US012560045B1

(12) United States Patent
Herrera et al.

(10) Patent No.: US 12,560,045 B1
(45) Date of Patent: Feb. 24, 2026

(54) SUBSEA WELL INTERVENTION SYSTEMS AND METHODS

(71) Applicant: Halliburton Energy Services, Inc., Houston, TX (US)

(72) Inventors: Adan H. Herrera, Carrollton, TX (US); Darrin N. Towers, Carrollton, TX (US); Kenneth L. Schwendemann, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/002,166

(22) Filed: Dec. 26, 2024

(51) Int. Cl.
*E21B 33/076* (2006.01)
*E21B 33/038* (2006.01)
*E21B 33/072* (2006.01)

(52) U.S. Cl.
CPC ..... *E21B 33/076* (2013.01); *E21B 33/038* (2013.01); *E21B 33/072* (2013.01)

(58) Field of Classification Search
CPC ..... E21B 33/076; E21B 33/038; E21B 33/072
USPC ..... 166/368
See application file for complete search history.

(56) References Cited

U.S. PATENT DOCUMENTS

| | | | | |
|---|---|---|---|---|
| 3,202,217 | A | 8/1965 | Watts et al. | |
| 3,517,736 | A | 6/1970 | Waldron | |
| 3,556,208 | A | 1/1971 | Dean | |
| 3,568,767 | A | 3/1971 | Weiss | |
| 4,023,619 | A | 5/1977 | Marquaire et al. | |
| 4,437,521 | A | 3/1984 | Richardson et al. | |
| 4,442,900 | A | 4/1984 | Padilla et al. | |
| 4,913,590 | A | 4/1990 | Svenning et al. | |
| 5,098,219 | A * | 3/1992 | Harrington | E21B 41/06 166/356 |
| 6,454,011 | B1 | 9/2002 | Schempf et al. | |

(Continued)

FOREIGN PATENT DOCUMENTS

| | | | |
|---|---|---|---|
| EP | 3434861 | B1 | 11/2023 |
| WO | 0220938 | A1 | 3/2002 |
| WO | 2007129899 | A1 | 11/2007 |

OTHER PUBLICATIONS

Dwayne M. Coleman, "An Improved Design of the Subsea Atmospheric System, Offshore technology Conference 4252," 14th Annual OTC in Houston, Texas, May 3-6, 1982. pp. 277-294.

(Continued)

*Primary Examiner* — Nicole Coy
*Assistant Examiner* — Douglas S Wood
(74) *Attorney, Agent, or Firm* — Conley Rose, P.C.; Rodney B. Carroll

(57) ABSTRACT

Disclosed embodiments relate to systems for providing well intervention for a subsea wellhead. For example, the system can comprise a tool insertion system and a subsea work chamber, with the tool insertion system operatively coupled to the subsea work chamber and to the wellhead. In embodiments, both the work chamber and the tool insertion system can be disposed subsea, for example in proximity to the wellhead. In some embodiments, the work chamber may be maintained at atmospheric pressure. In some embodiments, the tool insertion system can have a retracted position which provides access to a wireline within the work chamber, and an extended position which isolates the work chamber from the tool insertion system, the distal end of the wireline, an isolation valve, and/or the wellhead.

20 Claims, 36 Drawing Sheets

(56) References Cited

U.S. PATENT DOCUMENTS

| | | | | |
|---|---|---|---|---|
| 6,457,526 | B1 * | 10/2002 | Dailey | E21B 21/001 166/356 |
| 6,488,093 | B2 | 12/2002 | Moss | |
| 6,622,793 | B1 | 9/2003 | Rylov et al. | |
| 6,763,889 | B2 | 7/2004 | Rytlewski et al. | |
| 7,331,394 | B2 | 2/2008 | Edwards et al. | |
| 7,380,614 | B1 | 6/2008 | Williamson et al. | |
| 7,735,561 | B2 | 6/2010 | Johnson et al. | |
| 8,006,765 | B2 * | 8/2011 | Richards | E21B 19/146 166/341 |
| 8,973,665 | B2 | 3/2015 | Sbordone et al. | |
| 10,858,903 | B2 | 12/2020 | Carlsen et al. | |
| 11,168,528 | B2 * | 11/2021 | McGuire | E21B 23/10 |
| 11,598,170 | B1 | 3/2023 | Alsaleh | |
| 12,312,919 | B2 * | 5/2025 | Gupta | E21B 41/0007 |
| 2002/0134552 | A1 | 9/2002 | Moss | |
| 2003/0178200 | A1 | 9/2003 | Fox et al. | |
| 2005/0189115 | A1 * | 9/2005 | Rytlewski | E21B 47/00 166/344 |
| 2009/0050329 | A1 | 2/2009 | Johnson et al. | |
| 2009/0159273 | A1 | 6/2009 | Guerrero | |
| 2010/0163243 | A1 | 7/2010 | Sbordone | |
| 2010/0294479 | A1 | 11/2010 | Shee | |
| 2011/0005777 | A1 | 1/2011 | Meff | |
| 2014/0174716 | A1 | 6/2014 | Talgo et al. | |
| 2020/0063504 | A1 | 2/2020 | Logan et al. | |
| 2021/0010342 | A1 | 1/2021 | Turner et al. | |

OTHER PUBLICATIONS

Filing Receipt, Specification and Drawings for U.S. Appl. No. 19/002,219, entitled "Subsea Well Intervention Systems and Methods," filed Dec. 26, 2024, 168 pages.

Filing Receipt, Specification and Drawings for U.S. Appl. No. 19/002,319, entitled "Subsea Well Intervention Systems and Methods," filed Dec. 26, 2024, 168 pages.

Foreign Communication from Related Application—International Search Report and Written Opinion of the International Searching Authority, International Application No. PCT/US2025/011677, dated Sep. 19, 2025, 13 pages.

First Office Action dated Jun. 12, 2025 (15 pages), U.S. Appl. No. 19/002,219, filed Dec. 26, 2024.

First Office Action dated Jul. 24, 2025 (18 pages), U.S. Appl. No. 19/002,319, filed Dec. 26, 2024.

Foreign Communication from Related Application—International Search Report and Written Opinion of the International Searching Authority, International Application No. PCT/US2025/011657, dated Nov. 20, 2025, 12 pages. (ISRWO.

Foreign Communication from Related Application—International Search Report and Written Opinion of the International Searching Authority, International Application No. PCT/US2025/011671, dated Nov. 20, 2025, 12 pages.

Notice of Allowance dated Nov. 6, 2025 (16 pages), U.S. Appl. No. 19/002,319, filed Dec. 26, 2024.

* cited by examiner

SUBSEA WELL INTERVENTION SYSTEMS AND METHODS

CROSS-REFERENCE TO RELATED APPLICATIONS

Not applicable.

STATEMENT REGARDING FEDERALLY SPONSORED RESEARCH OR DEVELOPMENT

Not applicable.

FIELD

This disclosure relates generally to the field of hydrocarbon wells. More particularly, this disclosure relates to wireline intervention systems and methods for use in subsea well operations.

BACKGROUND

In the market today, there are many mature subsea production wells that require intervention work to improve or facilitate their continued production. For example, well intervention services may be carried out on a well during its productive life or at the end of its productive life. Well intervention can encompass many possible procedures which may be used on a well, for example altering the state of the well or well geometry, providing well diagnostics, or managing production of the well. In some embodiments, well intervention may be targeted at extending or improving production. In some embodiments, well intervention may be performed using a wireline/slickline. Exemplary well intervention procedures can include paraffin scraping, by way of non-exclusive example.

This need has conventionally been met by contacting a drill ship to perform the needed intervention work. Due to the limited availability and cost of contracting these types of vessels, many of the wells in need of intervention unfortunately go un-serviced. Additionally, weather events can sometimes prevent such conventional subsea well intervention, for example with weather windows inhibiting the timely maintenance of many subsea production wells (e.g. based on sea surface conditions, such as rough seas). Thus, there may exist a need for alternate systems and methods for providing timely and effective subsea well intervention, for example without regard to vessel availability and/or weather window issues.

BRIEF DESCRIPTION OF THE DRAWINGS

For a more complete understanding of the present disclosure, reference is now made to the following brief description, taken in connection with the accompanying drawings and detailed description, wherein like reference numerals represent like parts. These drawings illustrate certain aspects of some examples of the present disclosure and should not be used to limit or define the disclosure.

DETAILED DESCRIPTION

Figure 1:
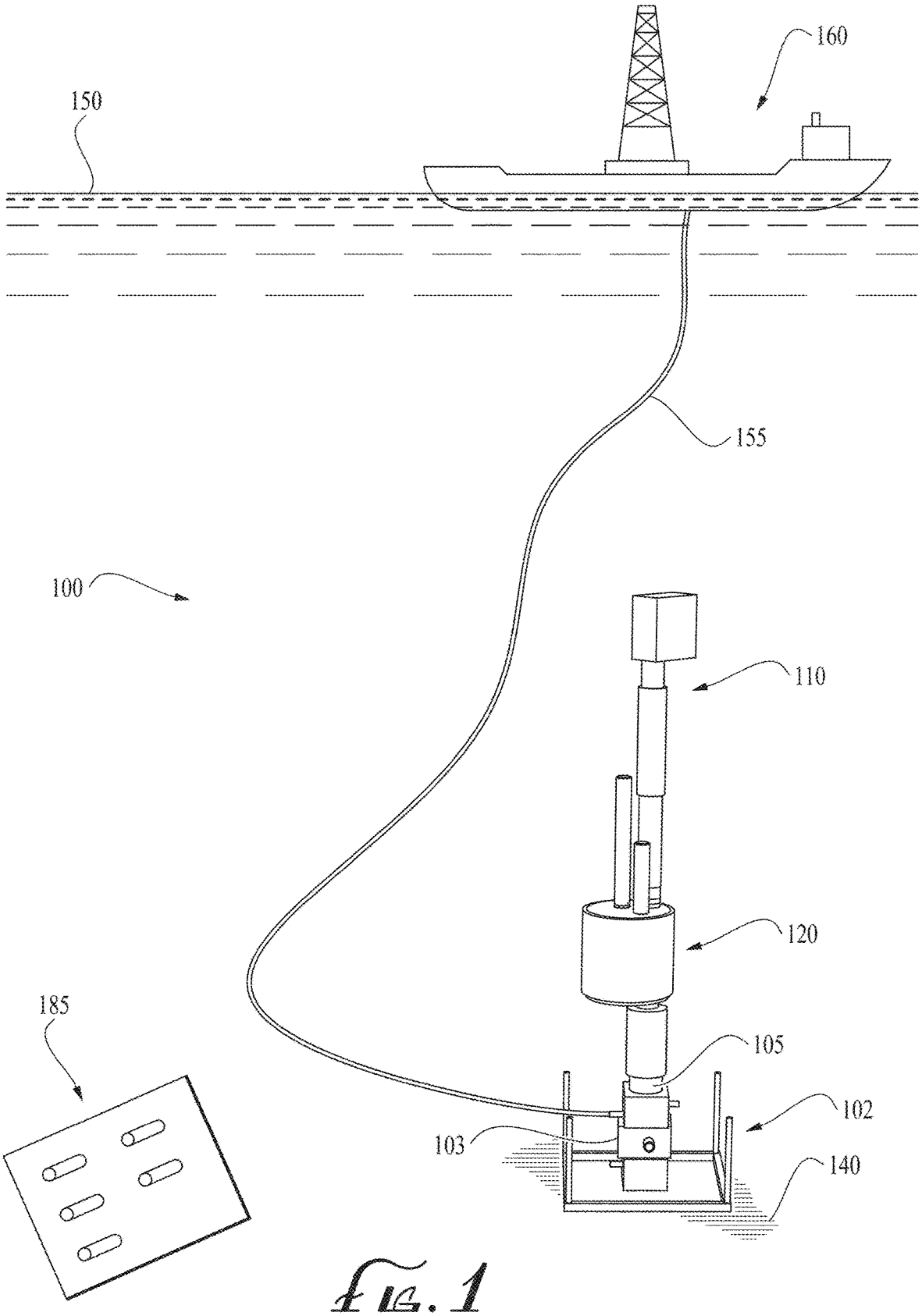
FIG. 1 is a diagram of an exemplary subsea well intervention system having a subsea work chamber and a tool insertion system coupled to an offshore/subsea well, according to an embodiment of the disclosure.

It should be understood at the outset that although illustrative implementations of one or more embodiments are illustrated below, the disclosed systems and methods may be implemented using any number of techniques, whether currently known or not yet in existence. The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description. The disclosure should in no way be limited to the illustrative implementations, drawings, and techniques illustrated below, but may be modified within the scope of the appended claims along with their full scope of equivalents.

As used herein the terms "uphole", "upwell", "above", "top", and the like refer directionally in a wellbore towards the surface, while the terms "downhole", "downwell", "below", "bottom", and the like refer directionally in a wellbore towards the toe of the wellbore (e.g. the end of the wellbore distally away from the surface), as persons of skill will understand. Orientation terms "upstream" and "downstream" are defined relative to the direction of flow of fluid. "Upstream" is directed counter to the direction of flow of fluid, while "downstream" is directed in the direction of flow of fluid, as persons of skill will understand.

Hydrocarbons are typically produced from wellbores drilled from the Earth's surface (e.g. the wellhead) through a variety of producing and non-producing subterranean zones. The wellbore may be drilled substantially vertically or may be drilled as a lateral well that has some amount of horizontal displacement from the surface entry point. In instances, the wellbore may be cased, open hole, contain tubing, and/or may generally be characterized as a hole in the ground having a variety of cross-sectional shapes and/or geometries as are known to those of skill in the art. While some wellbores may be located onshore (e.g. land-based wells), other wellbores may be located offshore (e.g. subsea wells, with the wellhead located undersea).

Wellbore servicing operations, such as well intervention, can be performed by lowering a downhole tool or tool string into the wellbore on a wireline/slickline, as persons of skill will readily appreciate. As used herein, the term "wireline" is intended to be understood broadly, for example including a wireline cable, a slickline cable, any derivative thereof, or any similar functional element/component. The wireline can operate as a conveyance mechanism used to transport the tool or tool string downhole into the wellbore, for example so that wellbore services such as intervention can be undertaken.

Conventional intervention for wells under the surface of the sea have proven to be limited, for example due to limited availability of the required vessels and/or due to weather windows (e.g. with inclement weather preventing timely well intervention, for example due to rough sea conditions). Disclosed embodiments relate to systems and methods which may address such issues (e.g. allowing subsea well intervention which is not restricted based on access to specific vessels (e.g. surface vessels) and/or due to weather events), for example by allowing for a robotic subsea intervention system to be placed on or in proximity to the seafloor (e.g. undersea). The subsea intervention system can be configured to provide timely wireline intervention without regard to vessel availability and/or weather window. Additionally, the system can be configured to operate without human operators undersea (e.g. without direct human intervention), for example either operating remotely (e.g. with human operators located on the sea surface and remotely operating elements of the system) and/or automatically (e.g. with robots performing pre-programmed tasks). In some embodiments, the subsea intervention system can be configured to be lightweight or even ultra-lightweight, which may minimize stress on the wellhead. Such disclosed subsea intervention systems may solve one or more concern arising from conventional systems and/or may provide useful functionality to improve well intervention in the subsea context, as persons of skill will appreciate.

By way of example, FIG. 1 illustrates an exemplary embodiment of a subsea well intervention system 100, which can be configured to provide well intervention for a subsea wellhead 102. The system 100 of FIG. 1 includes a tool insertion system 110 (e.g. configured to introduce wireline tools downhole in the well) and a subsea work chamber 120 (e.g. disposed undersea). The tool insertion system 110 can be operatively coupled to the subsea work chamber 120 and to the wellhead 102. In embodiments, the wellhead 102 can include a safety valve 105 and/or production (e.g. Christmas) tree 103, and the tool insertion system 110 can be coupled to the safety valve 105 and/or production tree 103. In embodiments, the wellhead 102 may also be operatively coupled to the surface 150 for production (e.g. of hydrocarbons), for example through the production tree 103 (e.g. via production tubing 155 extending to the surface 150, for example to a platform or ship 160). In this manner, the system 100 may be configured to allow for well intervention for a producing well. In some embodiments, the safety valve 105 may not include an emergency detaching system (e.g. configured for emergency decoupling of the tool insertion system 110 from the wellhead 102 and/or safety valve 105 and/or production tree 103). For example, the safety standards for the subsea well intervention system 100 (e.g. including the emergency detaching system and/or the safety factor for elements of the system, such as the subsea work chamber 120) can be reduced since there is no human operator located within the system.

Figure 2:
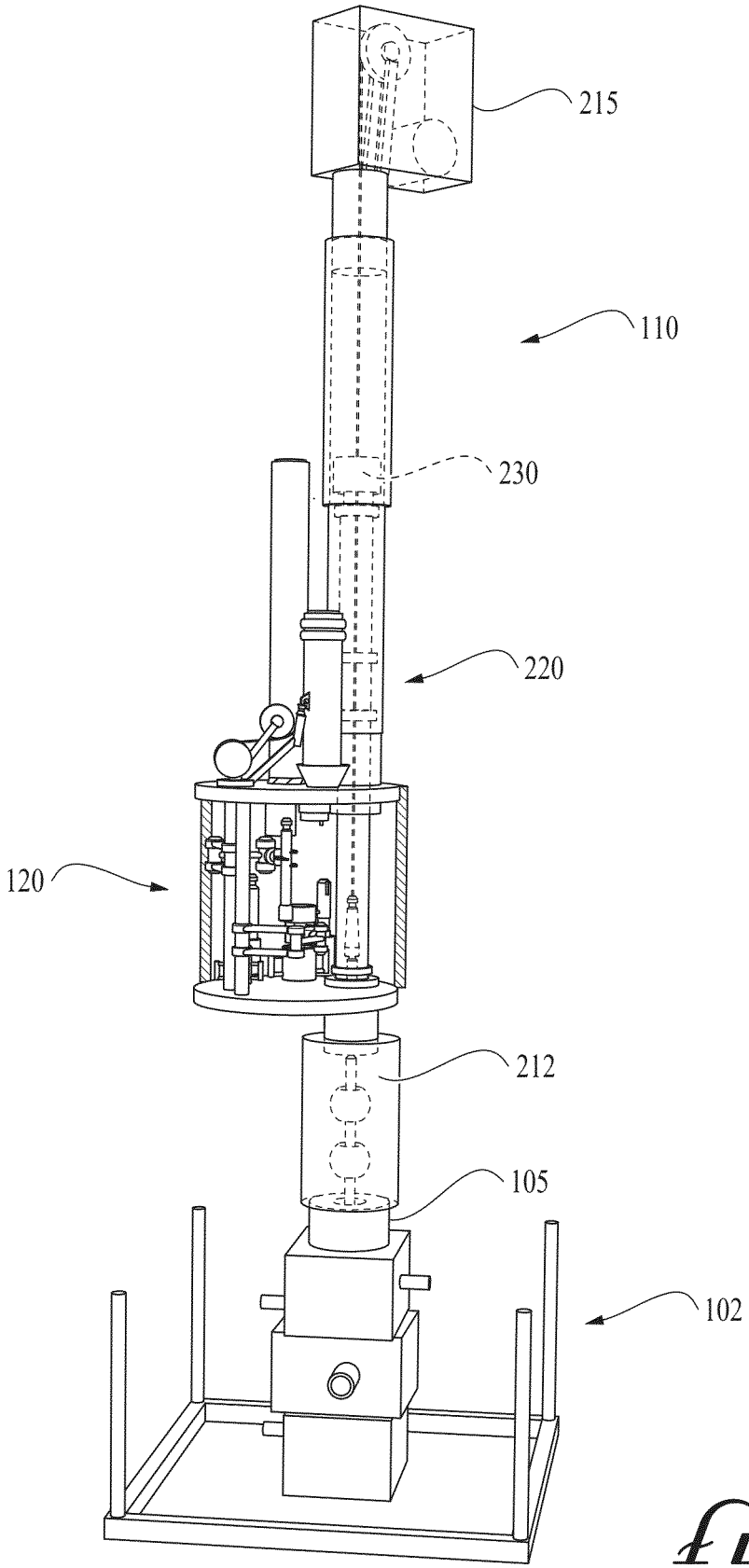
FIG. 2 is an isometric view of an exemplary subsea well intervention system, according to an embodiment of the disclosure.
Figure 3:
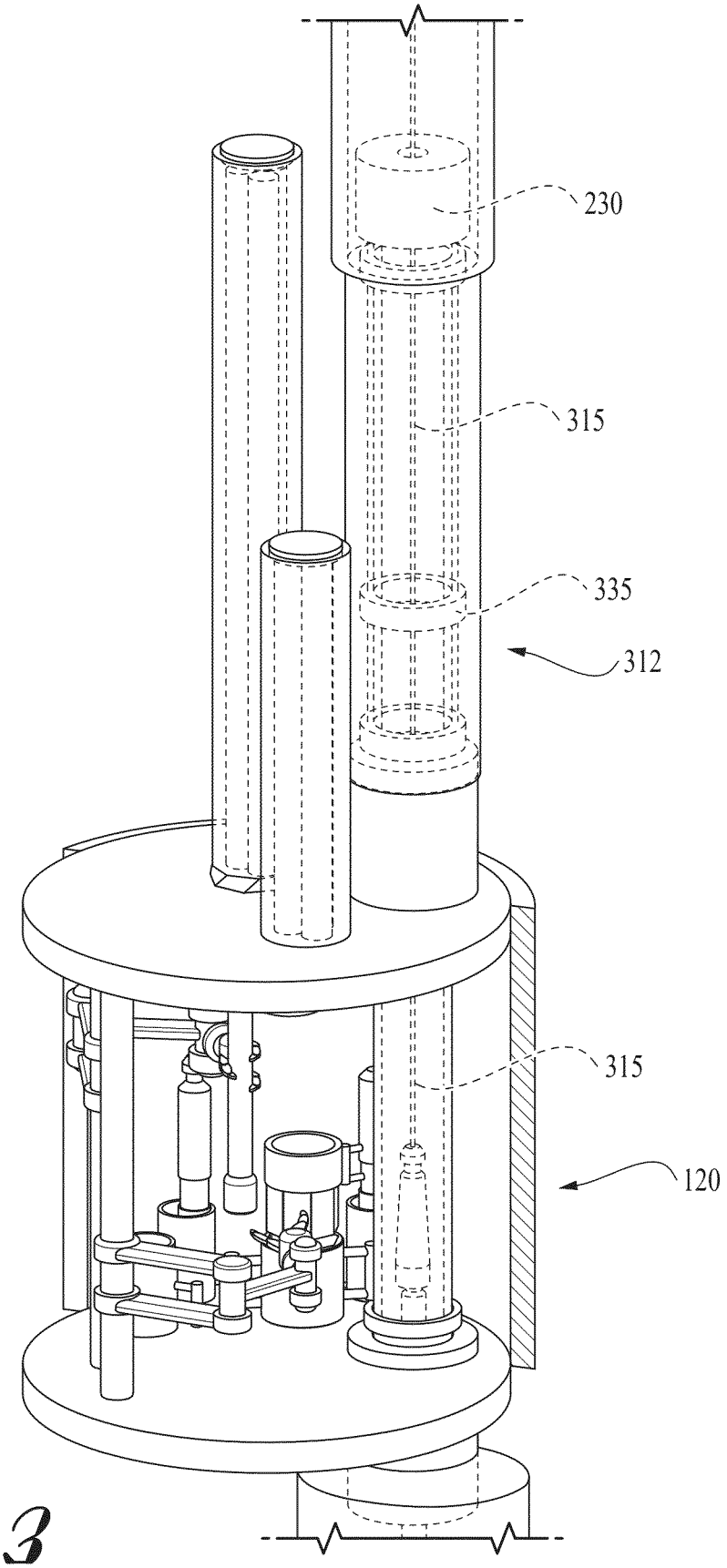
FIG. 3 is a diagram of an exemplary tool insertion system, according to an embodiment of the disclosure.

FIGS. 2-3 illustrate some aspects of the system 100, including the tool insertion system 110, in further detail. In embodiments, the tool insertion system 110 can include a wireline reeler unit 215 (e.g. having a wireline 315), a lubricator system 220 (e.g. a lubricator valve 212, for example configured to allow isolation of the system 100 (e.g. the subsea work chamber 120) from the wellhead 102, a lubricator conduit 312 coupled to the lubricator valve 212, for example disposed between the subsea work chamber 120 and the lubricator valve 212 and/or with its proximal end coupled to the subsea work chamber 120 and its distal end coupled to the lubricator valve 212 and/or configured to be placed into fluid communication with the lubricator valve 212), and a moveable wireline stuffing box 230 (e.g. configured to move axially within the lubricator system 220). In the embodiment of FIG. 3, the lubricator conduit 312 can include a telescoping conduit, as will be discussed in more detail below). The wireline 315 from the wireline reeler unit 215 passes through the wireline stuffing box 230, with the wireline reeler unit 215 configured to move (e.g. extend/ retract) the wireline 315. Typically, the wireline stuffing box 230 would be disposed between the distal end of the wireline 315 and the wireline reeler unit 215 (e.g. sealing passage of the wireline therethrough), and the wireline reeler unit 215 would be configured to control the amount of wireline 325 extending beyond the wireline stuffing box 230.

Figure 4A:
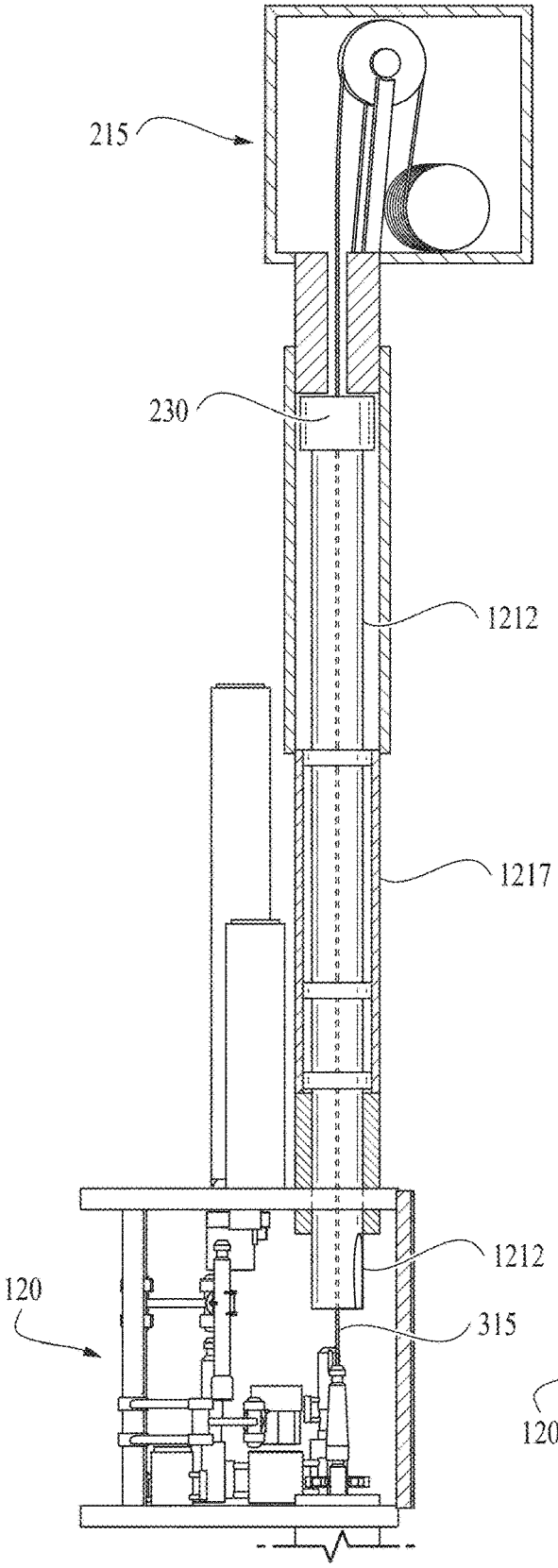
FIG. 4A illustrates a retracted position of the tool insertion system of FIG. 3, according to an embodiment of the disclosure.
Figure 4B:
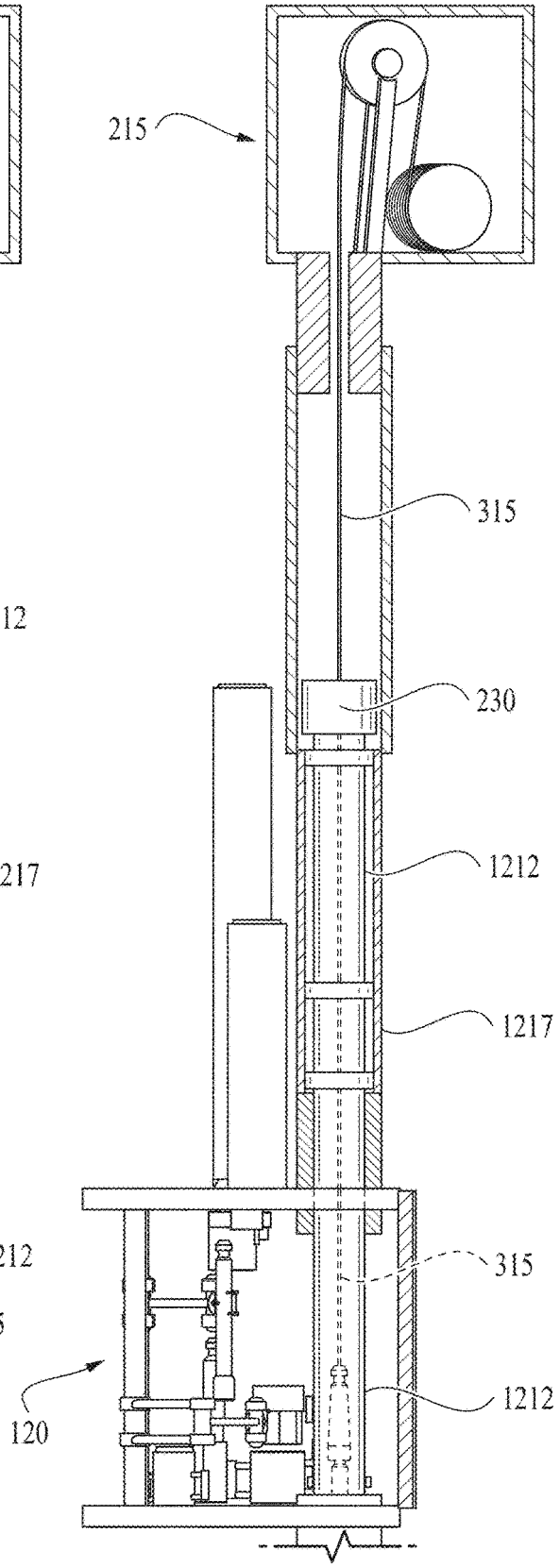
FIG. 4B illustrates an extended position of the tool insertion system of FIG. 3, according to an embodiment of the disclosure.

In embodiments, the moveable wireline stuffing box 230 can have a retracted position (e.g. see FIG. 4A) and an extended position (e.g. see FIG. 4B), with the retracted position providing an open area within the subsea work chamber 120 (e.g. between the moveable stuffing box 230 and the lubricator conduit 312 or lubricator valve 212) allowing access to the wireline 315 (e.g. for tool attachment and/or removal of the tool to the distal end of the wireline), and with the extended position isolating the subsea work chamber 120 from the lubricator system 220 (e.g. the lubricator conduit 312 and/or the lubricator valve 212) and/or the distal end of the wireline. For example, FIG. 4A illustrates an exemplary retracted position of the wireline stuffing box 230 and/or telescoping conduit 1212, providing an open gap within the work chamber 120 (e.g. between the two connectors) allowing access to the distal end of the wireline for tool attachment. FIG. 4B illustrates an exemplary extended position of the wireline stuffing box 230 and/or telescoping conduit 1212 (e.g. with the telescoping conduit 1212 spanning the work chamber 120 to sealingly engage the connector 560 to the lubricator valve 212), which can isolate the work chamber 120 from the distal end of the wireline and/or the lubricator valve 212.

Figure 5A:
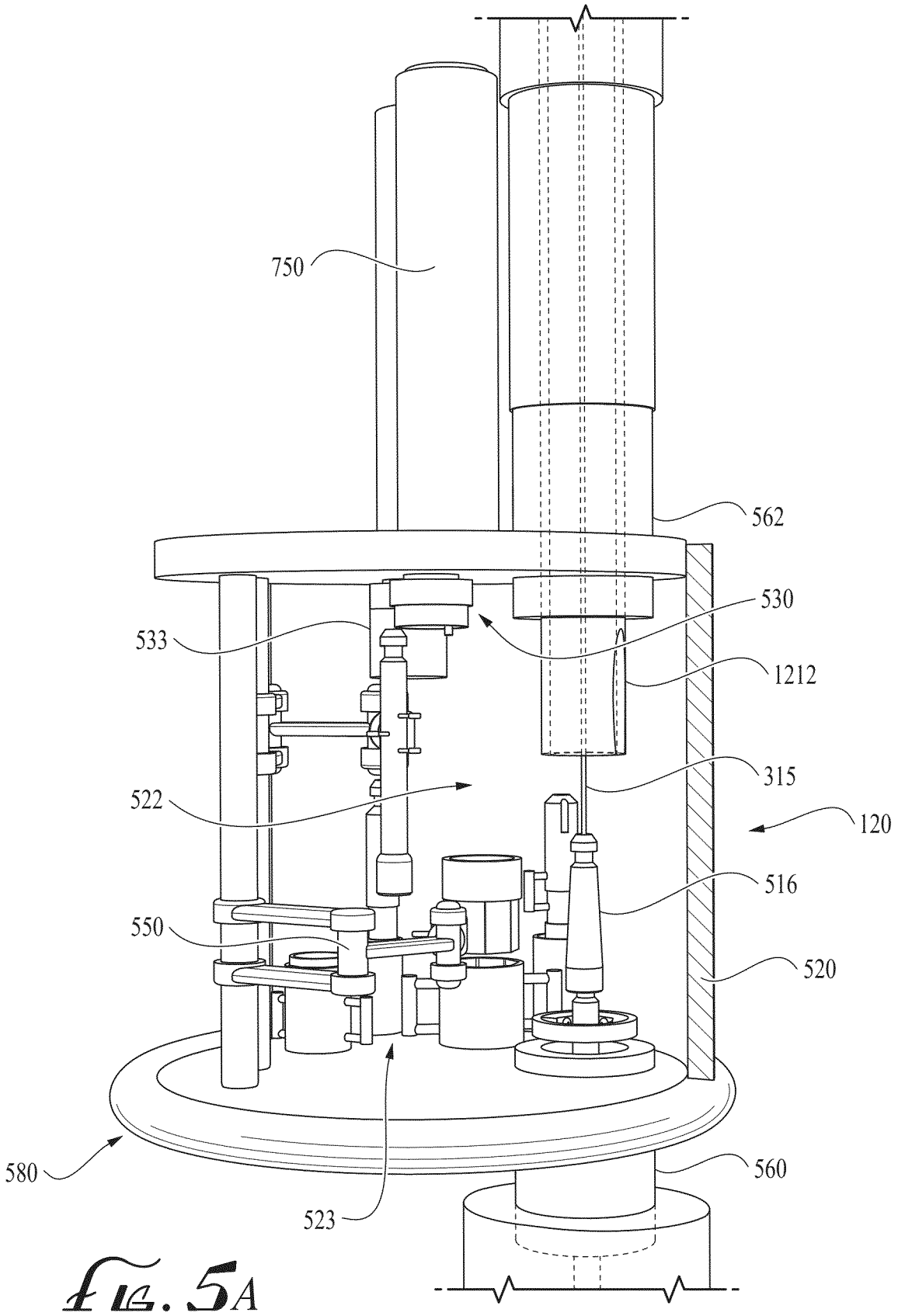
FIGS. 5A-C illustrate an exemplary subsea work chamber embodiment, according to an embodiment of the disclosure.
Figure 5B:
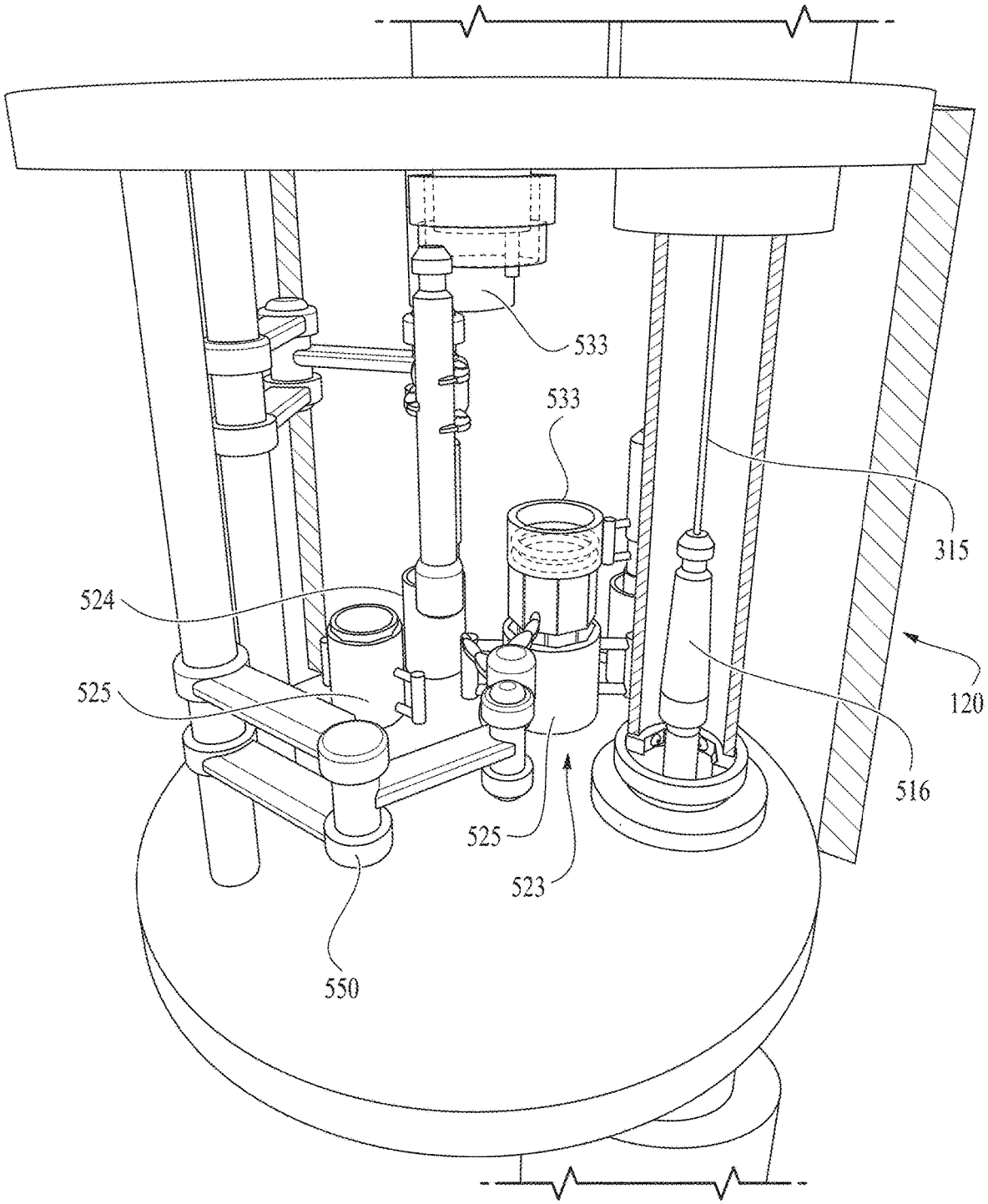
Figure 5C:
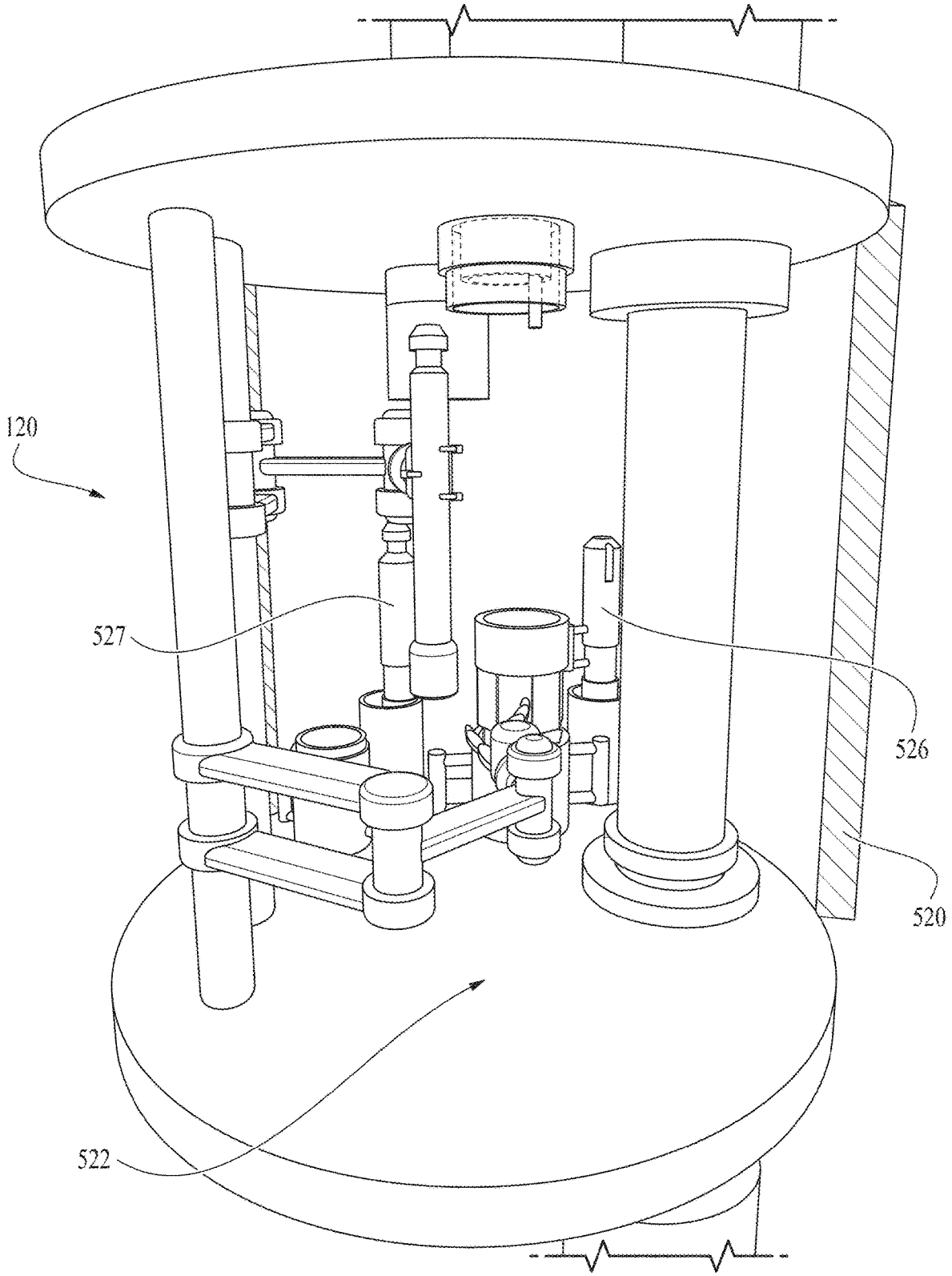

FIGS. 5A-C illustrate additional details for embodiments of the subsea work chamber 120. In embodiments, the subsea work chamber 120 can include a sealed/isolated chamber 520 (e.g. configured to withstand subsea pressure) having an internal work space 522, one or more (e.g. two or three) port 530 configured for tool canister/pod 750 docking (e.g. insertion of corresponding tool canister 750 with removable seal coupling), and a robotic assembly mechanism 550 (e.g. configured to remove tools from the docked canister 750, to connect one or more tool to the wireline 315, to make up a tool string, and/or to insert tools back into the docked canister 750). The subsea work chamber 120 can be configured to operatively couple to the lubricator system 220 and/or to the wireline reeler unit 215 (e.g. to the tool insertion system 110, and thereby to the wellhead 102). For example, the subsea work chamber 120 can comprise a first connector 560, configured for (e.g. fluid communication) coupling of the subsea work chamber 120 with the lubricator system 220 and/or wellhead 102 (e.g. having an opening between the internal work space 522 of the chamber 120 and the lubricator system 220), and a second connector 562 configured for (e.g. fluid communication) coupling of a wireline reeler unit 215 and/or wireline stuffing box 230 to the subsea work chamber 120 (e.g. having an opening between the internal work space 522 of the chamber 120 and the wireline reeler unit 215 and/or wireline stuffing box 230).

Figure 6A:
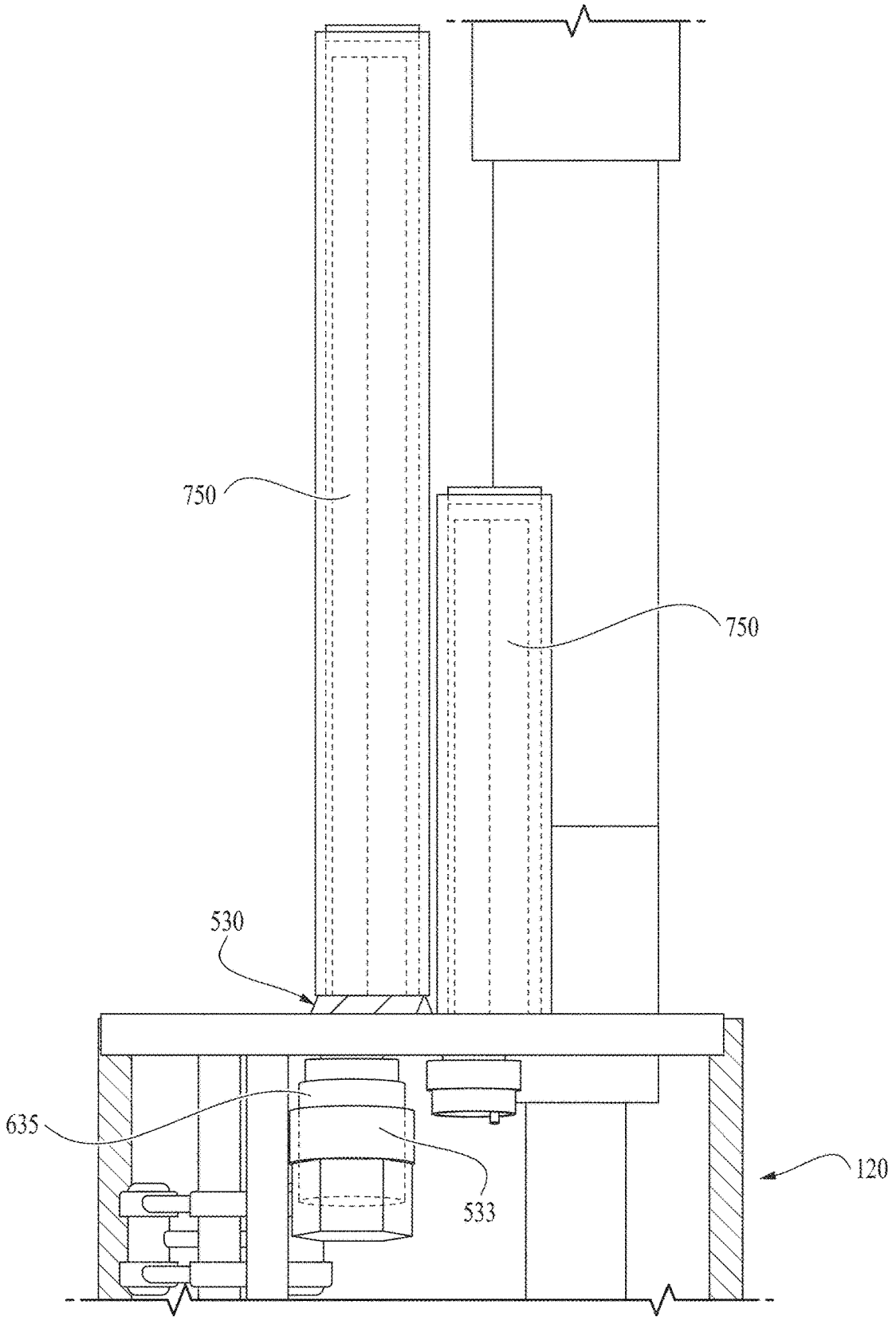
FIGS. 6A-C illustrates an exemplary subsea tool provision system, showing interaction between an exemplary tool canister and an exemplary subsea work chamber, according to an embodiment of the disclosure.
Figure 6B:
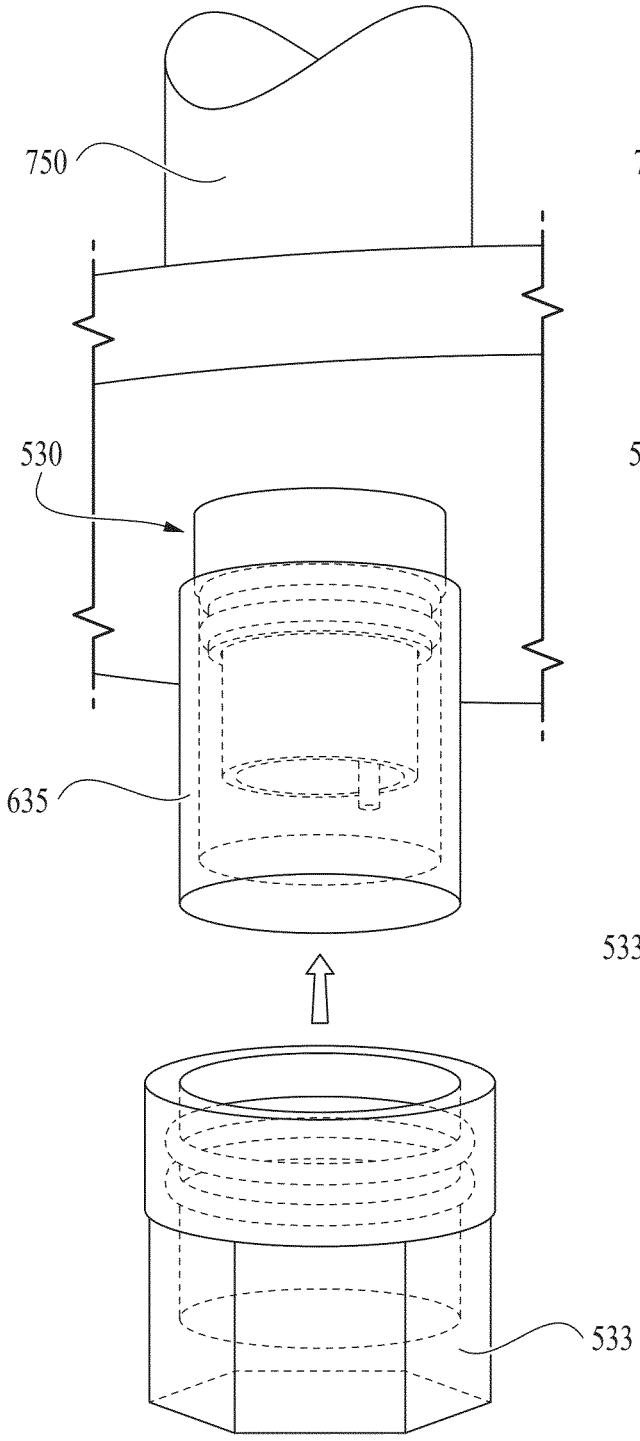
Figure 6C:
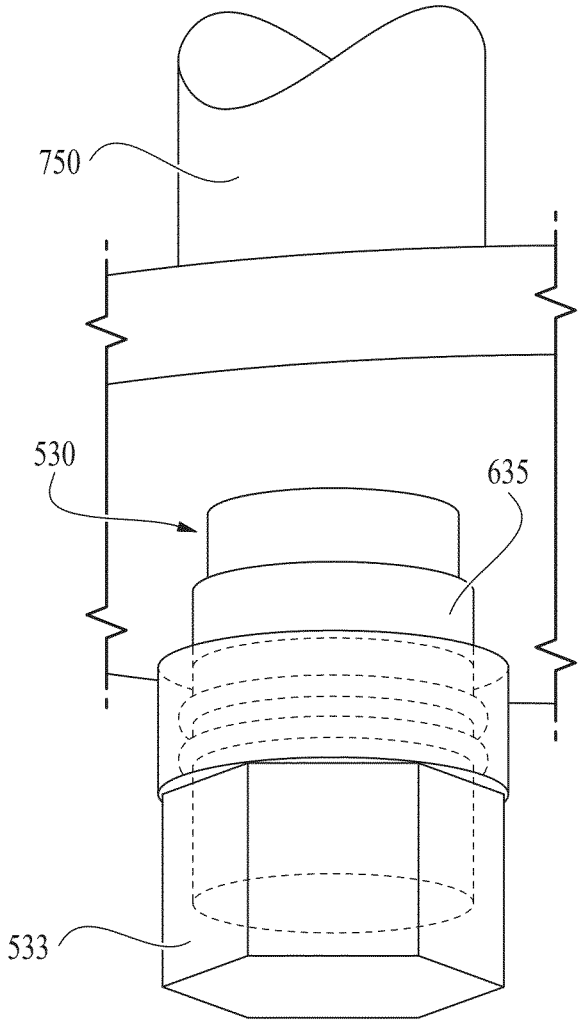

FIGS. 6A-C illustrate an exemplary port 530 (e.g. for a subsea work chamber 120, similar to FIG. 5A) and its interaction with a corresponding exemplary tool canister 750 (e.g. disposed/docked in the port 530). In embodiments, the port 530 can include a removable port cap 533, which can be configured to sealingly close the port 530. In FIG. 6A, one port cap 533 is shown on its port 530 (e.g. sealing it closed), and one port cap 533 is shown having been removed from its port 530 (e.g. removed to allow access to the tool canister 750 docked in the port 530, with FIG. 6B showing the corresponding opened port 530 with its port cap removed). Each port 530 can be configured to sealingly receive the corresponding tool canister 750, such that when the tool canister 750 is docked in the port 530, its canister cap 635 can be nested within the port cap 533 (see for example FIGS. 6B-C-illustrating an embodiment in which the canister cap 635 can be nested within the port cap 533 (e.g. when disposed in the sealed area of the port), such that removal of the port cap 533 exposes the canister cap 635, and removal of the canister cap 635 exposes the tool(s) in the canister 750 for removal). In some embodiments, the subsea work chamber 120 may be configured to maintain approximately atmospheric pressure therein (e.g. when coupled to the tool insertion system, thereby closing the connector openings 560, 562), and the robotic assembly mechanism 550 may comprise conventional robotic equipment (e.g. configured to operate in approximately atmospheric conditions/pressure and/or not configured for use in high pressure/subsea environments). For example, the subsea work chamber 120 may be configured to protect/shield the robotics therein from the subsea conditions, thereby allowing conventional robotics to be used for subsea intervention.

The port 530 may be configured to maintain the chamber pressure, for example by pumping fluid into or out of the sealed portion of the port 530 (e.g. between the port cap and a port seal). In some embodiments, the sealed chamber 520 can be configured to be coupled (e.g. tethered and/or anchored) to the wellhead 102 and/or seabed (e.g. through the lubricator system 220 and/or tool insertion system 110 and/or safety valve 105). For example, the subsea work chamber 120 may have a floatation device 580 (e.g. a floatation ring disposed around an exterior of the sealed chamber 520, as in FIG. 5A). The floatation device 580 can be configured to make the subsea work chamber 120 ultra-lightweight on the wellhead 102, for example configured to provide approximately neutral buoyancy.

Figure 8A:
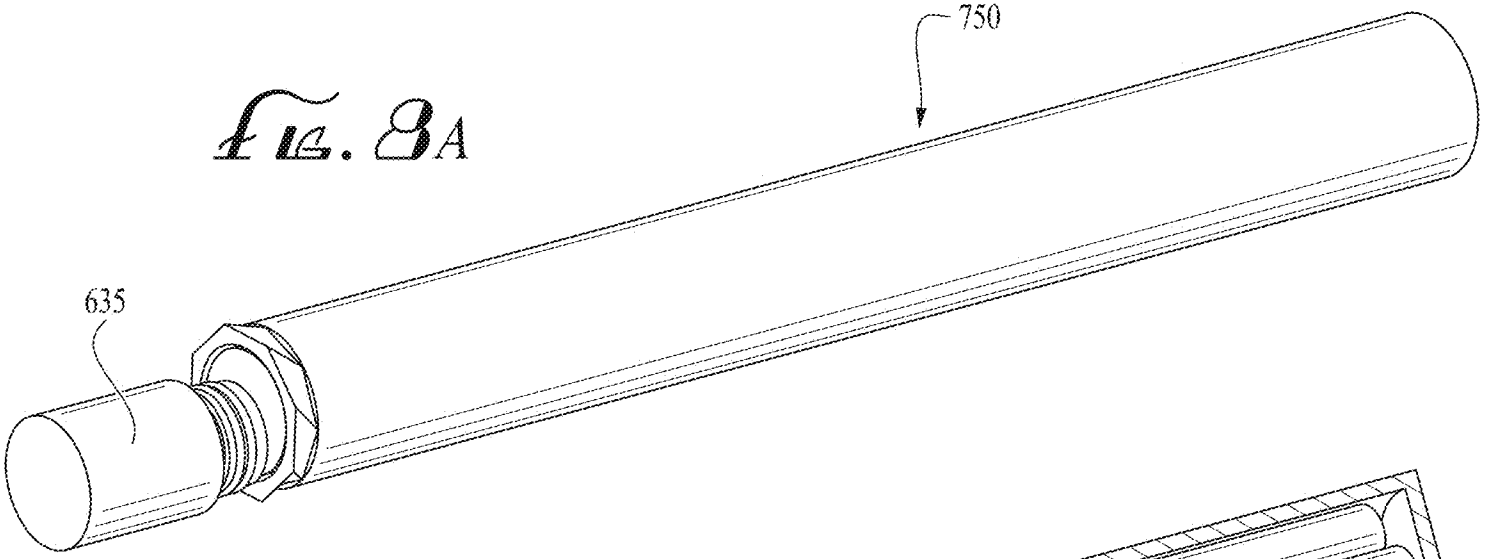
FIGS. 8A-L illustrate aspects of exemplary tool canister embodiments, according to an embodiment of the disclosure.
Figure 8B:
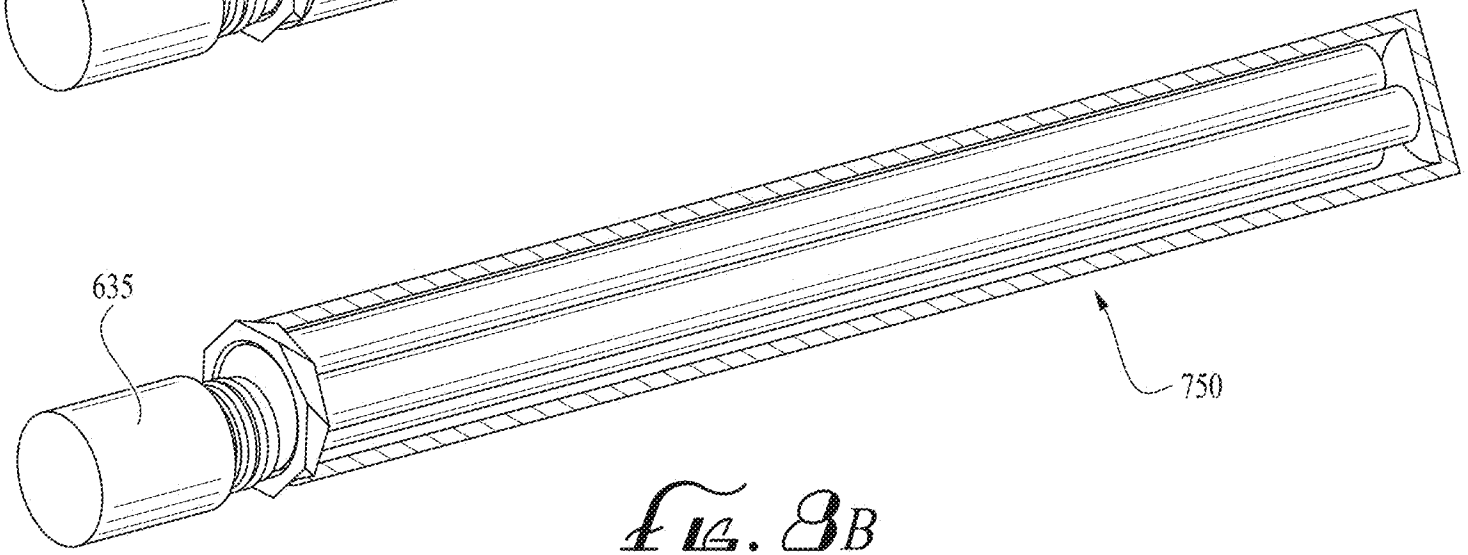
Figure 8C:
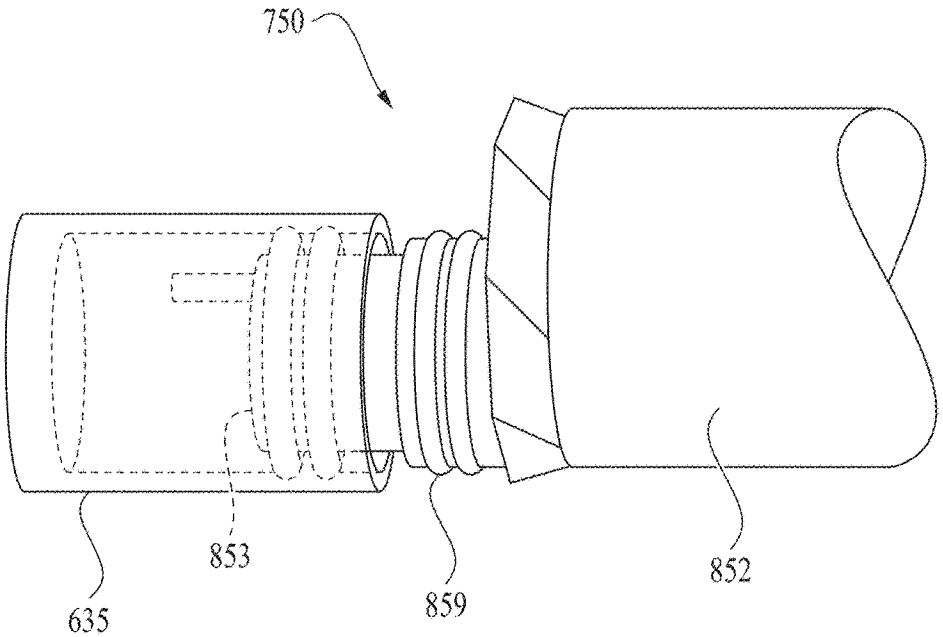
Figure 8D:
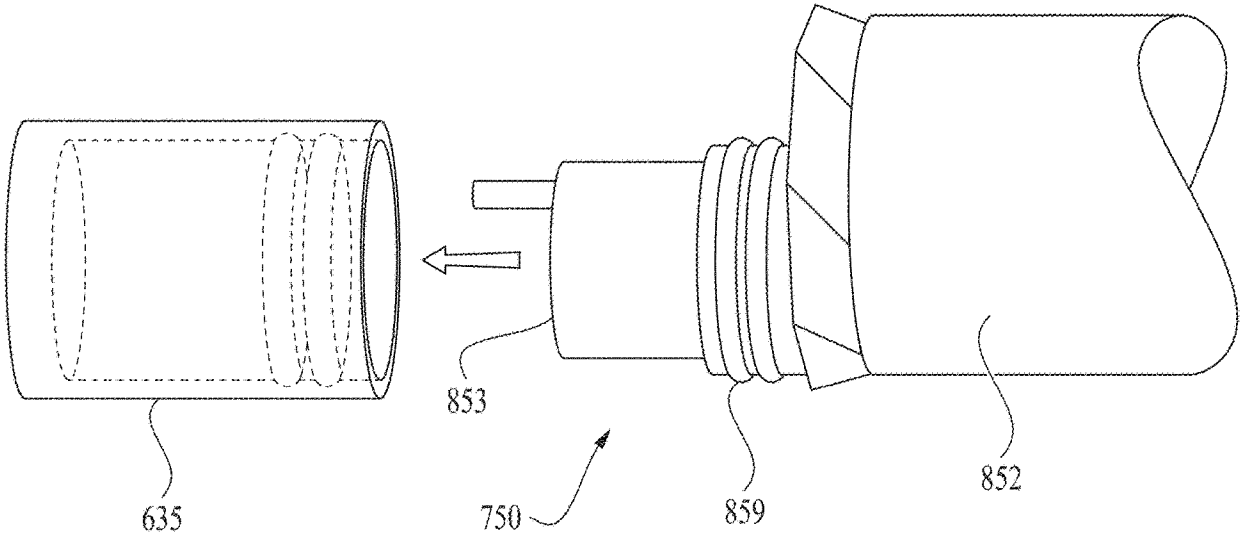
Figure 8E:
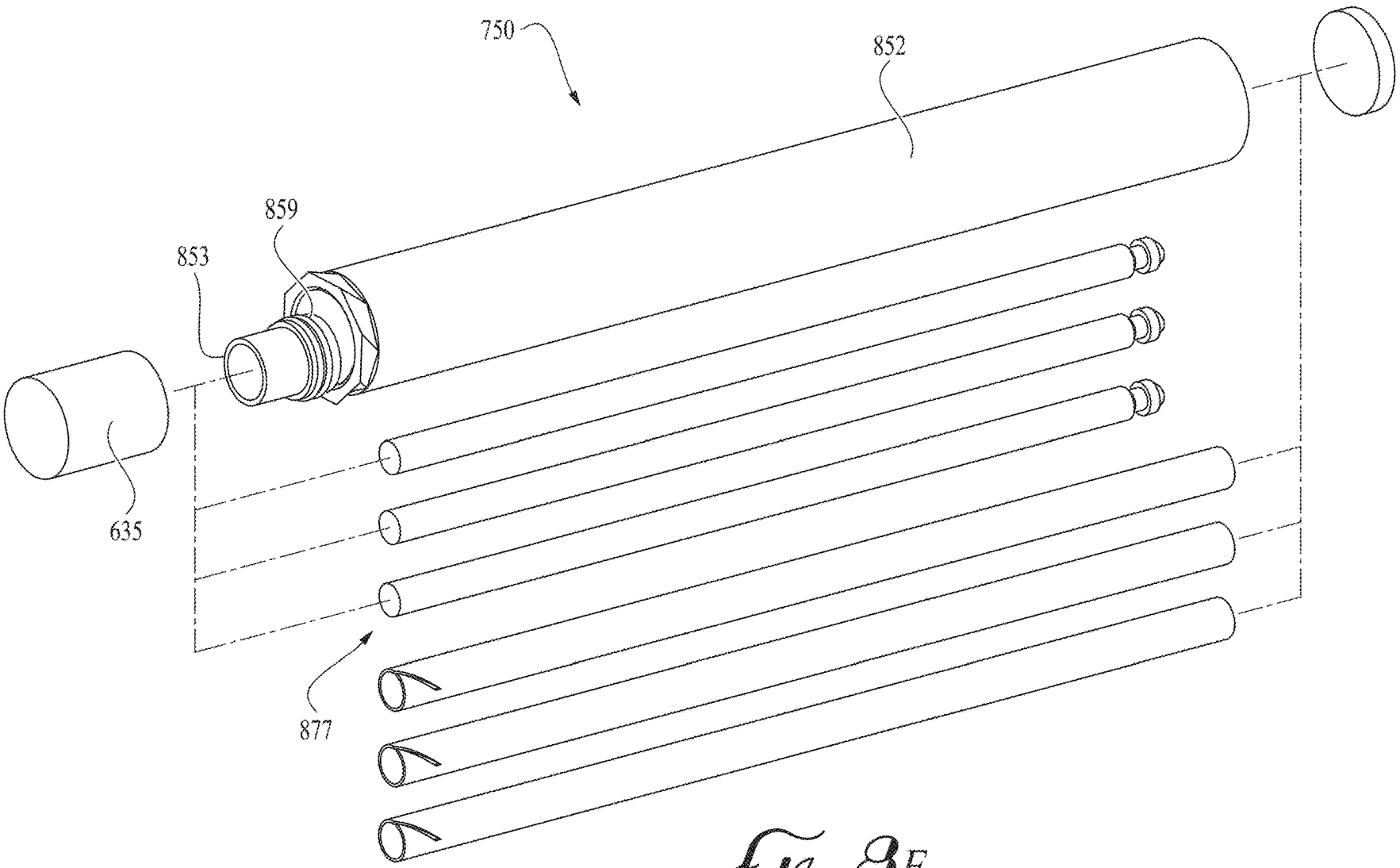
Figure 8F:
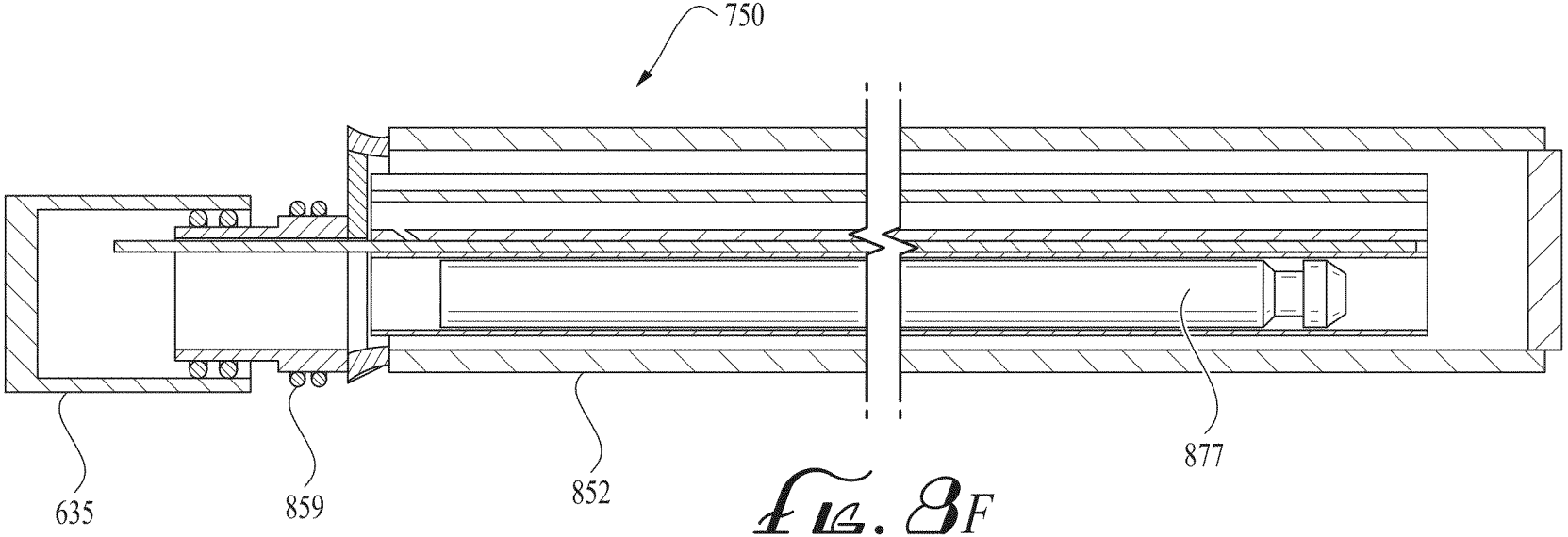
Figure 8G:
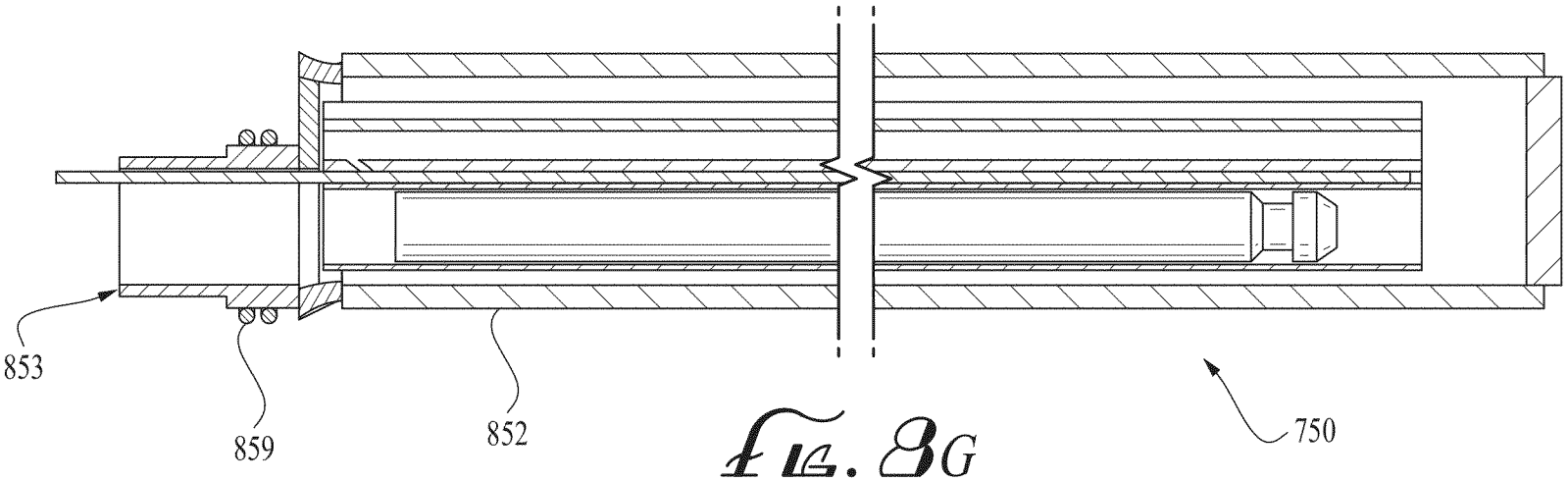
Figure 8H:
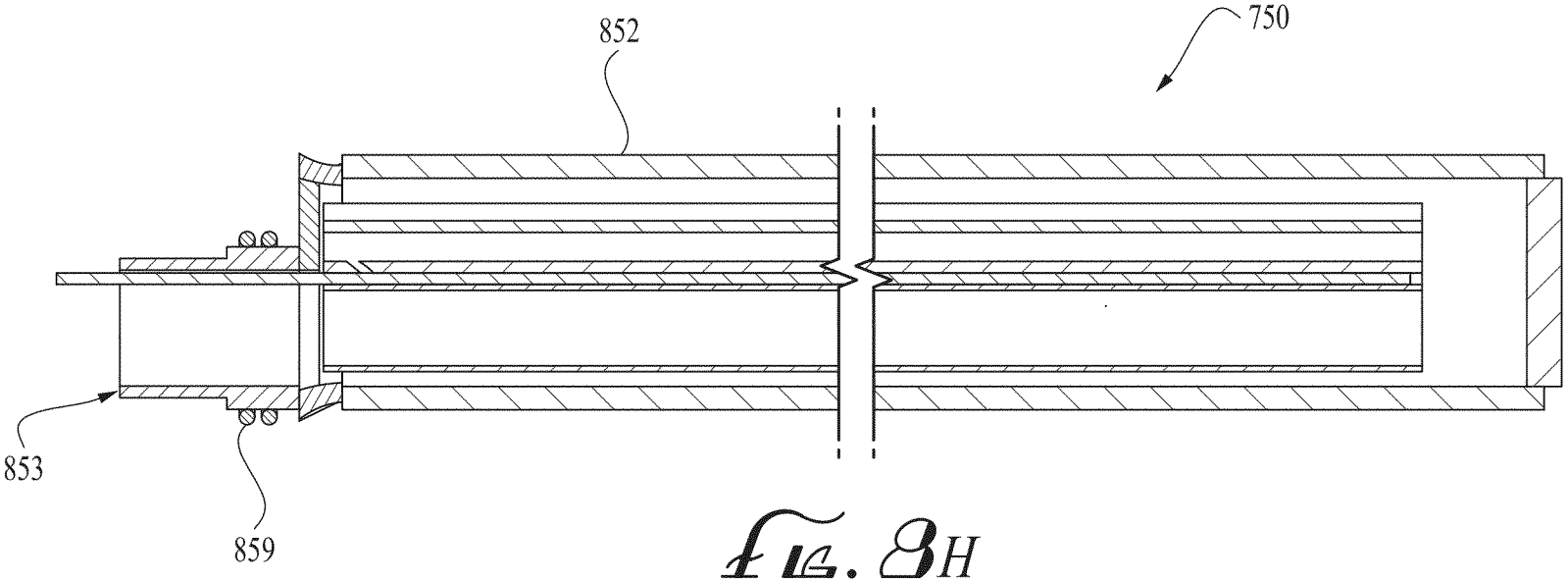
Figures 8I, 8J, 8K:
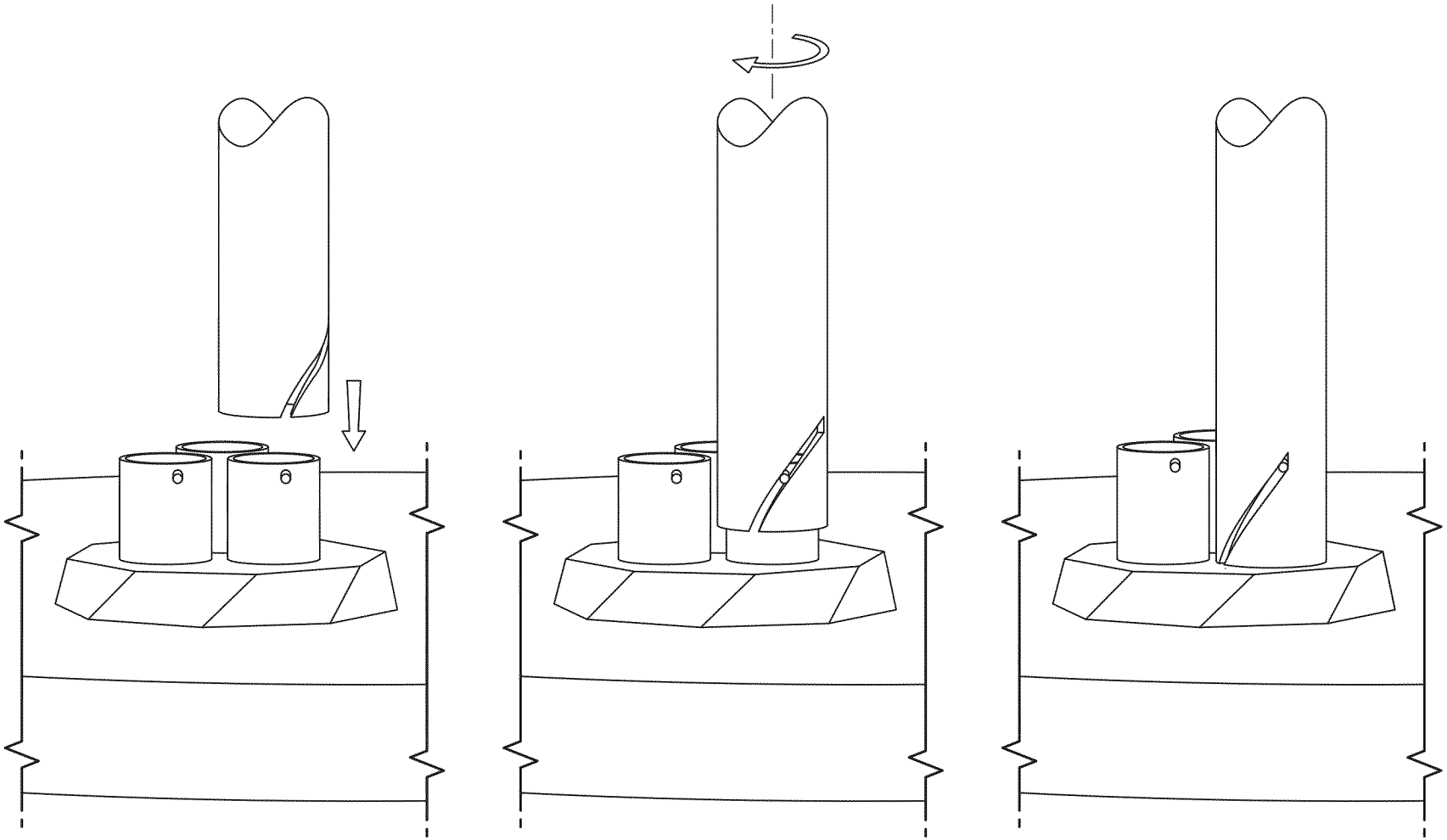
Figure 8L:
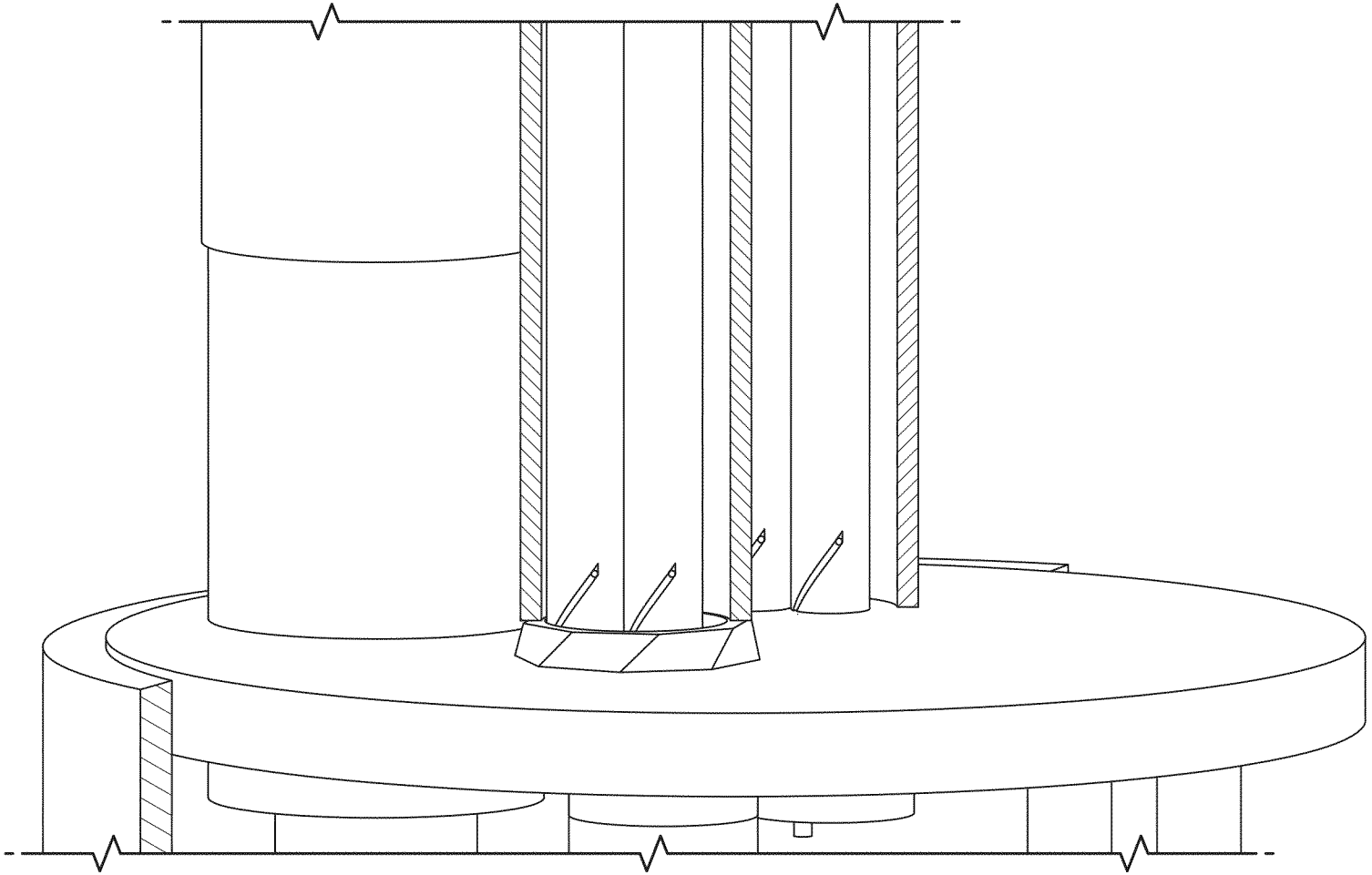
Figure 9:
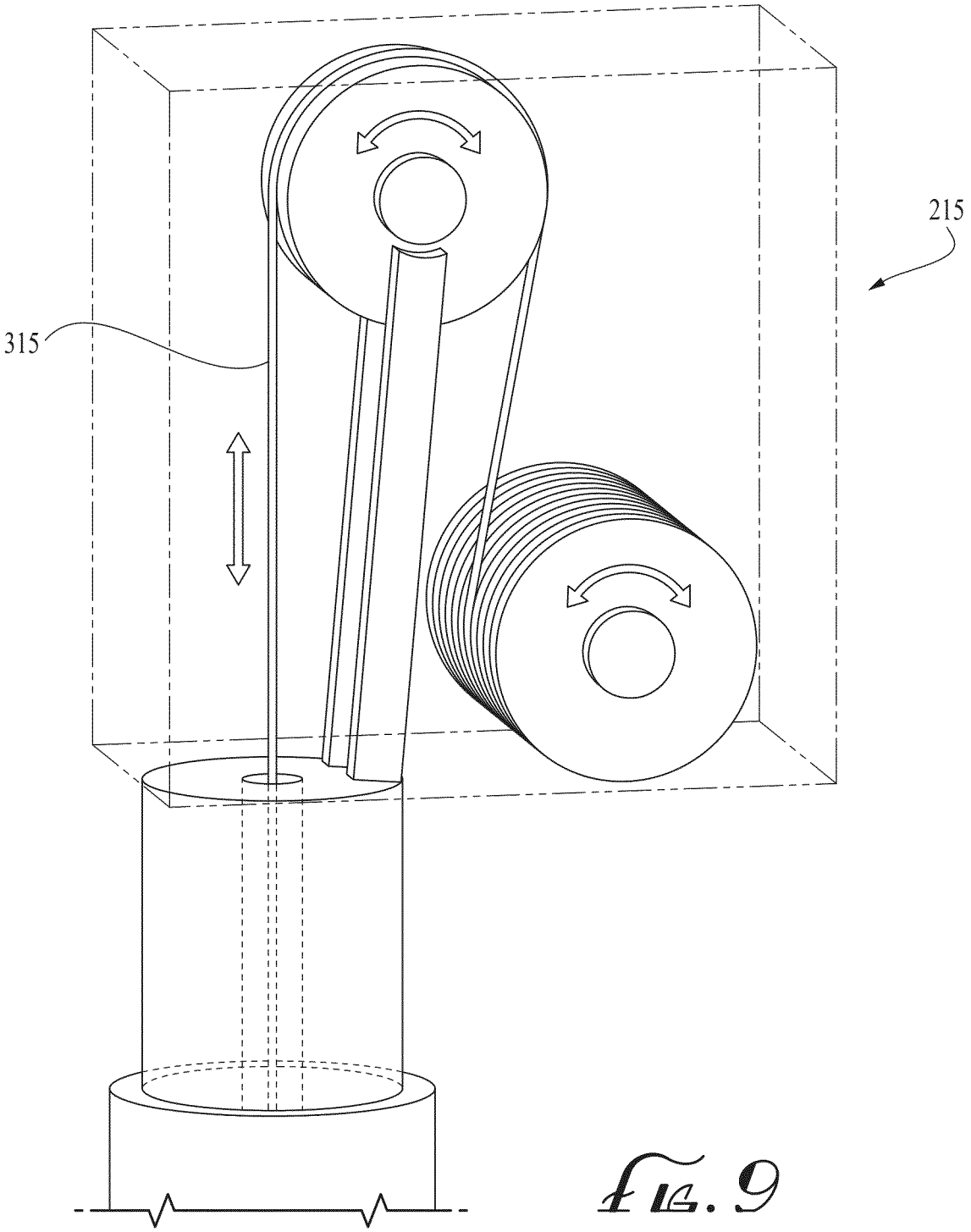
FIG. 9 illustrates an exemplary wireline reeler unit, according to embodiments of the disclosure.

In some embodiments, the system 100 can further comprise one or more tool canister 750 (e.g. configured for delivery of well intervention tools to the subsea work chamber 120). FIGS. 8A-L illustrate an exemplary tool canister 750, for example with FIG. 8A showing an isometric view of the tool canister 750 with its canister cap 635 on (e.g. sealing the interior of the canister from the external sea environment), FIG. 8B illustrating via partial cut-away the interior of the tool canister 750, FIG. 8C illustrating the open end 853 of the tool canister 750 configured for insertion into the corresponding port 530 of the subsea work chamber 120 (with its canister cap 635 thereon to seal the interior), FIG. 8D showing an exploded isometric view of how the canister cap 635 is removable from the open end 853 of the tool canister 750, FIG. 8E showing an exploded isometric view of the entire exemplary tool canister 750 with exemplary tools 877 removed, FIG. 8F showing a cross-sectional view the canister 750 of FIG. 8A, FIG. 8G showing a cross-sectional view of the canister 750 of FIG. 8D, FIG. 8H showing a cross-sectional view of the canister 750 of FIG. 8E, and FIGS. 8I-L illustrating exemplary elements of the tool canister 750 for holding the tools in place within the pod (e.g. an exemplary tool locking/retaining mechanism schematically).

For example, the tool canister 750 can include a canister/pod 852 configured to hold one more tool (e.g. wireline and/or well intervention tool) and having an open end 853, and a removable canister cap 635 configured to sealingly close the open end 853 of the canister/pod 852. In embodiments, the tool canister 750 can be configured to sealingly engage with a port 530 of the subsea work chamber 120, to create a sealed section around the canister cap 635 (e.g.

between a port cap 533 of the port 530 and a portion of the port 530 outward of the received canister cap 635).

Figure 7:
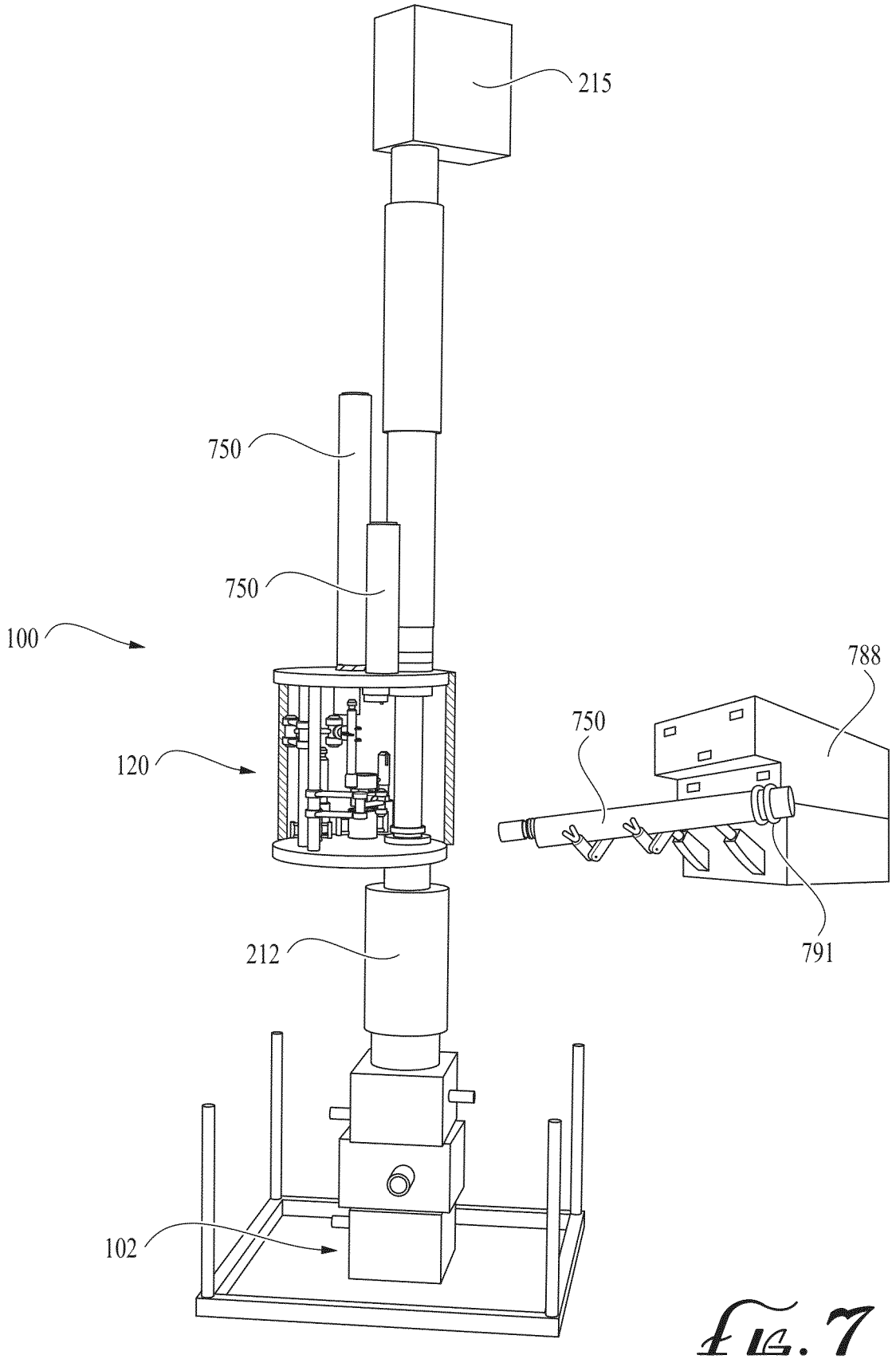
FIG. 7 illustrates delivery of an exemplary tool canister to an exemplary subsea work chamber by an exemplary ROV, according to an embodiment of the disclosure.

Some system embodiments can also include a mechanism configured to provide/deliver the tool canister 750 to the subsea work chamber 120 (e.g. to insert the canister into the port 530). For example, the mechanism can comprise a remotely operated vehicle (an ROV 788, or potentially a plurality of ROVs—see for example FIG. 7) and/or an external wireline system 1101 (see for example FIG. 11A-E) coupled to the surface (e.g. of the sea—for example to a ship or platform 160, but typically not a drill ship). Some system embodiments may also include one or more connector configured to removably couple/link elements of the subsea well intervention system 100 together (e.g. to couple the lubricator valve 212 to the safety valve 105, the lubricator conduit 312 to the lubricator valve 212, the lubricator conduit 312 to the subsea work chamber 120, the lubricator valve 212 to the subsea work chamber 120, a guide conduit 1217 to the subsea work chamber 120, and/or the wireline reeler unit 215 to the guide conduit 1217 and/or lubricator section 220 and/or work chamber 120.

Some embodiments can further include subsea (e.g. seabed) storage warehousing 185 (see for example FIG. 1), which can be configured to hold a plurality of tool canisters 750 and/or one or more ROV 788 subsea (e.g. in proximity to the wellhead 102 or to a plurality of wellhead 102*s*). In some embodiments, the system 100 can also have a ship or platform 160 at the surface 150 (e.g. of the sea). For example, the ship or platform 160 can be configured to produce the well (and typically is not a drill ship)—see for example FIG. 1. In some embodiments, the ship or platform 160 may house a plurality of tool canisters 750 for use with the subsea work chamber 120. For example, the ship or platform 160 can be configured to removably couple the tool canister 750 to an external wireline system 1101 for delivery of the tool canister 750 to the work chamber 120.

Typically, the system 100 does not include a riser to the surface 150. For example, the subsea work chamber 120 and/or tool insertion system 110 may either be disposed on the seabed or anchored/tethered to the wellhead 102, without a riser extending to the sea surface 150. In some embodiments, communication with the subsea work chamber 120 (e.g. the wireline 315, the tool, and/or the robotic assembly mechanism 550) can be through a pre-existing umbilical of the wellhead 102 (and this can be the only communication mechanism with the surface in some embodiments). In embodiments, the subsea work chamber 120 can be operated exclusively subsea. For example, the subsea work chamber 120 may be disposed in proximity to the seabed floor 140 (for example approximately 7-50 feet, 7-30 feet, 7-20 feet, 7-15 feet, 10-50 feet, 10-30 feet, 10-20 feet, 10-15 feet, 15-50 feet, 15-30 feet, 15-20 feet, or approximately 15 feet) and/or for storage or use on another well in the local field.

While various elements of the subsea well intervention system 100 have been briefly described above, more detailed descriptions of embodiments follow. For example, the subsea work chamber 120 can include a sealed/isolated chamber 520 (e.g. configured to withstand subsea pressure) having an internal work space 522, one or more (e.g. two or three) port 530 configured for tool canister/pod 750 docking (e.g. insertion of corresponding tool canister 750 with removable seal coupling), and a robotic assembly mechanism 550 (e.g. configured to remove tools from the docked canister 750, to connect one or more tool to the wireline 315, to make up a tool string, and/or to insert tools back into the docket canister 750). See for example FIGS. 5A-C. The subsea work chamber 120 can be configured to operatively couple to the lubricator system 220 and/or to the wireline reeler unit 215 (e.g. to the tool insertion system 110). For example, the subsea work chamber 120 can comprise a first connector 560, configured for (e.g. fluid communication) coupling of the subsea work chamber 120 with the lubricator system 220 and/or wellhead 102 (e.g. having an opening between the internal work space 522 of the chamber and the lubricator system 220), and a second connector 562 configured for (e.g. fluid communication) coupling of a wireline reeler unit 215 and/or wireline stuffing box 230 to the subsea work chamber 120 (e.g. having an opening between the internal work space 522 of the chamber and the wireline reeler unit 215 and/or wireline stuffing box 230).

In embodiments, the port 530 can include a removable port cap 533, which can be configured to sealingly close the port 530. The port 530 can be configured to sealingly receive the corresponding tool canister 750, such that when the tool canister 750 is docked in the port 530, its canister cap 635 can be nested within the port cap 533 (see for example FIG. 6). In some embodiments, the subsea work chamber 120 may be configured to maintain approximately atmospheric pressure therein, and the robotic assembly mechanism 550 may comprise conventional robotic equipment (e.g. configured to operate in approximately atmospheric conditions/pressure and/or not configured for use in high pressure/subsea environments). For example, approximately atmospheric pressure may be considered to include from atmospheric (e.g. approximately 14-15 PSI) to a few hundred PSI, for example depending upon the rated maximum specifications of the internal assemblies, which may be adjusted to balance design considerations of the chamber. In some embodiments, approximately atmospheric conditions may comprise less than 500 PSI, less than 400 PSI, less than 300 PSI, less than 250 PSI, less than 200 PSI, less than 150 PSI, less than 100 PSI, less than 75 PSI, less than 50 PSI, or less than 25 PSI (e.g. with atmospheric pressure and/or +/−10% typically being the minimum). The port 530 may be configured to maintain the chamber pressure, for example by pumping fluid into or out of the sealed portion of the port 530. In some embodiments, the sealed chamber 520 can be configured to be coupled (e.g. tethered and/or anchored) to the wellhead 102 and/or seabed 140 (e.g. through the lubricator system 220 and/or safety valve 105). For example, the subsea work chamber 120 may have a floatation device 580 (e.g. a floatation ring disposed around an exterior of the sealed chamber 520—see for example FIG. 5A). The floatation device 580 can be configured to make the subsea work chamber 120 ultra-lightweight on the wellhead 102, for example configured to provide approximately neutral buoyancy. Being coupled/tethered to the wellhead 102 (e.g. by the lubricator section) can dispose the subsea work chamber 120 above the wellhead 102, for example with the subsea work chamber 120 floating undersea above the safety valve 105 and/or production tree 103 of the wellhead 102.

In some embodiments, the wireline reeler unit 215 may comprise a device configured for running and retrieving wireline tools and/or for performing fishing and/or wireline operations (e.g. by extending and/or retracting wireline/slickline). In some embodiments, a wireline stuffing box 230 may be configured to seal around the wireline/slickline 315 (e.g. extending from the wireline reeler unit 215), with the wireline 315 extending therethrough. The seal around the wireline 315, which is provided by the wireline stuffing box 230, can be configured to confine wellbore fluids and/or gases, contain well pressure, and/or can allow wireline operations to be carried out under pressure (e.g. whether the wireline 315 is stationary within the stuffing box 230 or is moving (e.g. axially) through the stuffing box 230). In some embodiments, the wireline stuffing box 230 may also operate to guide the wireline 315 between the wireline reeler unit 215 and the lubricator section 220. In some embodiments, the lubricator section 220 may comprise a lubricator conduit 312, for example a riser (e.g. an elongate high-pressure tubular/pipe) which can be coupled to the top of a wellhead 102 (for example coupled to a Christmas tree on a wellhead 102). In operation, the lubricator section 220 may be configured to provide access while working on a well under pressure, for example allowing for insertion of tools into a high-pressure well. The lubricator section 220 may be configured to allow for running of tools into a producing well without having to kill the well. In some embodiments, the lubricator section 220 may include a high-pressure grease injection section. In some embodiments, the lubricator section can comprise a lower lubricator conduit (e.g. a conduit disposed below the subsea work chamber, for example between the subsea work chamber and the lubricator valve), a telescoping conduit, and/or a guide conduit. In some embodiments, the lubricator section and the lubricator valve can together form the lubricator system.

Figure 10:
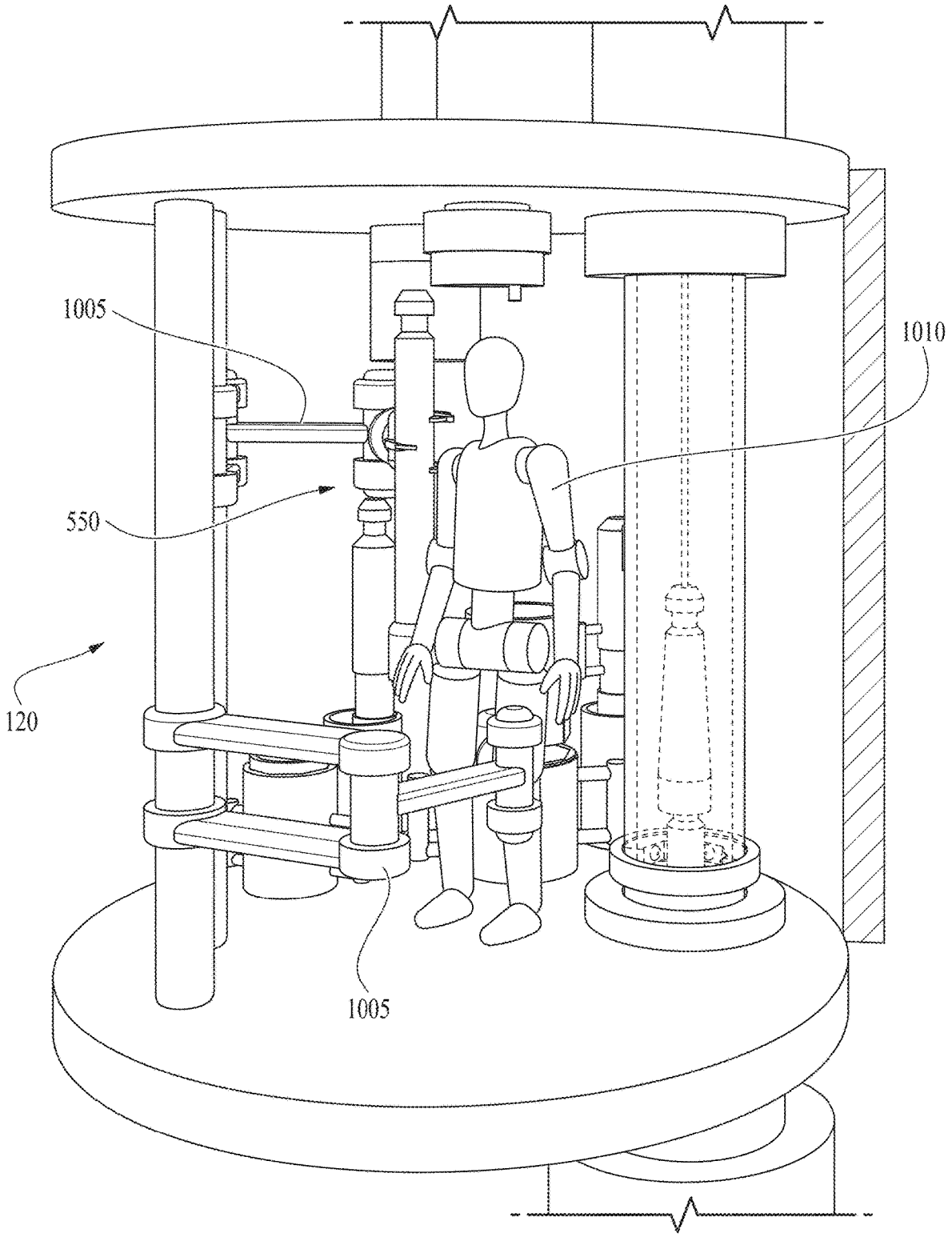
FIG. 10 illustrates an exemplary robotic assembly mechanism within an exemplary subsea work chamber, according to an embodiment of the disclosure.

In some embodiments, the robotic assembly mechanism 550 (e.g. disposed within the subsea work chamber 120) can comprise one or more arms 1005 (e.g. two arms), which in some embodiments can be configured to move on a track (e.g. extending around the periphery of the internal work space 522). For example, the robotic assembly mechanism 550 can include a Scara-type robot, an industrial robot, a tela-operated humanoid robot, an autonomous robot, or combinations thereof. In some embodiments, the robotic assembly mechanism 550 can comprise a humanoid robot 1010. FIG. 10 illustrates a robotic assembly mechanism 550 having both tracked arms 1005 and a humanoid robot 1010.

Figure 14:
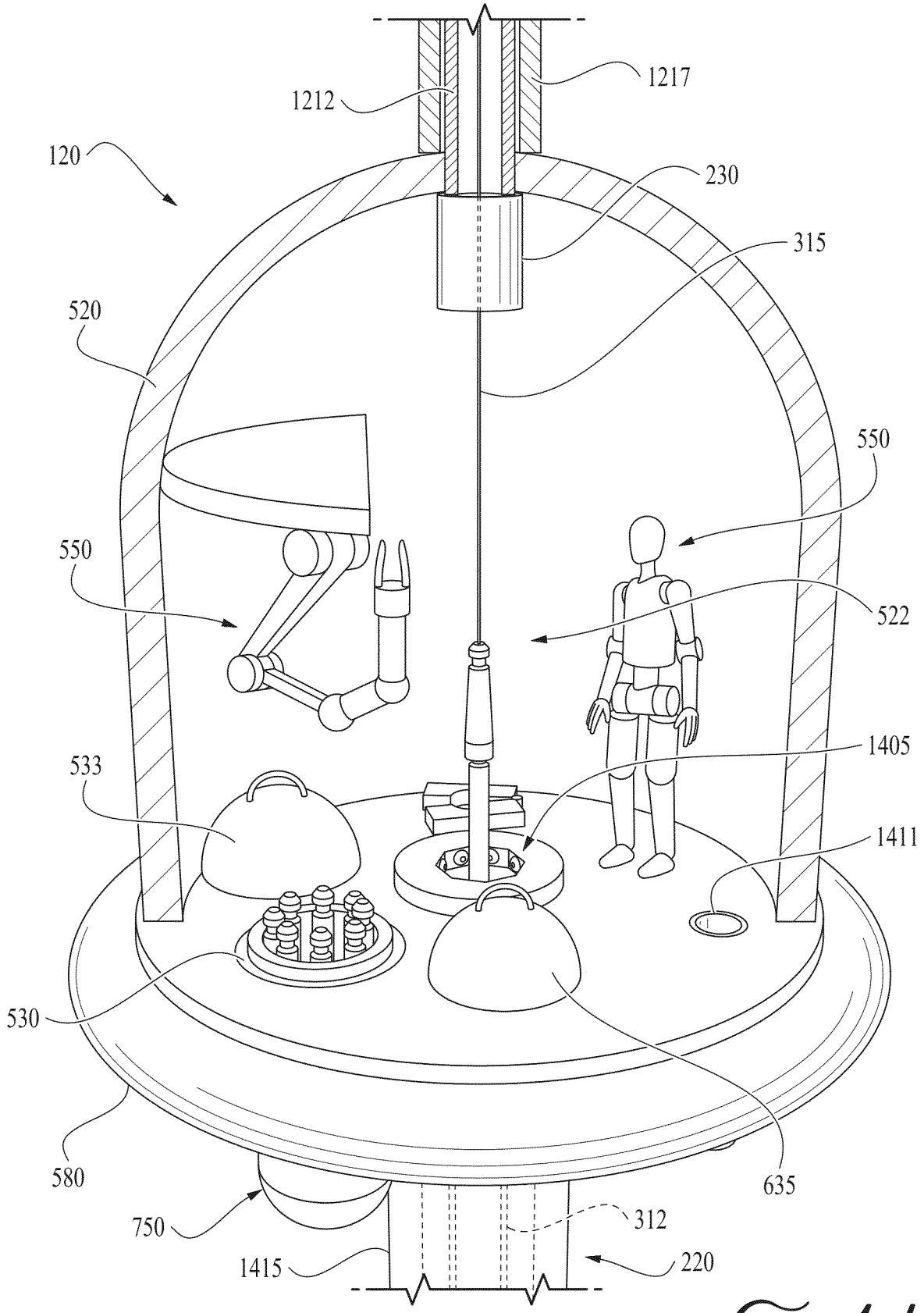
FIG. 14 is an isometric view illustrating an exemplary subsea work chamber of the system of FIG. 13, with the wireline stuffing box in its retracted position (e.g. providing access to the wireline), according to an embodiment of the disclosure.
Figure 15:
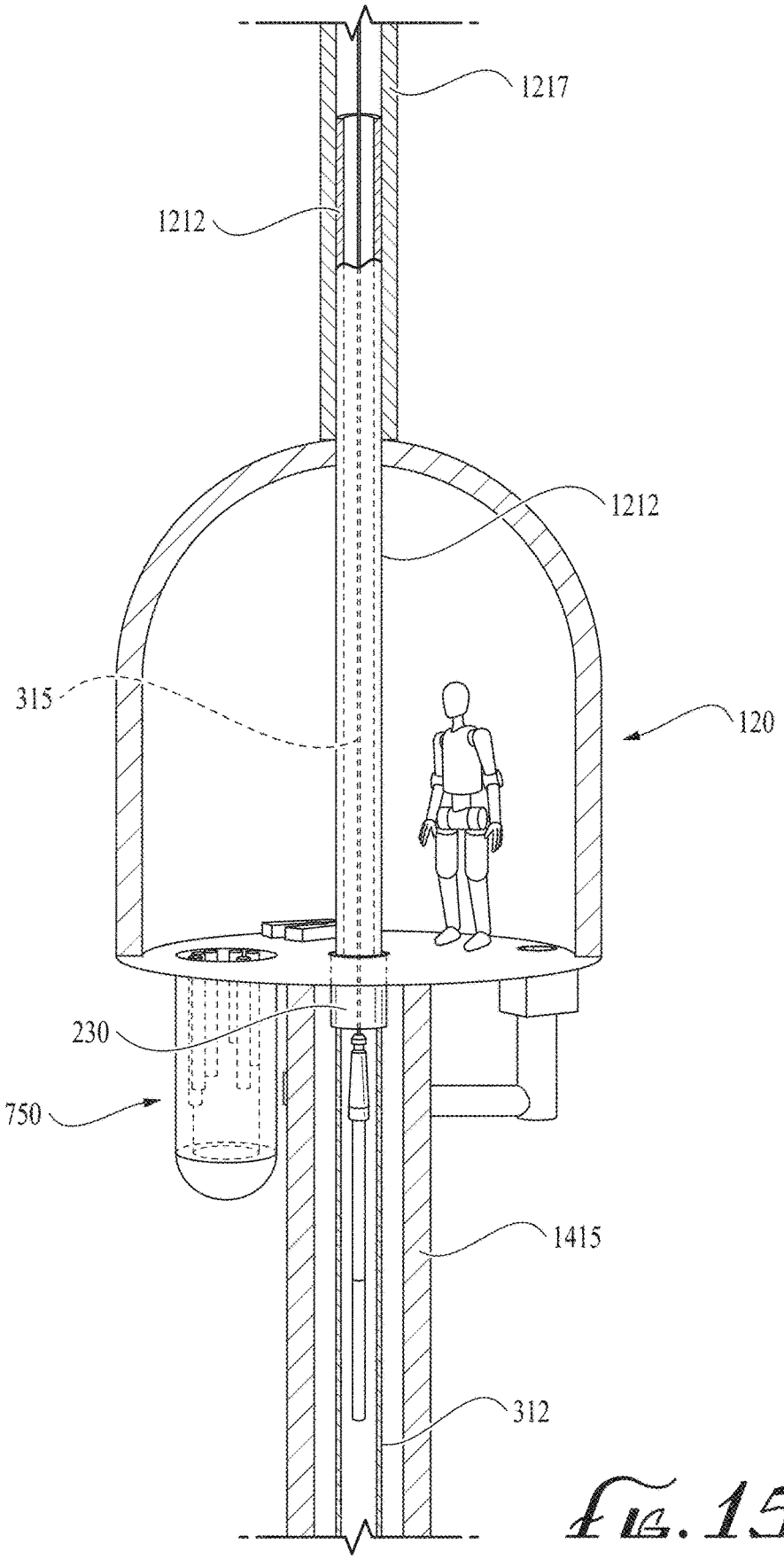
FIG. 15 is an isometric view illustrating the subsea work chamber with the wireline stuffing box of the tool insertion system in its extended position (e.g. with the telescoping conduit spanning the work chamber and isolating the work chamber from the wellhead and/or tool insertion system), according to an embodiment of the disclosure.
Figure 16:
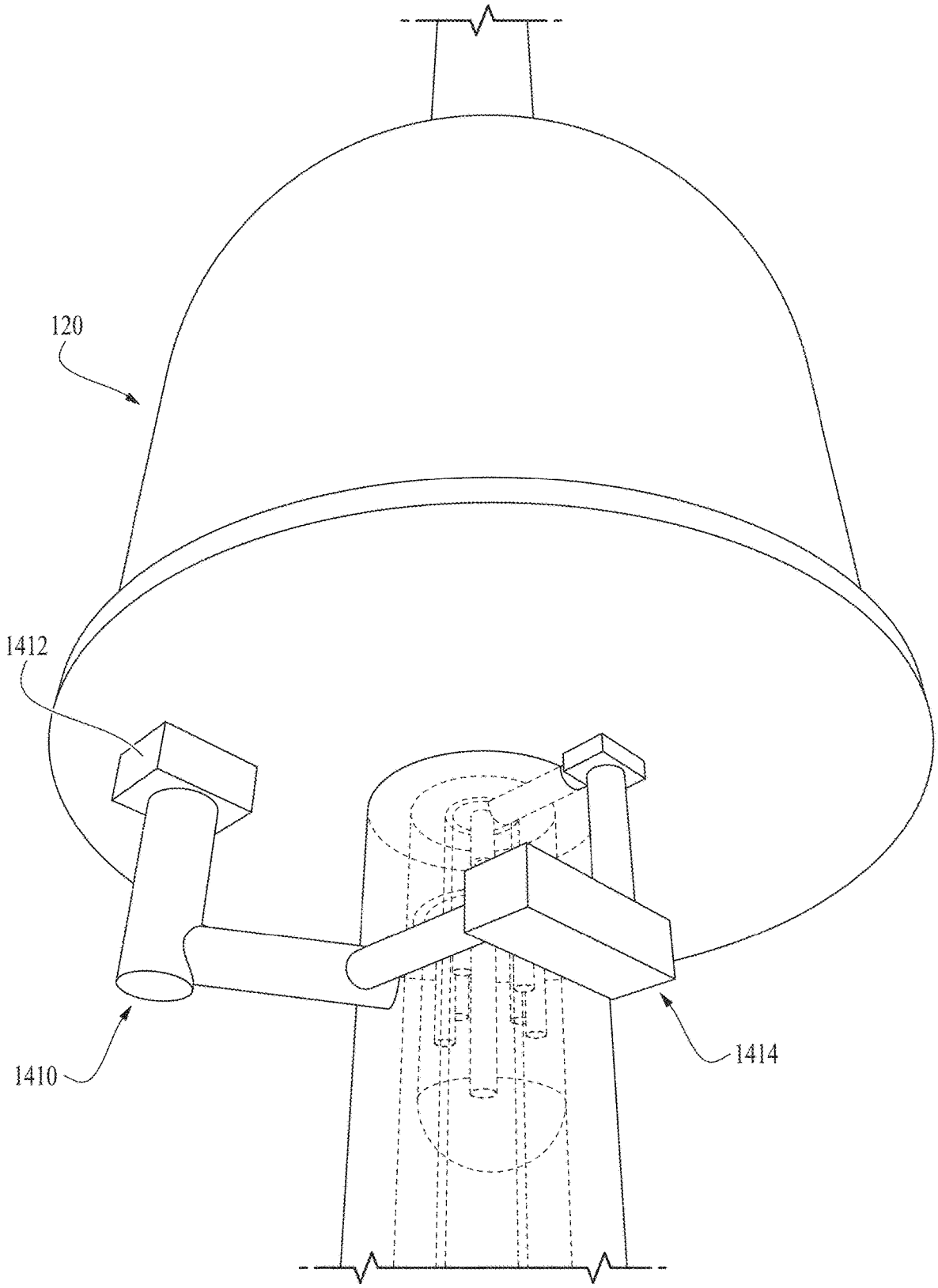
FIG. 16 illustrates an exemplary sump system for the subsea work chamber of FIG. 14, according to an embodiment of the disclosure.

Some embodiments of the subsea work chamber 120 may also include a sump system, which can be configured to eject/dispose of fluids (e.g. liquids) in the internal work space 522 (e.g. to maintain operational efficiency). For example, the sump system can comprise a drain, an annular conduit disposed around the lubricator system 220 (e.g. around the lubricator conduit 312), and a pump. The pump can be configured to pump fluids from the drain, for example into the hydrocarbon production line to be processed by floating production system, through the annular conduit. FIGS. 14-16 illustrate an exemplary sump system (which is described in more detail below). Some system embodiments also include a wash mechanism, such as a wash ring, which can be disposed in proximity to the first connector 560 and configured to wash (e.g. spray with water) tools being retracted out of the wellhead 102 and/or lubricator system 220. In some embodiments, the wash mechanism can also include a scrubber/brush which can be disposed in proximity to the first connector and/or wash ring (e.g. within the lubricator system 220 in proximity to the subsea work chamber 120). FIG. 14 further illustrates this.

In some embodiments, the one or more port 530 can each comprise a canister guide mechanism 1105 configured to guide the capped open end 853 of the tool canister 750 into the port 530. For example, the canister guide mechanism 1105 can comprise a funnel-shaped mechanism disposed on the port 530 (e.g. disposed on its external surface)—see for example FIG. 11B. Some embodiments of the port 530 may include a port seal 859, disposed distal/outward of the port cap 533 and forming a sealed space therebetween when the tool canister 750 is docked in the port 530. In other embodiments, the port seal 859 may be disposed on the tool canister 750, for example above (e.g. proximal to) the canister cap 635 (e.g. so that when the canister 750 is docked in the port 530, the canister cap 635 is disposed in a sealed section of the port 530 between the port seal 859 and the port cap 533). In either instance, inserting the capped canister open end 853 into the port 530 can create a sealed section between the port cap 533 and the port seal 859 (e.g. with the canister cap 635 of the tool canister 750 disposed therebetween). A pump can be configured to pump fluid in and/or out of the sealed section (e.g. depressurizing the sealed section for tool removal and/or pressurizing the sealed section for removal of the canister from the port). In some embodiments, the same pump can be used for pressurizing the port and for the sump system, while in other embodiments the port 530 can have its own pump.

As shown in FIGS. 5A-C, the internal work space 522 of the subsea work chamber 120 can comprise a storage area 523 configured to receive a wellcap/plug 524, a port cap 533, a canister cap 635, a cap removal tool 525, an indexing tool 526 (e.g. configured for selecting one of a plurality of tools in the tool canister 750, for example by rotating the tools within the tool canister 750), and/or an in-out tool 527 (e.g. configured for removal of a tool from the tool canister 750 and/or reinsertion of the tool into the canister 750). In some embodiments, the sealed chamber 520 is configured to retain approximately atmospheric pressure (e.g. even when disposed subsea and/or under high external pressure), and conventional robotics can be used therein. In other embodiments, the work chamber 120 can be filled with a liquid (e.g. silicon oil) and pressurized to approximately the same pressure as the external subsea environment, and the robotic assembly mechanism 550 can be configured for use under such high pressure. An indexing tool 526 and/or an in-out tool 527 can be disposed in the interior work space, in some embodiments, as can optional slips and vice.

As illustrated in FIGS. 11A-G, some system embodiments may include an external wireline system 1101 (e.g. reeler unit) configured to provide one or more tool canisters 750 from the surface (e.g. for insertion of tool canister 750 from the surface of the sea into the port 530 and/or for removal of tool canister 750 from the port 530 to the surface 150). For example, the external wireline system 1101 can be configured to removably couple to one or more tool canister 750 (e.g. with a removable coupling 1107). In some embodiments, for example having a plurality of ports 530 for tool canister 750 docking, the external wireline system 1101 can be configured to rotate/pivot between the two or more ports 530 (e.g. with a rotating base 1108 configured to be operated remotely or automatically, for example by computer based on pre-programmed instructions). This may allow a single external wireline system 1101 to insert or remove tool canisters 750 from multiple ports 530 (e.g. by decoupling from a first canister in a first port, pivoting towards a second canister at a second port, and coupling to the second canister).

Figure 12B:
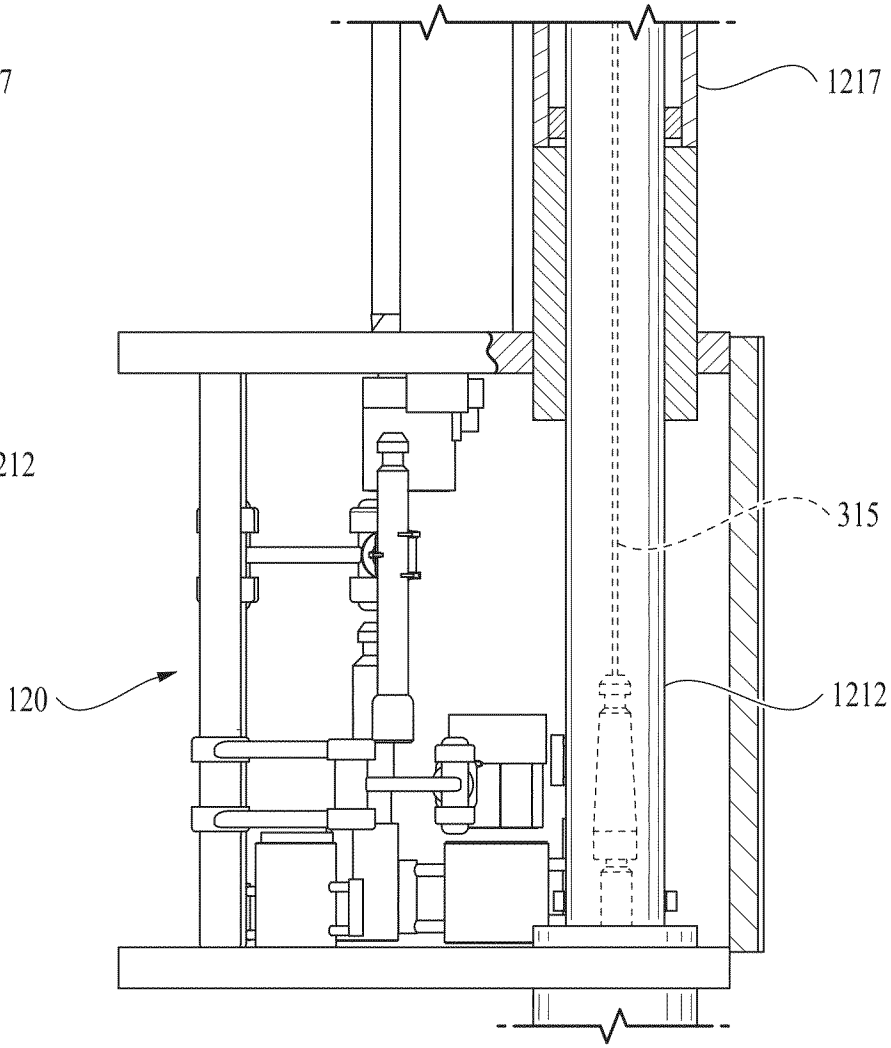
FIG. 12B illustrates the tool insertion system of FIG. 12A in the extended position (e.g. isolating the subsea work chamber from the tool insertion system and/or the wellhead, according to an embodiment of the disclosure.
Figure 12A:
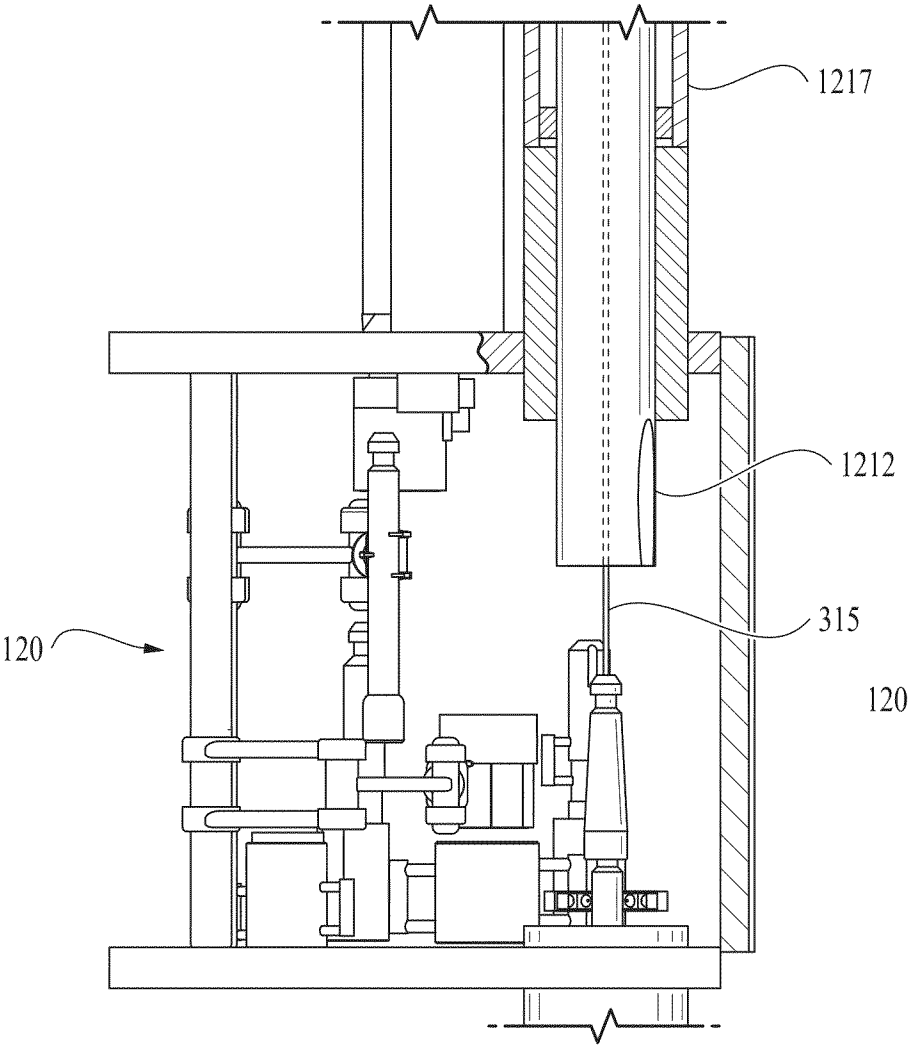
FIG. 12A illustrates a tool insertion system having a telescoping conduit, with the telescoping conduit in its retracted position (e.g. allowing access to the wireline within the subsea work chamber), according to an embodiment of the disclosure.

In some embodiments, the first and second connectors 560, 562 (e.g. the openings in the subsea work chamber 120 configured for operational coupling) can be disposed opposite one another on the sealed chamber 520. For example, the first and second connectors 560, 562 can have axes aligning, but be disposed on opposite sides of the subsea work chamber 120 (e.g. with the second connector 562 on top of the sealed chamber 520 and the first connector 560 on the bottom of the sealed chamber 520—see for example FIG. 5A). In some embodiments, the lubricator system 220 can further include a telescoping conduit 1212 configured to span the sealed chamber 520 (e.g. span the interior work space 522) between the first and second conduits 560, 562 when in extended position (e.g. isolating the distal end of the wireline from the work chamber), and to provide a work area (e.g. open to allow for passage of a tool and/or access to the distal end of the wireline) between the first and second conduits 560, 562 when in retracted position. FIG. 12A illustrates an exemplary telescoping conduit 1212 of a lubricator section 220 and/or tool insertion system 110, in its retracted position (e.g. configured to provide access within the subsea work chamber 120 to the wireline 315, for example for tool attachment and/or removal). FIG. 12B illustrates the exemplary telescoping conduit 1212 in its extended position (e.g. configured to isolate the internal work space 522 of the subsea work chamber 120 from the distal end of the wireline, the wellhead 102, the lubricator section 220, and/or the tool insertion system 110, for example with the telescoping conduit 1212 spanning the work chamber 120 from the second connector 562 to the first connector 560). In its extended position, the distal end of the telescoping conduit 1212 can provide sealed fluid communication with the lubricator valve 212 (e.g. sealingly engaging in the first connector 560, the lubricator conduit 312—see for example FIG. 15 (showing an exemplary lower lubricator conduit), or the lubricator valve 212). In some embodiments, the wireline stuffing box 230 can be coupled to the telescoping conduit 1212 (e.g. so they move together between retracted and extended positions), while in other embodiments the wireline stuffing box 230 can be fixed (e.g. with respect to the wireline reeler unit 215 and/or subsea work chamber 120) and the telescoping conduit 1212 can move independently between the retracted and extended positions (see for example FIG. 17C).

In FIG. 1, the subsea work chamber 120 is disposed subsea (e.g. in proximity to the seabed/seafloor 140) and/or is exposed to subsea conditions (e.g. approximately 500-6000 PSI, 1000-6000 PSI, 2000-6000 PSI, 3000-6000 PSI, 4000-6000 PSI, 5000-6000 PSI, 500-5000 PSI, 1000-5000 PSI, 2000-5000 PSI, 3000-5000 PSI, 4000-5000 PSI, 500-4000 PSI, 1000-4000 PSI, 2000-4000 PSI, 3000-4000 PSI, 500-3000 PSI, 1000-3000 PSI, 2000-3000 PSI, 500-2000 PSI, 1000-2000 PSI, 500-1000 PSI, or greater than 6000 PSI and/or typically approximately 40-30 deg Fahrenheit, with pressures typically varying depending on ocean floor depth for example of approximately 1000-9000 ft, 2000-9000 ft, 3000-9000 ft, 4000-9000 ft, 5000-9000 ft, 6000-9000 ft, 7000-9000 ft, 8000-9000 ft, 1000-8000 ft, 2000-8000 ft, 3000-8000 ft, 4000-8000 ft, 5000-8000 ft, 6000-8000 ft, 7000-8000 ft, 1000-7000 ft, 2000-7000 ft, 3000-7000 ft, 4000-7000 ft, 5000-7000 ft, 6000-7000 ft, 1000-6000 ft, 2000-6000 ft, 3000-6000 ft, 4000-6000 ft, 5000-6000 ft, 1000-5000 ft, 2000-5000 ft, 3000-5000 ft, 4000-5000 ft, 1000-4000 ft, 2000-4000 ft, 3000-4000 ft, 1000-3000 ft, 2000-3000 ft, 1000-2000 ft, or even in excess of 9000 ft). For example, the work chamber 120 can be configured to be disposed in a subsea environment (for example deep water such as ocean floor environments from shallow of approximately 1000 feet to deep water currently approximately 9000 ft and/or pressures up to 6000 PSI or greater). Typically, the subsea work chamber 120 is not coupled to (e.g. physically supported from) the surface 150 and/or a drill ship and/or does not include or couple to a riser to the surface. Generally, the internal work space 522 of the subsea work chamber 120 can be insufficient for a human operator (e.g. the subsea work chamber 120 is not configured to hold a human operator subsea). This can allow for a smaller size and lighter weight chamber 520. Due to the lack of human operator within the subsea work chamber 120, the sealed chamber 520 may not include an entryway/door for a human operator and/or the sealed chamber 520 may not meet safety standards required for a human operator (e.g. the sealed chamber 520 can be designed with lower safety standards acceptable for robotic use but not for human use).

FIGS. 2-4B illustrates an exemplary tool insertion system 110, which can include a wireline reeler unit 215 and a lubricator section 220, for example with a moveable wireline stuffing box 230. By way of more detailed example, an exemplary tool insertion system 110 can comprise a wireline reeler unit 215 having a wireline/slickline 315, a lubricator valve 212, a lubricator conduit 312 coupled to the lubricator valve 212 (e.g. opposite a subsea work chamber 120 and/or with its proximal end coupled to the subsea work chamber 120 and its distal end coupled to the lubricator valve 212), and a moveable wireline stuffing box 230. The wireline 315 from the wireline reeler unit 215 passes through the wireline stuffing box 230, with the wireline reeler unit 215 configured to move (e.g. extend/retract) the wireline 315. Thus, the wireline stuffing box 230 is disposed between the end of the wireline 315 (e.g. the distal end, for tool attachment) and the wireline reeler unit 215, and the wireline reeler unit 215 can be configured to control the amount of wireline 315 extending beyond the wireline stuffing box 230. In embodiments, the moveable wireline stuffing box 230 can have a retracted position and an extended position. For example, the retracted position can be configured to provide an open work area (e.g. within the subsea work chamber 120, for example between the moveable stuffing box 230 and the lubricator conduit 312 or between a telescoping conduit 1212 and the lubricator conduit 312) allowing access to the distal end of the wireline 315 (e.g. for tool attachment and/or removal) and/or to allow fluid communication between the work chamber 120 and the lubricator valve of the lubricator system. The extended position can be configured to isolate the subsea work chamber 120 from the lubricator system 220/tool insertion system 110 (e.g. from the lubricator valve) and/or to isolate the work chamber 120 from the distal end of the wireline. A ram mechanism 335 can be configured to move the wireline stuffing box 230 between the retracted and extended positions.

In embodiments, the lubricator valve 212 can be configured to close/seal the lubricator conduit 312 (e.g. preventing fluid flow therethrough and/or into the subsea work chamber 120). For example, the lubricator valve 212 can prevent fluid flow therethrough in a first/closed configuration, and allow fluid flow therethrough in a second/open configuration. The wireline stuffing box 230 can seal the passage of the wireline 315 therethrough (e.g. providing passage of the wireline 315 while isolating the wireline reeler unit 215 and/or the subsea work chamber 120 from the lubricator conduit 312 and/or wellhead 102).

In some embodiments (see for example FIGS. 12A-B), the lubricator system 220 also includes a telescoping conduit/tube 1212, and the wireline stuffing box 230 can be coupled to the telescoping conduit 1212 in some embodiments. For example, the wireline stuffing box 230 can be configured to move with the telescoping conduit 1212. In some embodiments, the lubricator conduit 312 comprises or consists of the telescoping conduit 1212. In some embodiments, the wireline stuffing box 230 can be attached/coupled at either end of the telescoping conduit 1212, or can be disposed (e.g. sealingly) within the telescoping conduit 1212. For example, in FIG. 12A, the stuffing box 230 is coupled to the proximal end of the telescoping conduit 1212 (e.g. closer to the wireline reeler unit 215), while in FIG. 13 the stuffing box 230 is coupled to the distal end of the telescoping conduit 1212 (e.g. closer to the subsea work chamber 120 and/or away from the wireline reeler unit 215). In embodiments, the wireline stuffing box 230 is sealingly coupled to the telescoping conduit 1212.

As shown in FIGS. 12A-B, the telescoping conduit 1212 can be configured to have retracted and extended positions corresponding to the positions of the movable wireline stuffing box 230. For example, in the extended position (see FIG. 12B), the telescoping conduit 1212 can extend through the subsea work chamber 120 (e.g. spanning the work chamber 120), for example into the lubricator conduit 312, first connector, and/or lubricator valve 212; and in the retracted position (see FIG. 12A), the telescoping conduit 1212 can retract out of the lubricator conduit 312 (e.g. any portion of the lubricator conduit 312 extending between the subsea work chamber 120 and the lubricator valve 212, which can be the connector 560 in some embodiments), and/or the subsea work chamber 120 (e.g. so no portion of the telescoping conduit 1212 extends into the lower lubricator conduit (e.g. telescoping conduit 1212 is entirely withdrawn from the lower lubricator conduit and/or connector 560)), and the telescoping conduit 1212 does not span the subsea work chamber 120—for example, none or only a portion of the telescoping conduit 1212 extends into the work chamber 120, leaving the open area within the subsea work chamber 120 and/or providing access to the wireline connector 516 and/or distal end of the wireline 315). In some embodiments, in the retracted position, the telescoping conduit 1212 can allow fluid communication between the work chamber 120 and the lubricator valve 212 and/or can allow access to the distal end of the wireline (e.g. in the work chamber).

In some embodiments, in the extended position, the telescoping conduit 1212 sealingly connects into fluid communication with the lubricator valve 212 (e.g. by having its distal end disposed in the proximal end of the lower lubricator conduit, with a seal disposed therebetween—see for example FIG. 15—or having its distal end sealingly mate within the first connector 560—see for example FIG. 12B) and/or provides isolated passage through the work chamber 120 (e.g. between the lubricator conduit 312/lubricator valve 212 and the moveable stuffing box 230) (e.g. isolates the lubricator conduit 312, lubricator valve 212, lubricator section 220, and/or tool insertion system 110 from the work chamber 120). In some embodiments, such as illustrated in FIG. 12B, the extended position of the telescoping conduit 1212 spans the subsea work chamber 120 (e.g. between the first and second connectors 560, 562) with its distal end sealingly disposed in fluid communication with the lubricator valve 212 (e.g. disposed within the first coupling/connector 560 and/or contacting the lubricator valve 212). In some embodiments, in the extended position the telescoping conduit 1212 can isolate the work chamber 120 from the lubricator valve 212 and/or can isolate the work chamber 120 from the distal end of the wireline. The telescoping conduit 1212 can have an axial length sufficient to span the subsea work chamber 120 (e.g. in its extended position). For example, the axial length of the telescoping conduit 1212 can be greater than the span/height of the subsea work chamber 120 (e.g. between the first and second connectors 560, 562), and/or the difference between the axial length of the telescoping conduit 1212 and the span/height of the work chamber 120 can be greater than a length of a tool (e.g. for attachment to the wireline 513, for example a well intervention tool).

The ram mechanism 335 (e.g. piston) can be configured to axially displace the telescoping conduit 1212/tube between the retracted position (FIG. 12A) and the extended position (FIG. 12B) (e.g. this may also move the wireline stuffing box 230 between its retracted and extended positions). In some embodiments, the ram/piston 335 may be hydraulic (although other ram/piston mechanisms for extending and retracting telescoping conduit 1212 are also contemplated, such as electrically powered linear, actuators, and motors or gear-based designs, including cable systems). In some embodiments, a wireline tool connector 516 can be disposed at a distal end of the wireline 315 (e.g. coupled to the wireline 315, for example with the wireline stuffing box 230 disposed between the wireline reeler unit 215 and the tool connector 516). The wireline tool connector 516 can be configured to allow for removable coupling of a tool to the wireline 315.

As shown in FIGS. 12A-B, some embodiments also include a wireline guide conduit 1217, for example disposed around (e.g. circumferentially around at least a portion of) the telescoping conduit 1212 and configured to guide axial movement of the telescoping conduit 1212 between the retracted and extended positions (e.g. configured to allow axial movement of the telescoping conduit 1212 therein). In embodiments, the proximal end of the telescoping conduit 1212 may never extend out of the wireline guide conduit 1217 (e.g. some portion of the telescoping conduit 1212 may always be disposed within the wireline guide conduit 1217). In some embodiments, the wireline stuffing box 230 may never leave the guide conduit 1217 (e.g. if the wireline stuffing box 230 is coupled to the proximal end of the telescoping conduit 1212). In some embodiments, in the extended position, a portion of the telescoping conduit 1212 may remain within the guide conduit. For example, in FIG. 12B (when extended), a first (e.g. distal) portion of the telescoping conduit 1212 may extend into one or more of a portion of the lubricator conduit 312 opposite the wireline guide conduit (e.g. a lower lubricator conduit), the connector 560, and/or the lubricator valve 212, a second (e.g. central) portion of the telescoping conduit 1212 may span the subsea work chamber 120, and a third (e.g. proximal) portion of the telescoping conduit 1212 may remain disposed within the wireline guide conduit 1217).

In FIG. 12A (e.g. when retracted), no portion of the telescoping conduit 1212 may be sealingly engaged with the lubricator valve 212, the connector 560, or any portion of the lubricator conduit 312 opposite the wireline guide conduit (e.g. lower lubricator conduit), and most or all of the telescoping conduit 1212 may be disposed in the wireline guide conduit 1217 (e.g. leaving an exposed gap within the subsea work chamber 120 between the connectors 560, 562 for access to the wireline 315). In embodiments, the wireline reeler unit 215 can be disposed/coupled at the proximal end of the wireline guide conduit 1217 (e.g. opposite the subsea work chamber 120) and/or the distal end of the wireline guide conduit 1217 can be coupled to the subsea work chamber 120. In embodiments, the wireline stuffing box 230 may only be in fluid communication with the wellbore pressure/fluid in the extended position.

In embodiments, when the lubricator valve 212 is open and wireline stuffing box 230 and/or the telescoping conduit 1212 is in the extended position, wellbore pressure can extend through the lubricator valve 212 and/or the lubricator conduit 312 to the wireline stuffing box 230 (e.g. but is isolated from the subsea work chamber 120). For example, in the extended position, a seal can be disposed between the telescoping conduit 1212 and a lower portion of the lubricator conduit 312 opposite the wireline guide conduit and/or first connector 560 (e.g. seal disposed in proximity to the distal end of the telescoping conduit 1212) and can be configured to seal the coupling therebetween. In other embodiments, a seal can be disposed between the wireline stuffing box 230 and a lower portion of the lubricator conduit 312 opposite the wireline guide conduit and/or first connector 560 (e.g. with the seal configured to seal the coupling therebetween). See for example FIG. 15. In embodiments, the lubricator valve 212 can be configured to only be opened when the telescoping conduit 1212 and/or wireline stuffing box 230 is in the extended position.

Some embodiments of the tool insertion system 110 can also include a pump (e.g. a high pressure pump) configured to pressurize and/or depressurize the lubricator conduit 312 (e.g. between the lubricator valve 212 and the wireline stuffing box 230 in the extended position). In embodiments, the pump can be configured to equalize pressure either with the well (e.g. when preparing to insert a tool into the wellhead 102) or with the subsea work chamber 120 (e.g. when preparing to remove a tool from the wireline). Some embodiments may also have a second pump configured to pressurize and/or depressurize the area in the guide conduit and/or the telescoping conduit 1212 between the wireline stuffing box 230 and the wireline reeler unit 215 (e.g. to equalize or minimize pressure differential across the wireline stuffing box 230, for example pressurizing when the wireline stuffing box 230 is exposed to wellbore pressure, and depressurizing when the stuffing box 230 is exposed to work chamber 120 pressure (e.g. approximately atmospheric pressure)). In some embodiments, the same pump can perform both tasks. In some embodiments, the subsea work chamber 120, lubricator valve 212, lubricator conduit 312, wireline guide conduit 1217, and/or wireline reeler unit 215 can comprise a floatation device (e.g. being configured for floatation, for example for approximately neutral buoyancy). In some embodiments, the lubricator valve 212 may be coupled directly to the work chamber 120, and the lubricator conduit 312 may be formed of the coupling (e.g. the first connector 560), the telescoping conduit 1212, and/or the guide conduit.

FIGS. 8A-L illustrates an exemplary tool canister/pod 750, of the sort that can deliver well intervention tools to a subsea work chamber 120. For example, the tool canister 750 can comprise a canister/pod 852 configured to hold one more tool (e.g. a wireline and/or well intervention tool) and having an open end 853, and a removable canister cap 635 configured to sealingly close the open end 853 of the canister 852. In embodiments, the tool canister 750 can be configured for use in a subsea environment (for example deep water such as approximately 1000-9000 feet or more and/or high-pressure such as approximately 500-6000 psi or greater). The tool canister 750 can be configured to sealingly engage with a port 530 of the subsea work chamber 120, to create a sealed section around the canister cap 635 (e.g. between a port cap 533 of the port 530 and a portion of the port 530 outward of the received canister cap 635). For example, the canister cap 635 can be configured to fit within the port 530 of the subsea work chamber 120, and can have a port seal 859 configured to sealingly engage within the port 530 of the subsea work chamber 120 (e.g. thereby preventing fluid flow from the surrounding sea environment through the port 530 when the canister is docked in the port 530—e.g. between an exterior of the canister and the walls of the port 530). In embodiments, the port seal 859 can be disposed on an exterior surface of the canister 852, and can be located so that when the canister is docked in the port 530, the canister cap 635 is disposed between the port cap 533 and the port seal 859. For example, the port seal 859 can be disposed above (e.g. proximal to) the canister cap 635 and/or the port seal 859 can be uncovered by the canister cap 635 (e.g. the port seal 859 is exposed, even when the canister cap 635 is applied to the open end 853). In other embodiments, the port seal 859 can be disposed within the port 530, for example outward of the port cap 533 (and when the canister 750 is inserted into the port 530, the canister cap 635).

In embodiments, the capped open end 853 of the canister can be configured for insertion into the port 530 of the subsea work chamber 120, thereby nesting the canister cap 635 within the port cap 533 (see for example FIGS. 6A-C). Furthermore, inserting the capped canister open end 853 into the port 530 can create a sealed section between the port cap 533 and the port seal 859 (e.g. with the canister cap 635 therebetween). Upon removal of the canister cap 635 from the canister open end 853, the one or more tools disposed therein can be exposed (e.g. so that they can be removed, for example once the port cap 533 is removed to open the port 530 to the interior of the subsea work chamber 120).

In some embodiments, the tool canister 750 can comprise a flotation device (for example, configured to provide approximately neutral buoyancy to the canister). For example, the floatation device/ring(s) 791 may be disposed away from the open end 853, for example in proximity to the opposite end of the tool canister 750. This may allow for easier movement of the canister undersea (for example by an ROV 788). Typically, the tool canister 750 can be configured to hold a plurality of tools (e.g. subsea well intervention tools). In some embodiments, the canister holds a plurality of the same tool (e.g. for redundancy), while in other embodiments, the canister holds a plurality of different tools. In some embodiments, the canister can be configured to hold a plurality of tools configured to jointly be made up into a toolstring. In some embodiments, for example when the subsea work chamber 120 retains approximately atmospheric pressure, the tool canister 750 may have approximately atmospheric pressure therein. By having the interior pressure of the tool canister 750 approximately equal to the internal pressure of the subsea work chamber 120, interaction therebetween can be facilitated (e.g. the pressure in the subsea work chamber 120 can be maintained). The canister cap 635 may sealingly attach (removably) to the canister/pod. By way of example, a seal maybe disposed on the canister cap 635 and/or the open end 853 of the canister/pod, so that when the canister cap 635 is on, the interior space of the canister/pod is sealed. In some embodiments, the canister cap 635 can be configured for twist attachment and/or removal (e.g. using screw threading or bayonet attachment).

Some tool canister 750 embodiments can also include a tool receptacle/carousel disposed within the canister and configured to hold the tools. For example, the tool receptacle can be configured so that an end of one or more tool can project outward and/or out of the canister 852 when the canister cap 635 is removed. In some embodiments, the tools may be disposed entirely within the canister but accessible when the canister cap 635 is removed. For example, the tools 877 can be held approximately parallel to a longitudinal axis of canister 852 by the tool receptacle. In some embodiments, each tool can fit within a corresponding slot in the tool receptacle (which can be configured to removably hold the tool). In some embodiments, the tool receptacle can be configured to rotate within the canister 852 (e.g. to index a desired tool for removal). For example, the tool receptacle can be configured so that its rotational orientation is held securely until being lifted (e.g. pressed further into the canister) to allow rotation. In some embodiments, a retaining pin may secure the rotational orientation. In some embodiments, the tool receptacle can be biased outward (e.g.

towards the open end 853 of the canister). In some embodiments, each tool can be removably latched/held within the tool receptacle (e.g. within the corresponding slot) (e.g. by a latching system). For example, the latching system for each tool/slot can be configured with a j-slot (e.g. configured to operate in a manner similar to a retractable pen). In some embodiments, the latching system may comprise a spiral slit with lateral divot disposed on the slit (e.g. which can be configured to interact with a corresponding pin).

In embodiments, a sealed work chamber 120 (such as a subsea work chamber 120) can be used in conjunction with one or more tool canister 750, for example to provide a subsea tool provision system. For example, such an exemplary system can include a sealed chamber 520, having a port 530 and a removable port cap 533 configure to sealingly close the port 530 (wherein the port cap 533 is configured to seal against sea pressure); and a canister/pod configured to hold one more tool, configured to fit within the port 530, and having an open end 853 with a removable canister cap 635 configured to sealingly close the open end 853. The canister can be configured to sealingly engage within the port 530, to create a sealed section around the canister cap 635 (e.g. between the port cap 533 and a portion of the port 530 outward of the received canister cap 635) when the canister 750 is docked.

In some embodiments, a port seal 859 disposed on the canister 750 can be configured to sealingly engage within the port 530 (thereby preventing fluid flow from the surrounding sea environment through the port 530—e.g. through the open end 853 of the port 530). For example, the canister cap 635 can be distal to the port seal 859 (e.g. so that when the canister is docked, the canister cap 635 is disposed between the port cap 533 and the port seal 859) and/or the port seal 859 may be uncovered by the cannister cap (e.g. the port seal 859 can be exposed, even when the canister cap 635 is applied to the open end 853). In alternate embodiments, the port seal 859 could be disposed on the interior of the port 530 and configured so that, when the canister 750 is disposed in the port 530, the canister cap 635 is disposed between the port cap 533 and the port seal 859 and/or so that the canister cap 635 is disposed inward of the port seal 859 and/or the port seal 859 is disposed outward of the canister cap 635. In embodiments, the capped open end 853 of the canister 750 can be configured for insertion into the port 530 of the subsea work chamber 120, thereby nesting the canister cap 635 within the port cap 533. See for example FIGS. 6A-C. In some embodiments, inserting the capped canister open end 853 into the port 530 can create a sealed section between the port cap 533 and the port seal 859 (e.g. with the canister cap 635 disposed therebetween).

In some embodiments, the sealed section can be depressurized and/or pressurized, for example to equalize pressure for tool removal (e.g. from the canister into the sealed chamber 520) and/or for changing canisters (e.g. removing the canister from the sealed chamber 520 port 530). For example, a pump can be configured to pump fluid in and/or out of the sealed section (e.g. depressurizing the sealed section for tool removal and/or pressurizing the sealed section for removal of the canister from the port 530). In some embodiments, to access the tools, the pump can depressurize the sealed section (e.g. between the port cap 533 and the port seal 859), for example reducing the pressure therein to approximately match that of the sealed chamber 520 (e.g. approximately atmospheric pressure). Then, the port cap 533 can first be removed (e.g. by a robot in the sealed chamber 520, thereby unsealing the sealed section, while maintaining the external seal to prevent seawater incursion), and then the canister cap 635 can be removed (e.g. by the robot). In some embodiments, to remove/change the canister, the canister cap 635 can first be attached (e.g. by the robot), and then the port cap 533 can be attached (e.g. to reestablish the sealed section) (e.g. by the robot). The pump can pressurize the sealed section (e.g. to approximately external subsea pressure), for example before removing the canister from the port 530. In some embodiments, the pump can over pressurize the sealed section (e.g. pressurize above surrounding/external sea pressure), for example to assist in ejection of the canister from the port 530. In embodiments, the pump can be configured to pump seawater into the sealed section to pressurize, and can eject seawater from the sealed section into the sea to depressurize.

Figure 11A:
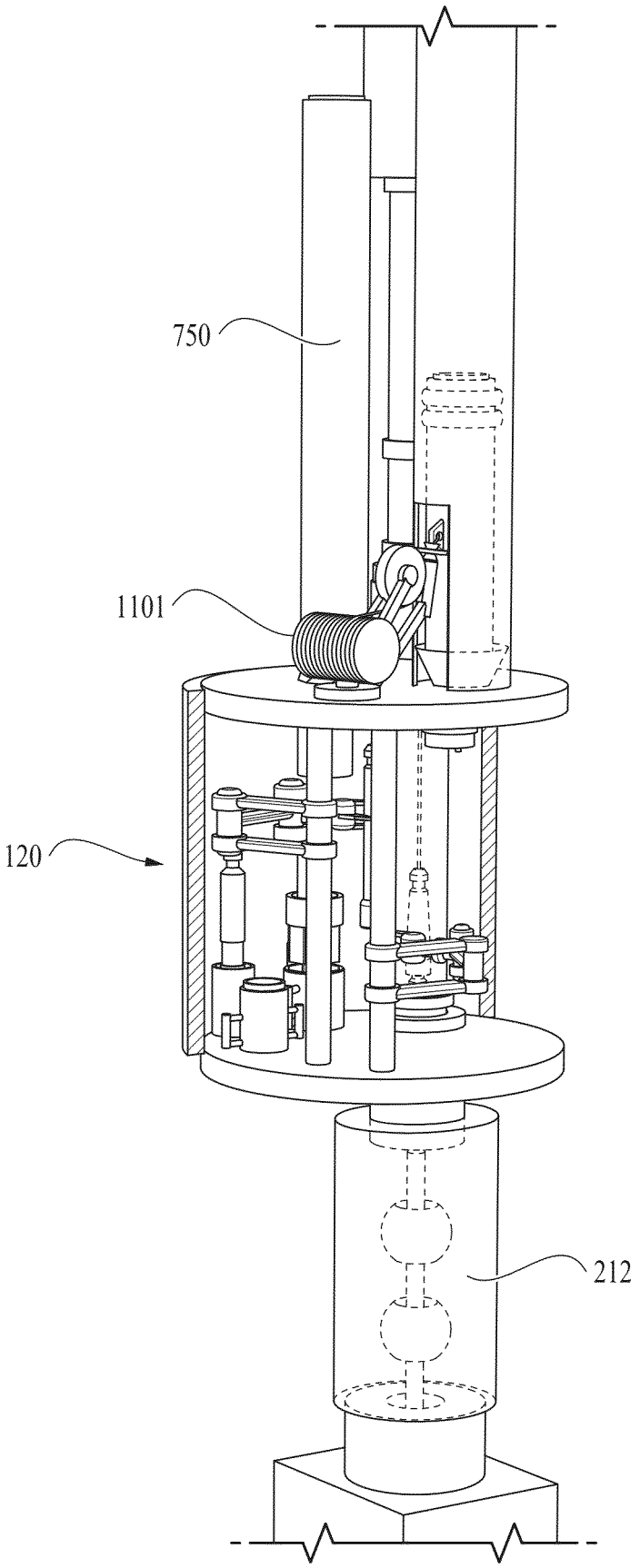
FIGS. 11A-G illustrate an exemplary external wireline system for delivering exemplary tool canisters from the surface to an exemplary subsea work chamber, according to an embodiment of the disclosure.
Figure 11B:
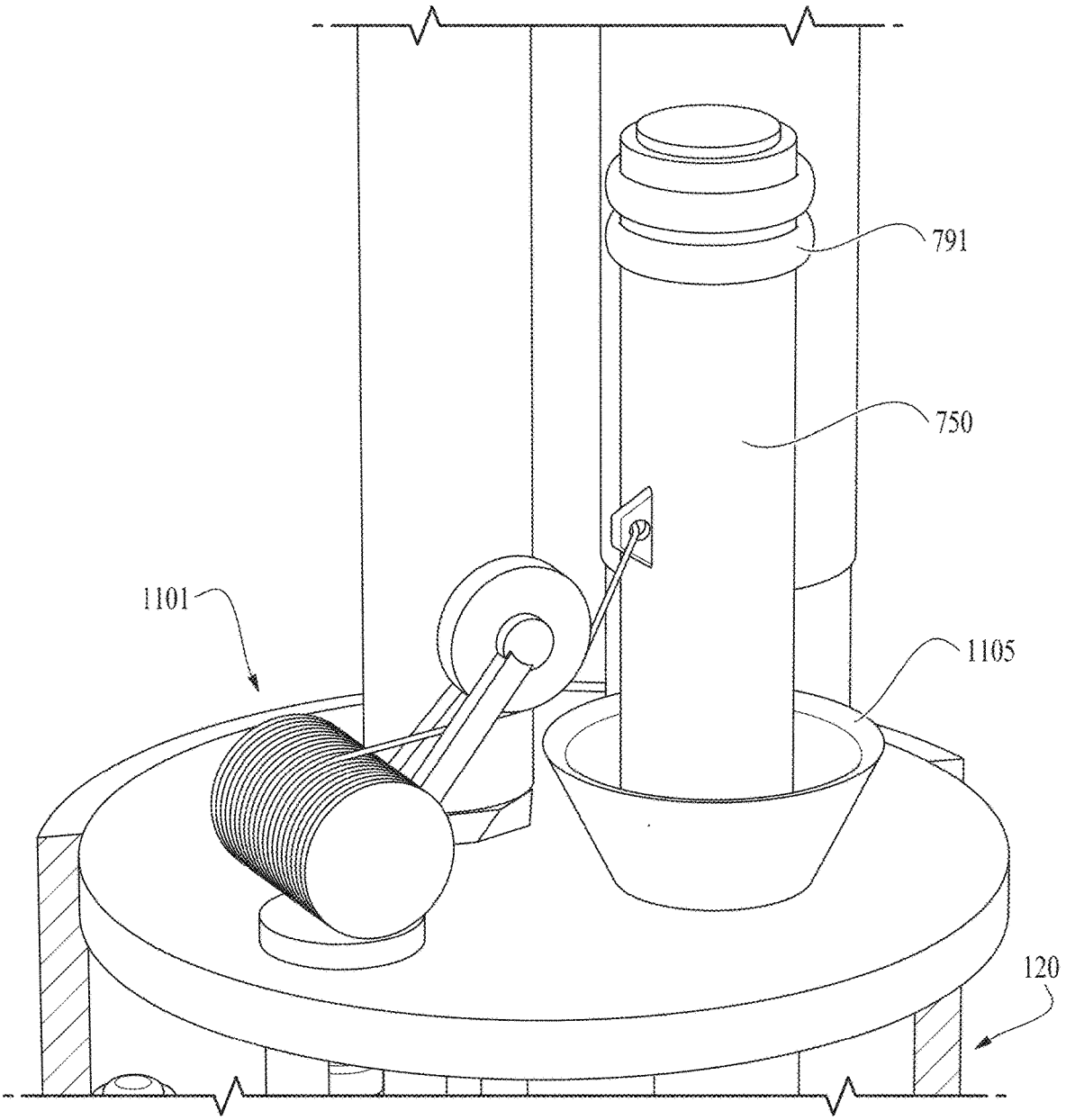
Figure 11C:
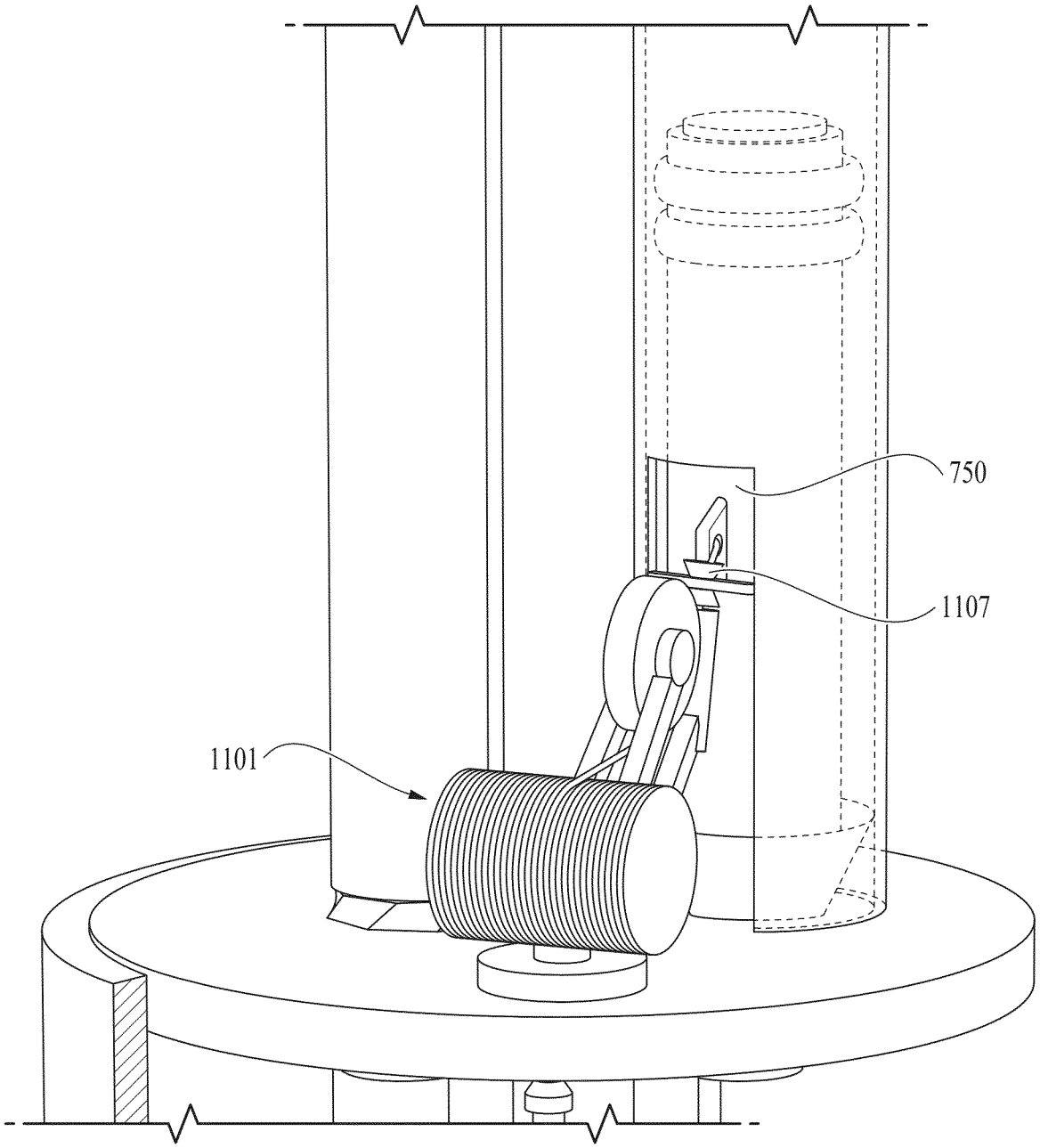
Figure 11D:
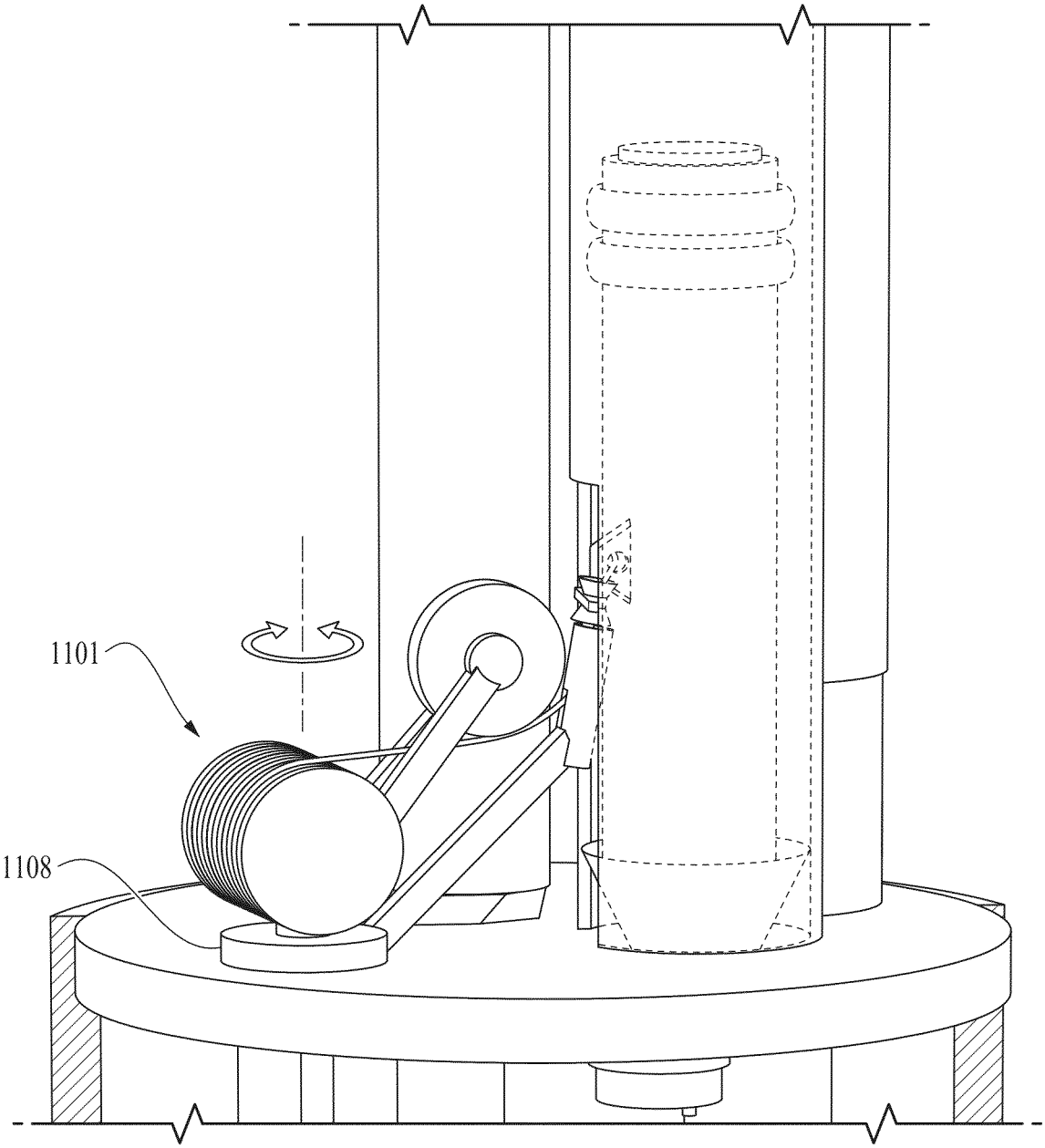
Figure 11E:
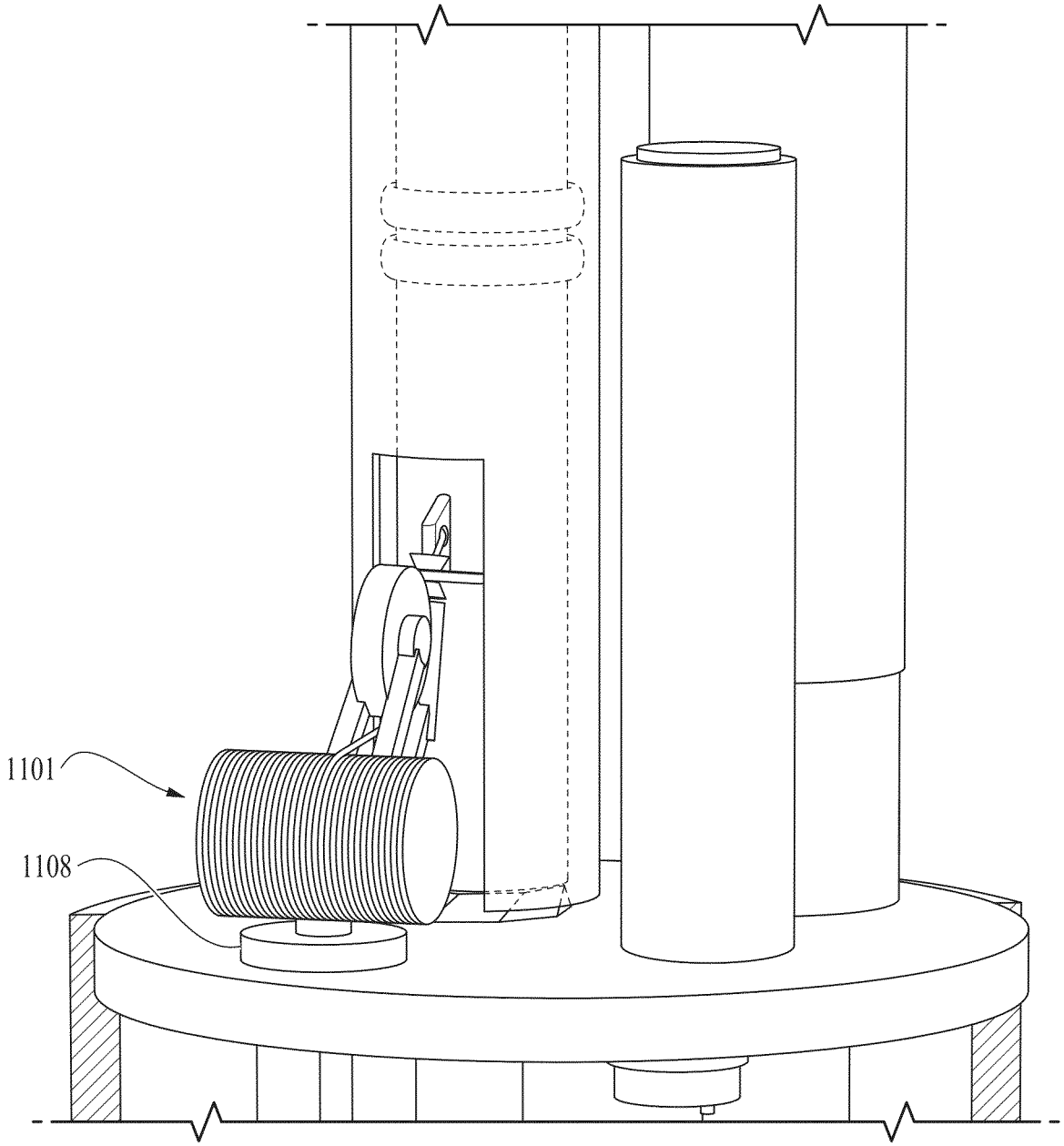
Figure 11F:
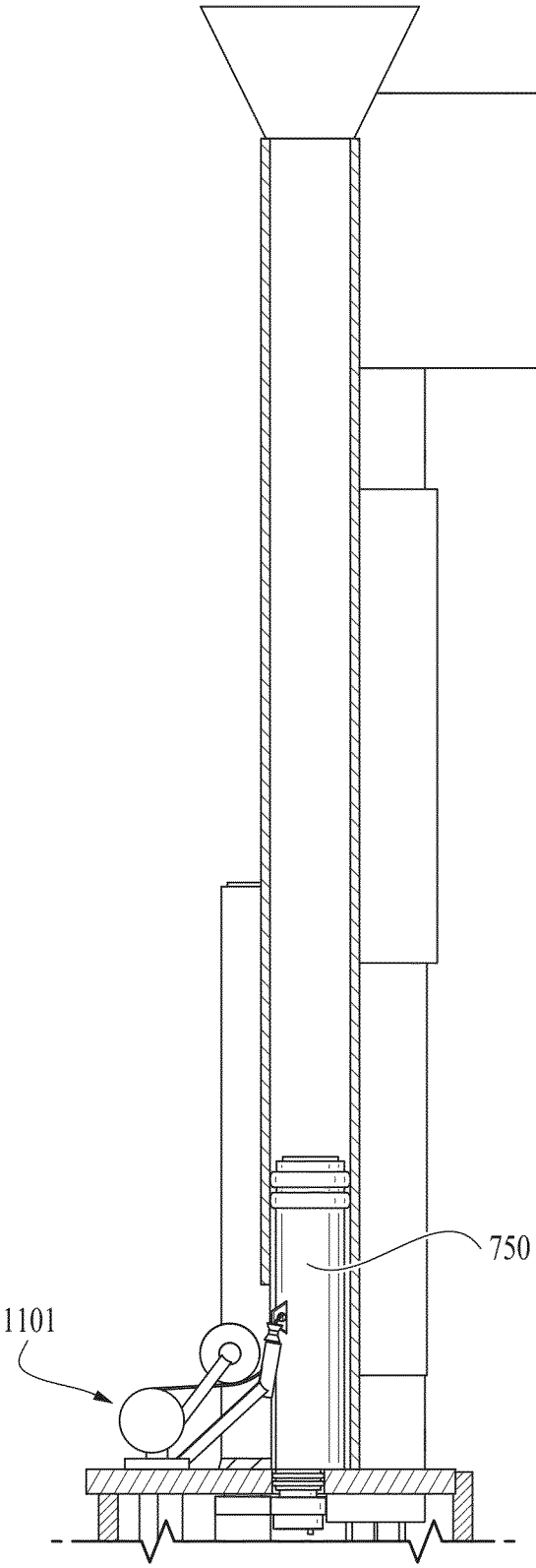
Figure 11G:
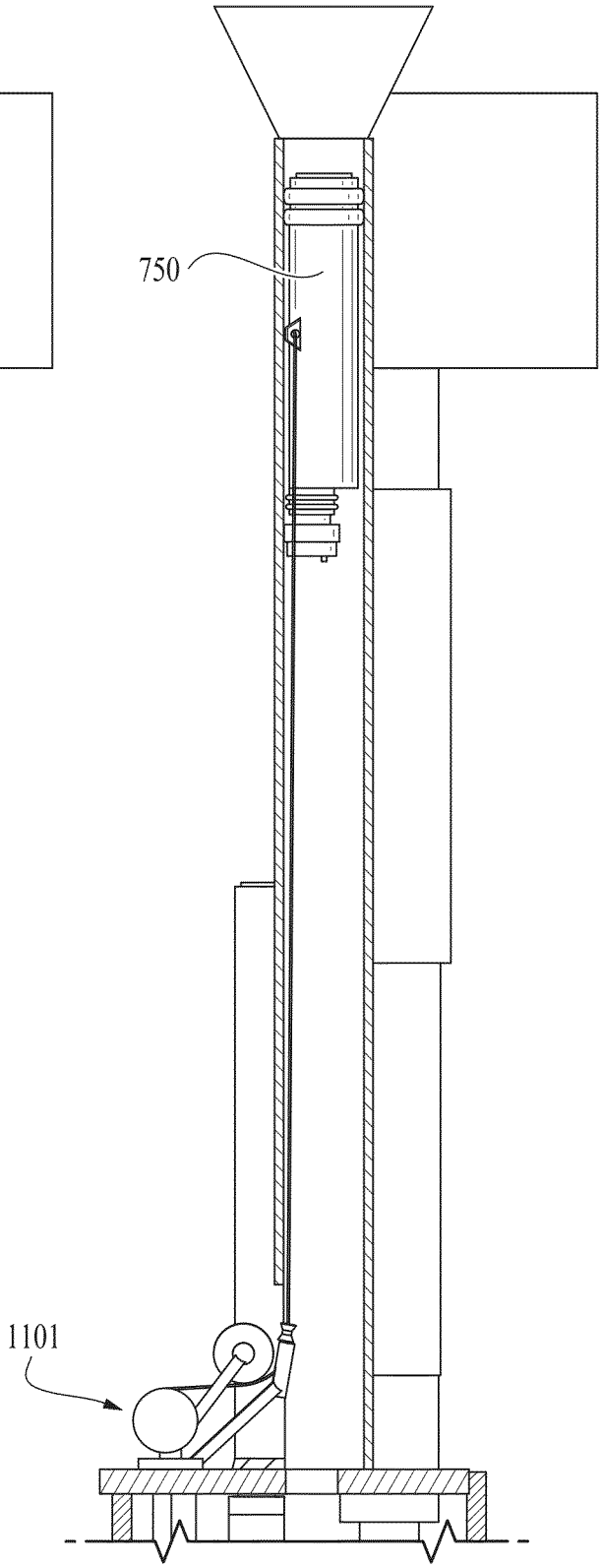

In some embodiments, the sealed chamber 520 can further comprise a canister guide mechanism 1105 (e.g. disposed on its external surface in proximity to the port 530), which can be configured to guide the capped open end 853 of the canister into the port 530. For example, the canister guide mechanism 1105 can comprise a funnel-shaped mechanism disposed on the port 530 (e.g. on the exterior of the port 530), as shown in FIG. 11B for example. In some embodiments, the canister 750 can comprise a flotation device (for example, configured to provide approximately neutral buoyancy to the canister). In some embodiments, the sealed chamber 520 can have a floatation device, for example configured to provide approximately neutral buoyancy. The sealed chamber 520 may be configured to be tethered to float (e.g. suspended underwater in proximity to the seafloor 140) above the wellhead 102, for example by a tool insertion system 110 and/or lubrication system.

In some embodiments, the canister cap 635 is configured to be accessible within the sealed chamber 520 after removal of the port cap 533 (e.g. removal of the port cap 533 exposes the cannister cap for removal, for example by the robot). In embodiments, the port 530 can comprise a tube extending into the seal chamber, and the port cap 533 can be configured to fit onto and/or close/seal the tube. In some embodiments, the port 530 can comprise an opening extending through the wall (e.g. the exterior wall) of the sealed chamber 520. For example, the opening can open into the tube (e.g. they may share a common axis). In some embodiments, one or both of the port cap 533 and canister cap 635 can be configured for twist attachment and/or removal (e.g. via screw threading or bayonet attachment). In some embodiments, the sealed chamber 520 and the canister each can have approximately atmospheric pressure therein.

In embodiments, one or more element of the subsea well intervention system can be used alone, together, and/or with other elements. For example, the subsea tool provision system can be used with another/different tool insertion system 110; or the tool insertion system 110 could be used with some other mechanism for providing tools for the wireline. In embodiments, the disclosed tool insertion system 110 can be used within more conventional well servicing systems. In embodiments, the subsea work chamber 120 can be used in other contexts (e.g. other than well intervention) and/or can be used in connection to one or more other component, element, or system.

While FIGS. 1-12B illustrate an exemplary system and/or related elements/components (e.g. a top-loading system), FIGS. 13-16 illustrate an alternative exemplary system (e.g. a bottom-loading system). The two systems may share many commonalities, and represent only two of many possible variations of this disclosure, all of which are included within the scope herein. While the movable wireline stuffing box 230 of FIGS. 1-12B is shown as being disposed at the proximal end of the telescoping conduit 1212, in the embodiment of FIGS. 13-16 the wireline stuffing box 230 is shown as being disposed at the distal end of the telescoping conduit 1212. In still other embodiments, the movable stuffing box 230 may be configured to move between its extended and retracted positions without being coupled to a telescoping conduit 1212 (for example with the ram acting directly on the wireline stuffing box 230, as in FIGS. 18A-B). In some embodiments (see for example FIG. 17C), the wireline stuffing box 230 may be fixed (e.g. with respect to the wireline reeler unit 215 and/or subsea work chamber 120), and the telescoping conduit 1212 may move separately to provide the required isolation of the work chamber 102.

Figure 13:
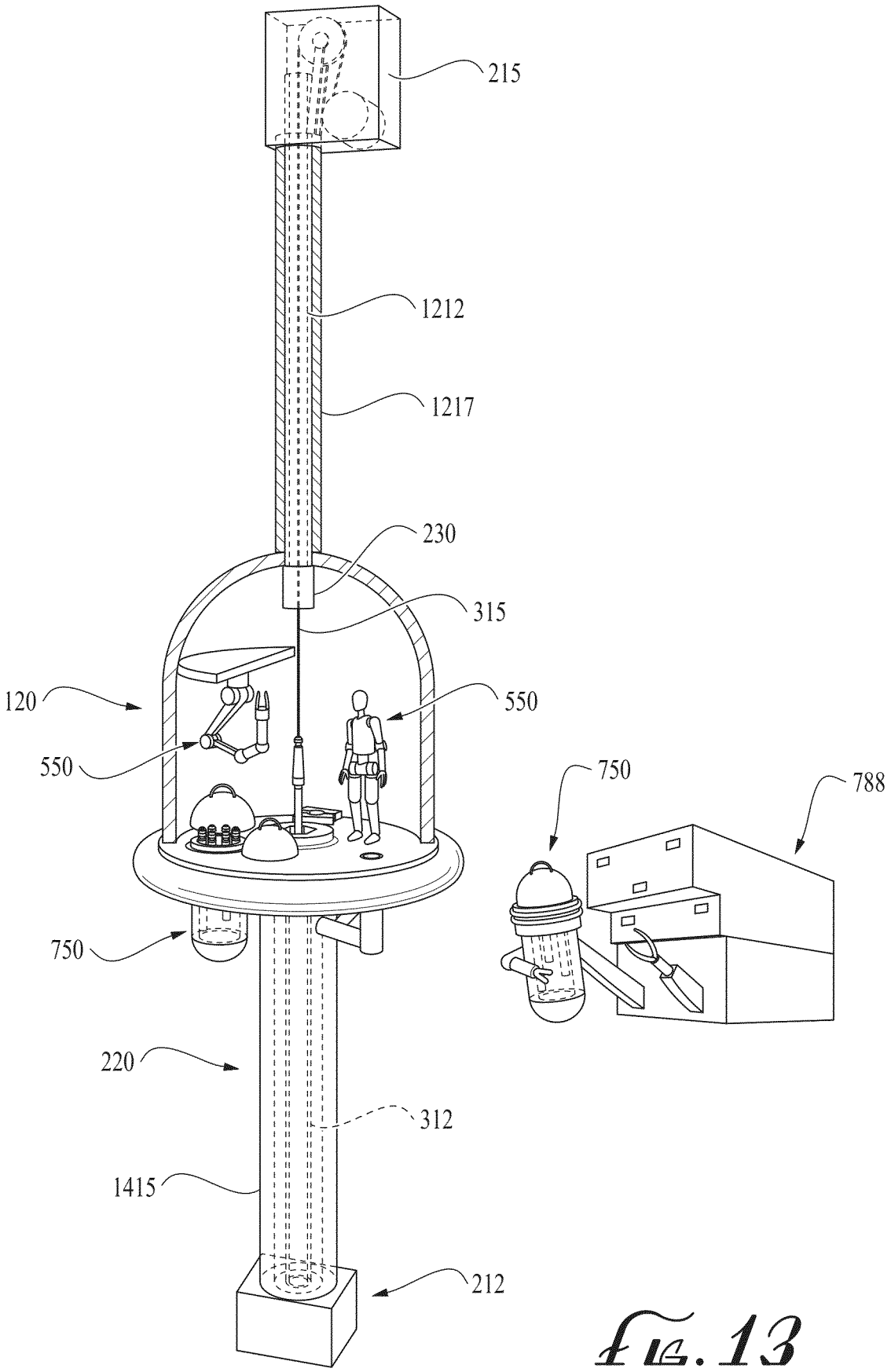
FIG. 13 is an isometric view illustrating another exemplary subsea well intervention system, according to an embodiment of the disclosure.

With regard to the embodiment of the subsea well intervention system 100 of FIGS. 13-16, the exemplary system can comprise an enclosed wireline reeler unit 215, for example including reel, controls, and the wireline stuffing box 230. The wireline stuffing box 230 of FIG. 13 is configured to move axially (e.g. with respect to the lubricator system 220, for example with respect to the lubricator conduit 312 and/or the lubricator valve 212), for example between the retracted and extended positions (e.g. similar to the discussion above with respect to FIGS. 4A-B). In some embodiments, the enclosed wireline reeler unit 215 may be at atmospheric pressure, for example to allow for ease of development and maintenance. In some embodiments, a light weight connector can be configured to allow the wireline reeler unit to be attached to the lubricator section (e.g. to the guideline conduit 1217 of the telescoping conduit 1212). The connector can be part of the wireline unit, part of the lubricator section, or a separate element. The wireline 315 may extend from the reel, through the stuffing box 230, for example with the reel being configured to control axial movement of the wireline 315 and the stuffing box 230 sealing around the wireline 315. The wireline 315 can be configured to extend (e.g. in its extended position) through the lubricator section 220, for example through the lubricator valve 212 and into the wellhead 102.

The lubricator section 220 in FIG. 13 comprises the lubricator conduit 312 and the lubricator valve 212. For example, the lubricator conduit 312 of FIG. 13 can be coupled between the subsea work chamber 120 and the lubricator valve 212. In the retracted position (e.g. as shown in FIG. 13), the lubricator conduit 312 can provide fluid communication between the lubricator valve 212 and the subsea work chamber 120. The lubricator valve 212 can be positioned to provide well bore isolation (e.g. fluidically isolating the system from the wellhead 102), for example until the inner tube (e.g. telescoping conduit 1212) of the lubricator section 220 seals off and allow the tools to be lowered into and out of the well bore (while the work chamber 120 is isolated). For example, the lubricator valve 212 may only be opened once the subsea work chamber 120 has been isolated from the lubricator conduit 312 (e.g. by extending the telescoping conduit 1212 and/or wireline stuffing box 230).

In embodiments, the lubricator section 220 can also include an inner tube (e.g. a telescoping conduit 1212) that can be moved vertically/axially in and out of the subsea work chamber 120 to provide a seal of the tubular (e.g. the lubricator section 220) to the well bore. For example, in the extended position, the subsea work chamber 120 can be isolated from the wellhead 102 and/or the lubricator section 220/lubricator valve 212 and/or distal end of the wireline; in the retracted position (see FIG. 13 for example), the subsea work chamber 120 can be in fluid communication with the lubricator section 220/lubricator valve 212 (e.g. no longer isolated) and/or has access to the wireline 315. For example, the telescoping conduit 1212 in the extended position (see for example FIG. 15) may span the subsea work chamber 120 to sealingly engage the proximal end of the lubricator conduit 312. For example, a seal on the exterior of the telescoping conduit 1212 (which in some embodiments may include a seal on the stuffing box 230 attached to the telescoping conduit 1212) may operate to seal the connection between the distal end of the telescoping conduit 1212 and the proximal end of the lubricator conduit 312 and/or a seal on the interior of the lubricator conduit 312 may operate to seal the connection.

In the extended position (e.g. as shown in FIG. 15, for example with the telescoping conduit 1212 spanning the subsea work chamber 120), the lubricator valve 212 and lubricator conduit 312 are fluidically isolated from the subsea work chamber 120. The telescoping conduit 1212 and/or guide conduit 217 can also be fluidly isolated from the subsea work chamber 120 in the extended position (e.g. as shown in FIG. 15). Thus, the lubricator section 220 and/or the tool insertion system 110 can be fluidly isolated from the work chamber 120 in the extended position. In the retracted position (e.g. as shown in FIG. 13), the wireline 315 can be accessed within the subsea work chamber 120 (e.g. by the robotic assembly mechanism, for example to attach and/or detach tool(s) to the distal end of the wireline 315) (e.g. since the telescoping conduit is no longer disposed between the wireline 315 and the work space 522 of the subsea work chamber 120), and/or the subsea work chamber 120 can be in fluid communication with the lubricator valve 212, the lubricator conduit 312, and/or the wireline stuffing box 230.

In some embodiments, the wireline stuffing box 230 may be configured to move between retracted and extended positions without a telescoping conduit (e.g. the ram 335 may act directly on the stuffing box 230, and/or the stuffing box 230 may be configured to sealingly engage within the lubricator conduit 312). However, in FIG. 13, the wireline stuffing box 230 may be configured to move with the telescoping conduit 1212. In FIG. 13, the wireline stuffing box 230 may be coupled to the distal end of the telescoping conduit 1212 (e.g. closer to the lubricator valve 212 and/or subsea work chamber 120, and further from the wireline reeler unit 215). In FIG. 13, a hydraulic ram can be configured to move the wireline stuffing box 230 and/or the telescoping conduit 1212 (although other mechanisms for axial movement between retracted and extended positions are also contemplated).

In some embodiments, the subsea work chamber 120 may include a sealed chamber 520 at approximately atmospheric pressure with a robotic assembly mechanism 550 (e.g. robotic arms, humanoid robot(s), and/or other robotic systems) that allow for the make-up of the wireline tools into and out of the well (e.g. via the lubricator section 220). FIG. 14 illustrates an exemplary subsea work chamber 120. In embodiments, the lubricator section 220 may be coupled to the wireline reeler unit 215 by a connector and/or the lubricator section 220 can be coupled to the subsea work chamber 120 by a connector and/or the lubricator section 220 can be coupled to a lubricator valve 212 by a connector. In some embodiments, similar connectors may be used for each coupling of various components of the system. In FIG. 14, the guide conduit 1217 (and thereby the wireline reeler unit 215) can be coupled to a top of the subsea work chamber 120, while the lubricator conduit 312 (and thereby the lubricator valve 212 and/or wellhead 102) can be coupled to a bottom of the work chamber 120. For example, the two connections (e.g. the openings in the work chamber) can be disposed opposite one another on the subsea work chamber 120, for example aligned to allow for axial extension of the telescoping conduit 1212 and/or wireline stuffing box 230 therebetween and/or for axial movement of the wireline 315 and/or attached tools.

One or more tool canister 750 can be configured for removable coupling within a port 530 of the subsea work chamber 120. Each tool canister/module 750 may include two or three (or more) tools arranged in a container/canister/pod 852, and may be configured with a method of moving a selected tool to an opening in the canister 852 that allows the tool to be loaded into the internal workspace 522 where it can be manipulated by the robotic arm(s) (e.g. when in the retracted position, as shown in FIG. 14). In some embodiments, the tool canisters 750 can be designed to allow ROV 788 delivery to and from the subsea work chamber 120 while preserving the atmospheric environment of the system. For example, the tool canister 750 may have approximately atmospheric pressure therein, with its removable canister cap 635 sealing the canister shut, and docking of the tool canister 750 within its corresponding port 530 may act to form a port seal therebetween (e.g. outward of the canister cap 635). A removable port cap 533 can seal the port 530 closed until the canister 750 is docked in the port 530. Then to access the tools in the canister 750, the sealed section between the port cap 533 and the port seal can be depressurized (e.g. brought to approximately atmospheric pressure, for example by pumping seawater out), the port cap 533 can be removed, and the canister cap 635 can be removed. Reinserting tools into the canister 750 may occur in substantially the opposite manner (e.g. reattaching the canister cap 635, reattaching the port cap 530, and pressurize the sealed space (e.g. pumping seawater into the sealed space until approximately equalized with the external sea environment). The tool canister 750 can then be removed from the port 530, for example allowing a different tool canister 750 to be inserted.

The subsea work chamber 120 can serve as an atmospheric bell work area that may allow for conventional robotic systems to be used to deliver wireline tools in and out of a well. The lubricator valve 212 can be configured to be landed on a wellhead 102 (e.g. with a safety system, such as a safety valve 105, disposed between the wellhead 102 and the lubricator valve 212). The lubricator section (e.g. a lubricator conduit 312) can be coupled above the lubricator valve 212, above which the subsea work chamber 120 can be coupled (e.g. with the lubricator conduit 312 coupled between the lubricator valve 212 and the subsea work chamber 120, and a first connector 560 connecting the lubricator conduit 312 to the subsea work chamber 120). In some embodiments, the first connector 560 can form the lubricator conduit between the lubricator valve 212 and the subsea work chamber 120. Above the work chamber 120 in FIG. 13 is the wireline stuffing box 230, guide conduit 1217, and/or wireline reeler unit 215.

The wireline stuffing box 230 can be attached to and/or moved by a hydraulic ram 335 capable of lowering the stuffing box 230 down into a sealable section in the top of the lubricator conduit 312. For example, the stuffing box 230 may have a retracted position (e.g. withdrawn from the subsea work chamber 120) and an extended position (e.g. isolating the subsea work chamber 120 from the lubricator valve 212 and/or from well pressure), and the ram 335 may move the stuffing box 230 therebetween. In FIG. 14, the stuffing box 230 is disposed at the distal/bottom end of the telescoping conduit 1212, which can be disposed within the guide conduit 1217. The ram 335 may be configured to move the stuffing box 230, for example by moving the telescoping conduit 1212 (e.g. between retracted and extended positions). At the very top of the system/assembly can be the wireline reeler 215 unit (which may include controls and/or which may be encased in an atmospheric chamber/housing). The wireline reeler unit 215 may be configured to extend and/or retract the wireline 315, which extends though the stuffing box 230 (e.g. with the stuffing box sealing around the wireline 315). In embodiments, the wireline reeler unit may be coupled atop the subsea work chamber 120, for example by the guide conduit 1217.

The subsea work chamber 120 enclosure can include robotic systems (e.g. a robotic assembly mechanism 550) to allow for the running in and retreating of wireline tools that have been delivered to the work chamber 120 in a canister/pod 750. For example, the robotic systems can include a Scara-type robot on rails (e.g. that could be raised or lowered) and/or a humanoid robot. For example, the tool canister 750 can be delivered from and/or retired to an ocean floor warehouse or a service vessel by an ROV. In other embodiments, an external wireline system or other mechanism can be configured for insertion and removal of tool canisters 750 into the corresponding port 530 of the subsea work chamber 120. The robotic systems may be configured to remove tools from the tool canister 750 (e.g. when docked in a port 530 of the work chamber 120), to attach the tool to the wireline, 315 (e.g. when in the retracted position) to make-up a tool string, to remove the tool from the wireline 315, and/or to return the tool to the canister 750. In embodiments, the robotic systems may also perform other tasks within the system.

In some embodiments, the work chamber 120 can also provide a work space for a wash ring 1405, for example allowing tools to be cleaned off as they are retrieved from the well. In some embodiments, the work chamber 120 can include a sump system 1410, for example configured so that fluids (e.g. liquids within the work chamber 120) can exit the chamber 120 via a sump drain 1411 and can be pumped via valve system 1412 and high-pressure pump 1414 back into the well (e.g. back into the production stream via an annular tube 1415 (e.g. around the lubricator conduit 312) connected to the production line at the wellhead 102). FIG. 16 illustrates an exemplary sump system 1410 and the associated piping. In embodiments, the high-pressure pump 1414 (or a separate pump) can also allow for pressuring up the lubricator section 220 (e.g. the lubricator conduit 312) prior to opening the lubricator valve 212 to well pressure. FIG. 16 also illustrates an exemplary pressurizing system with high-pressure pump and associate valving and piping. A traditional slip system and vice combination can be placed over the top of the lubricator section to allow the robotic systems to build out and retrieve sets of wireline tools. The wireline/slickline can be used for raising and lowering the tools in and out of the lubricator section. The tool canister 750(*s*) (e.g. tool delivery modules) typically have a capping and sealing system, providing atmosphere storage of the tools and a method of opening and closing the canister to maintain the atmospheric pressure in the work chamber 120. In some embodiments, the subsea work chamber 120 may include additional atmospheric tube(s), for example arranged vertically, which can be configured to give clearance for lifting long assemblies of tools (e.g. tool strings) into and out of the lubricator section 220.

A floatation device (e.g. floatation ring) 580 can be coupled to the subsea work chamber 120, and may be configured to provide approximately neutral buoyancy. This exemplary approach can provide for an ultra-lightweight robotic subsea intervention system (e.g. to be placed on the seafloor 140 and/or coupled/tethered to the wellhead 102) that can provide timely wireline intervention, without regard to vessel availability and weather window. The subsea work chamber 120 can be placed on the wellhead 102 (e.g. in proximity to the seafloor 140), and can allow well control, a robotic system for wire line tool deployment and/or retrieval including wireline reel, tool canisters/pods 750 for delivery of tool sets to and from the seafloor 140, and a taxi method for the canister/pod 750 deployment and retrieval. In some embodiments, the system can include a seafloor 140 warehousing method that reduces surface vessel requirements.

Figure 17C:
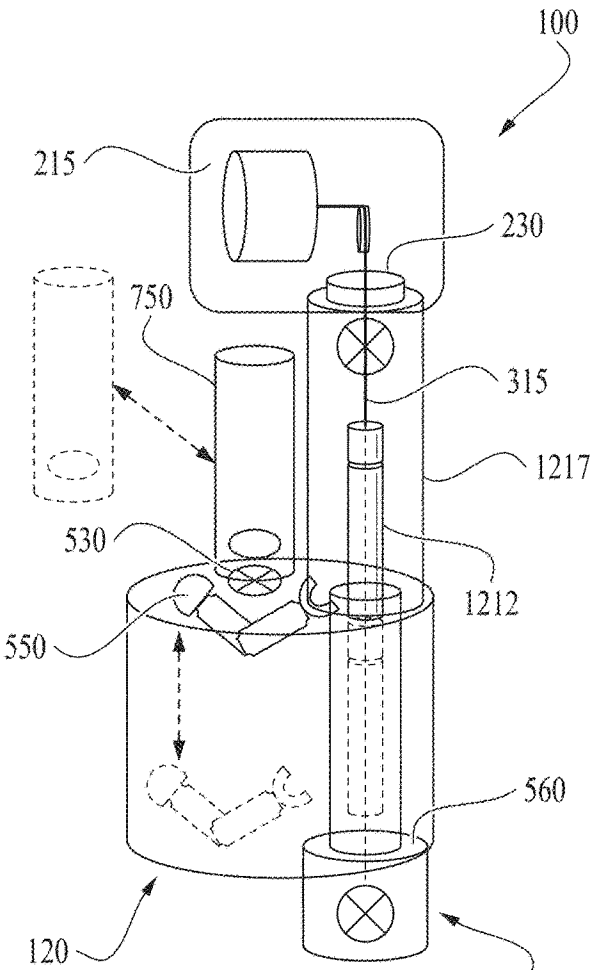
FIGS. 17A-C illustrate schematically another subsea well intervention system, according to an embodiment of the disclosure.
Figure 17B:
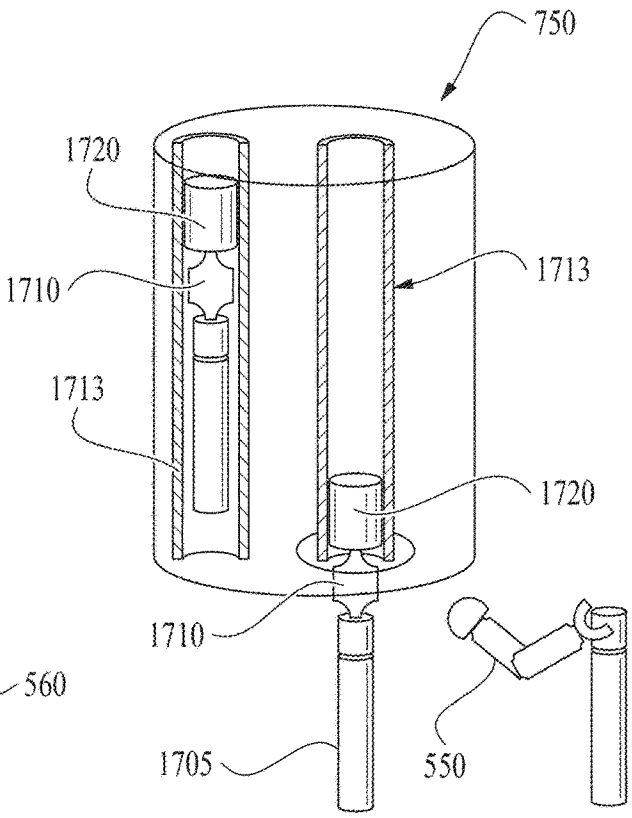
Figure 17A:
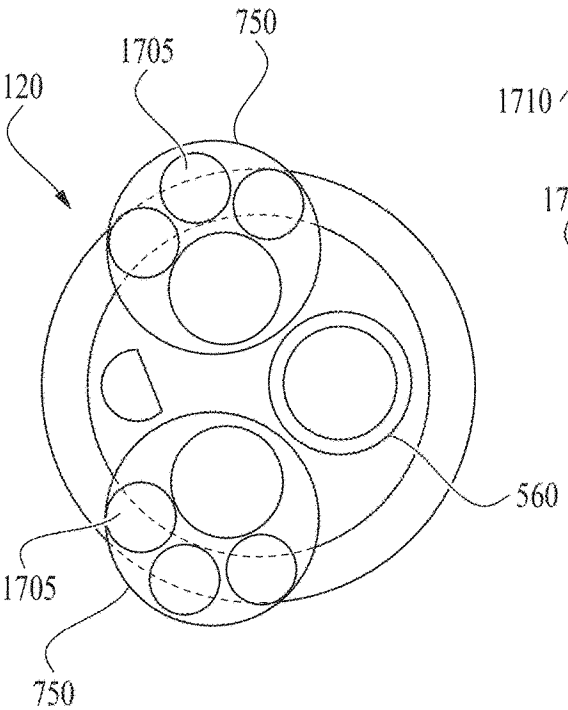

FIGS. 17A-C schematically illustrate aspects of an exemplary subsea well intervention system and its operation. FIG. 17A illustrates, via schematic plan view, how tool canister(s) 750 docked in corresponding port(s) 530 of the subsea work chamber 120 can provide access to tools therein. The subsea work chamber 120 can be coupled (e.g. via connector 560) to the lubricator section 220, and thereby to the wellhead 120. FIG. 17C illustrates, via schematic elevation view, the system 100, having the subsea work chamber 120 operatively coupled to a tool insertion system having a wireline reeler unit 215, a wireline stuffing box 230, a telescoping conduit 1212 (e.g. having a retracted position in which most of the telescoping conduit is disposed in the guide conduit 1217 and/or provides access to the wireline and/or tool in the subsea work chamber 120, and an extended position spanning the work chamber 120) and a lubricator section 220 (e.g. a lower lubricator section, which can comprise the lubricator valve 212). In FIG. 17C, the lubricator valve 212 can be directly coupled to the subsea work chamber 120, and the telescoping conduit 1212 can be configured so that in extended position, it extends into sealing connection with the lubricator valve 212 and/or the connector 560. In some embodiments, the wireline stuffing box 230 may be fixed (e.g. to the wireline reeler unit 215 and/or to the guide conduit 1217), and the telescoping conduit 1212 may move independently of the wireline stuffing box 230. FIG. 17C illustrates such an embodiment. For example, there may be a seal between the telescoping conduit 1212 and the guide conduit 1217 and/or between the guide conduit 1217 and the subsea work chamber 120 (so that when the telescoping conduit 1212 is in the extended position and the lubricator valve 212 is open, well pressure can flow through the telescoping conduit 1212, into the guide conduit 1217, up to the wireline stuffing box 230, which prevents flow into the wireline reeler unit 215, while the subsea work chamber 120 is isolated from well pressure (e.g. no fluid communication between the telescoping conduit 1212 and the subsea work chamber 120). In other embodiments, the wireline stuffing box 230 can be coupled to the telescoping conduit 1212, so that they move as one (e.g. as shown in FIG. 3 and FIG. 14). For example, the retracted and extended positions of the wireline stuffing box 230 and of the telescoping conduit 1212 may correspond, due to coupling therebetween.

In FIG. 17C, the tool canister 750 can be sealingly docked within the port 530. The robotic systems 550 can then open (e.g. remove) the port cap and the canister cap to access the tools in the canister 750 (e.g. while maintaining the internal environment of the work chamber 120, which may be approximately atmospheric). In some embodiments, one or more tool (e.g. from within the work chamber 120) may be used by the robotic system 550 to remove the port cap and the canister cap. The robotic systems 550 can then remove a tool from the canister 750 and attach it to the wireline 315 (e.g. when the telescoping conduit 1212 is in the retracted position). By extending the telescoping conduit 1212 to the extended position (e.g. spanning the work chamber 120), when the robotic systems 550 have been cleared from the area (e.g. are not disposed linearly between the connectors 560, 562), the work chamber 120 can be isolated from the lubricator valve 212. The lubricator section (e.g. the telescoping conduit 1212 and/or the guide conduit 1217 (e.g. up to the location of the stuffing box 230)) can be pressurized (e.g. up to approximately well pressure). The lubricator valve 212 can then be opened, and the tool lowered into the well via the wireline.

After well intervention with the tool is completed, the wireline can retract the tool above the lubricator valve 212, the lubricator valve 212 can be closed (while the telescoping conduit still isolates the work chamber 120 in its extended position), fluid can be pumped out of the telescoping conduit 212, etc. to depressurize the lubricator system, and only then can the telescoping conduit 1212 be retracted to its retracted position (providing access to the tool on the wireline, which can be positioned in the work chamber 120). In this way, the work chamber 120 can be kept isolated from the wellhead throughout the entire process. The robotic systems 550 can then remove the tool from the wireline and reinsert it into the canister 750.

If desired, another tool can be removed from the canister 750 and attached to the wireline by the robotic systems 550. When tools other than those in the docked tool canister 750 are desired for well intervention, the robotic systems 550 can close (e.g. sealingly reattach) the canister cap and the port cap (e.g. with the canister cap nested within the port cap/sealed section of the port 530) (thereby creating a sealed section around the canister cap), the sealed section can be pressurized (e.g. pumping fluid such as seawater into the sealed area between the port cap and the port seal), and the tool canister 750 can be removed from the port 530 (e.g. by an ROV etc.). If desired, another, different tool canister 750 (e.g. having one or more different tool) can then be docked (e.g. inserted, for example by the ROV) into the port 530 in the subsea work chamber 120, so that additional, different tools can be used (e.g. similar to the process described above).

While there are many different ways in which the tools 1705 can be removably held within the tool canister 750, FIG. 17B illustrates one exemplary tool canister system. The tool may be removably coupled to a tool connector 1710, and may be disposed within a corresponding slot 1713 in the canister 750. The slot 1713 may extend axially in the canister 750 (e.g. in a tool receptacle of the canister), so that the tools 1705 can slide axially in and out (e.g. with the tool connector 1710 configured to be movable axially within the slot 1713). A pusher mechanism 1720 can be configured so that the robotic system 550 can use it to move the tool 1705 in and out of the slot 1713. In some embodiments, the tool pusher 1720 can have a first (retracted, tool retaining) position and a second (e.g. extended, tool ejection) position. For example, the robotic system 550 can push upward on a tool removably retained in the canister 750, thereby activating the pusher 1720 to push the tool out of the slot 1713 (e.g. downward in FIG. 17B). In some embodiments, the robotic system can use a tool to engage (e.g. an in-out tool 527). The robotic system 550 can then detach the tool 1705 from the tool connector 1710. In some embodiments, the tool connector 1710 can be attached to the pusher 1720. Reinserting the tool can occur in substantially the opposite way (e.g. with the robotic system reattaching the tool 1705 to the tool connector 1710, and pushing the tool 1705 (and thereby the pusher 1720) upward into the first position (so that he tool is retained in the canister 750)).

In FIG. 17A, the tool slots 1713 and/or tools 1705 can be rotated to orient the desired tool for removal. For example, the robotic system 550 can rotate the tools (e.g. by rotating a tool receptacle, which may include a swing arm) to position the desired tool 1705 over an opening in the canister 750. Once oriented, the robotic system 550 can remove the selected tool from the canister via the opening in the canister 750. To select a different tool, the tool receptacle can be rotated (e.g. via robotic system 550) to position a second tool over the opening. In some embodiments, the robotic system 550 can include one or more robotic arms, which can be conventional robotics if the work chamber is maintained at approximately atmospheric conditions. In some embodiments, the robotic arm(s) can be mounted to the ceiling, for example on a track. In some embodiments, the robot arm(s) can each have two joints in XY plane or one joint in either the XY plane or radially plus one joint in the Z plane. Persons of skill will understand these and other embodiments in relation to this disclosure and the accompanying figures, all of which are included within the scope of this disclosure.

Figure 18A:
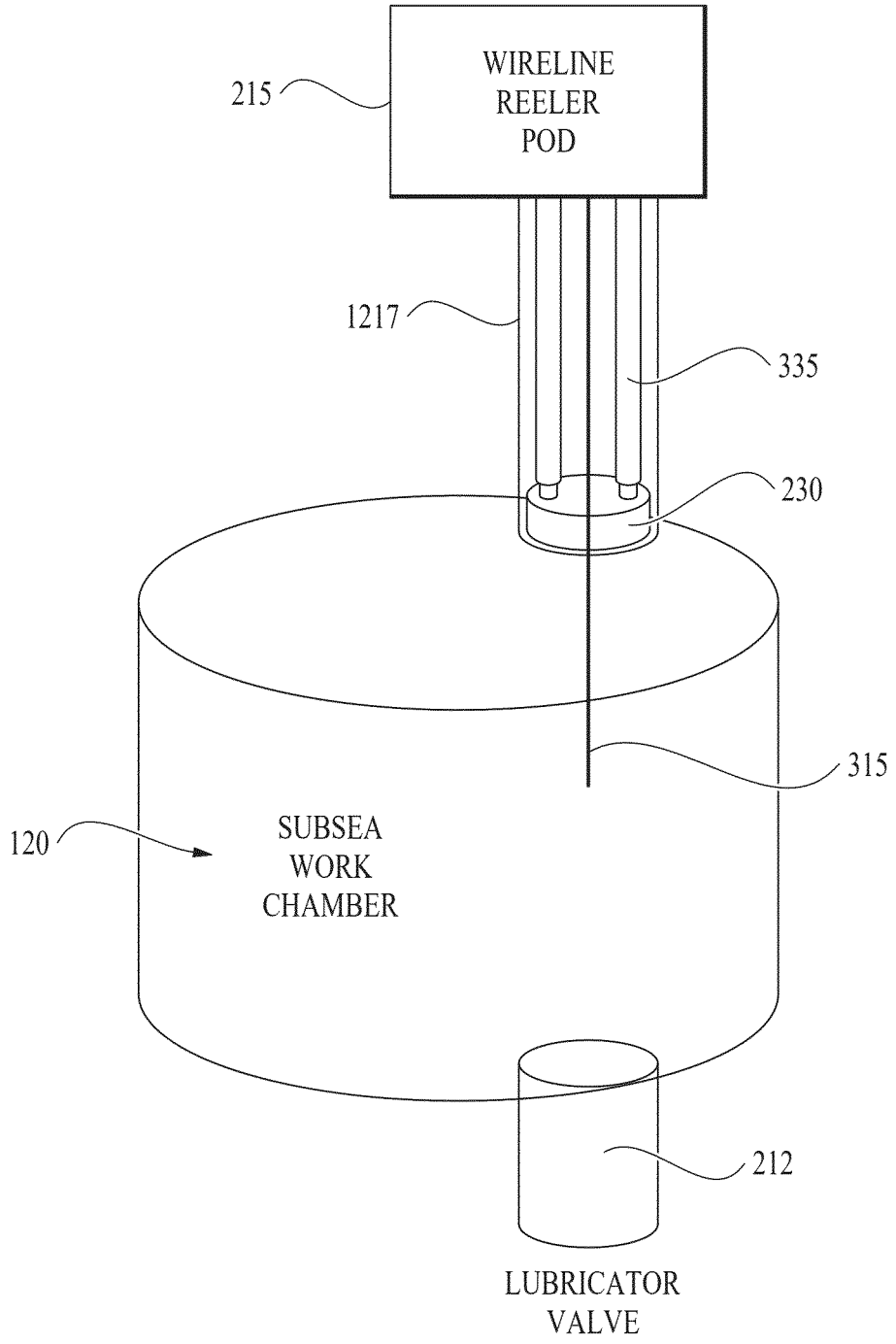
FIGS. 18A-B illustrate yet another exemplary system, for example with FIG. 18A illustrating a retracted position of a wireline stuffing box, and FIG. 18B illustrating its extended position, according to an embodiment of the disclosure.
Figure 18B:
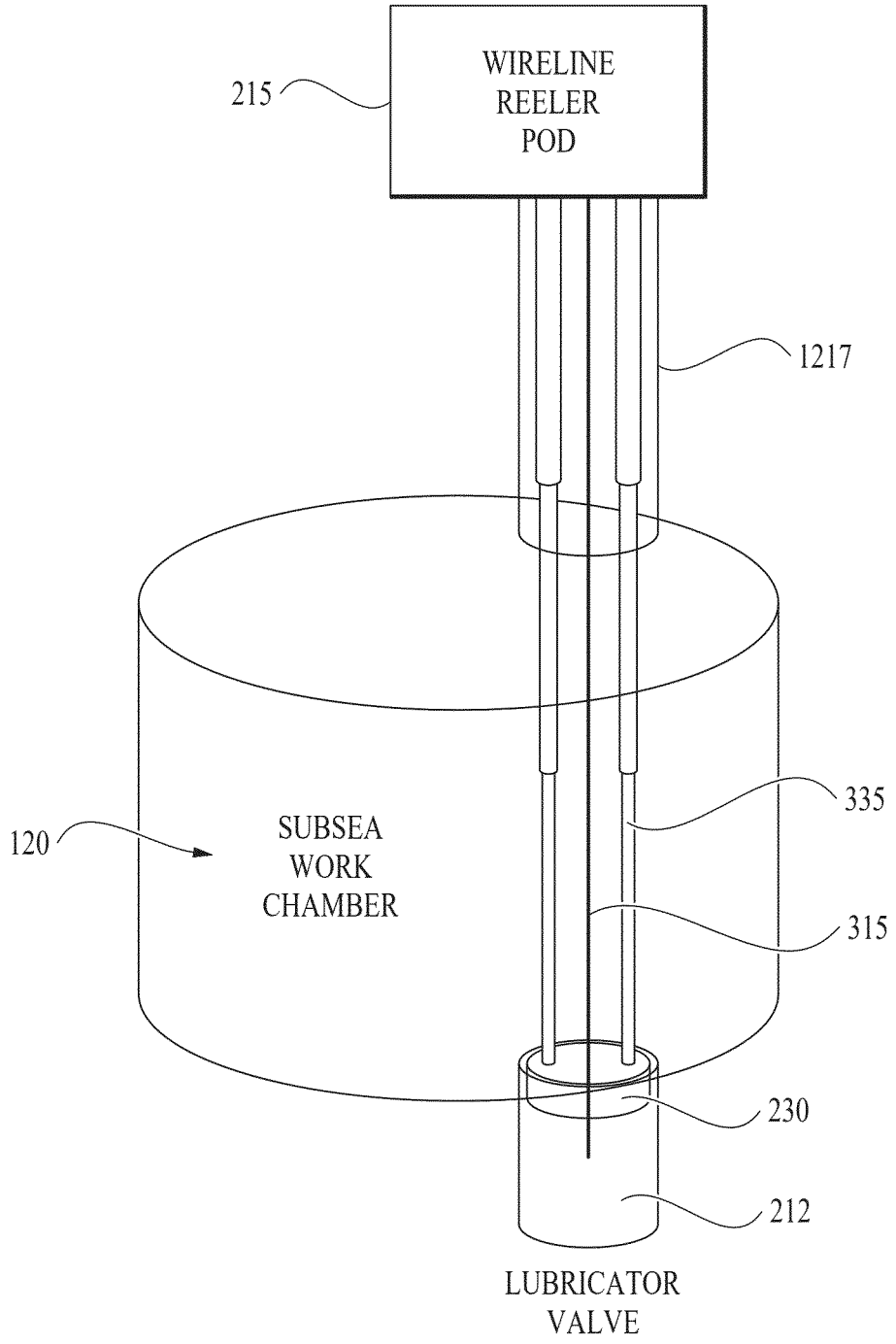

FIGS. 18A-B illustrate another embodiment of a subsea well intervention system. The system in FIGS. 18A-B can be similar in many respects to other disclosed embodiments, but for example may be configured to provide a moveable wireline stuffing box 230 without the use of a telescoping conduit (e.g. the ram mechanism 335 may not encompass the wireline 315, but in some embodiments may move the stuffing box 230 while still having the portion of the wireline 315 in the chamber 120 accessible, even though the distal end of the wireline 315 is isolated from the chamber 120). FIG. 18A illustrates the retracted position for the wireline stuffing box, while FIG. 18B illustrates the extended position. In this embodiment, the ram mechanism 335 may be configured to move the wireline stuffing box 230 between the retracted and extended positions directly, for example acting directly on the wireline stuffing box 230 (e.g. without intervening telescoping conduit).

In the retracted position, the wireline stuffing box 230 may be pulled upward sufficiently that there is access in the work chamber 120 to the distal end of the wireline 315. In some embodiments, the wireline stuffing box 230 may be entirely withdrawn from the work chamber 120, for example being disposed within the guide/connector conduit 1217 and/or the upper connector 562. In other embodiments, the wireline stuffing box 230 can still remain at least partially within the work chamber 120 during retraction, so long as there is sufficient space beneath it to access the wireline 315.

In the extended position, the wireline stuffing box 230 may extend into sealing connection with the lubricator valve 212, lower lubricator conduit and/or lower connector 560, thereby isolating the work chamber 120 from the lubricator valve 212 and/or distal end of the wireline 315. For example, in FIG. 18B the ram mechanism 335 may span the work chamber 120 in order to seat the wireline stuffing box 230 within the upper portion of the lubricator valve 212 (e.g. thereby forming a seal therebetween). Persons of skill will understand these and other embodiments, all of which are included within the scope of this disclosure.

One or more method may relate to the disclosed systems and/or components/elements thereof. Furthermore, the disclosed systems and/or components/elements can be used in one or more method. Exemplary methods are disclosed below, and persons of skill will understand that these are merely exemplary and are not intended to be limiting. One or more exemplary method may be used together, used with exemplary systems or devices, and/or modified within the scope and guidance of this disclosure (for example, with aspects of one method embodiment being used within other method embodiments). Persons of skill will understand these and other such method embodiments, within the context of this disclosure, all of which are included within the scope of this disclosure.

The disclosed subsea well intervention systems can be assembled and/or installed onto the wellhead 102. For example, an exemplary method of assembling a subsea well intervention system, can comprise: coupling a lubricator system 220 to a safety valve 105 of a wellhead 102 (e.g. placing the lubricator valve 212 into fluid communication with the wellhead 102); coupling a subsea work chamber 120 to the lubricator system 220; and configuring a wire line reeler unit 215 to provide wireline/slickline for extension into the lubricator section 220. In embodiments, configuring the wireline reeler unit 215 can comprise coupling the wireline reeler unit 215 to the subsea work chamber 120 (e.g. by coupling it to part of the lubricator system 220, such as a guide conduit 1217). In embodiments, the wireline reeler unit 215 may be configured to extend wireline axially through the lubricator system 220. In some embodiments, such configuration may also extend wireline through the subsea work chamber 120 (e.g. spanning the work chamber to extend towards the lubricator valve of the lubricator system).

In embodiments, the subsea work chamber 120 can be disposed under the surface of the sea (e.g. in proximity to the seabed). In embodiments, the subsea work chamber 120 can include a flotation device, and the chamber can be anchored to the wellhead (for example, via the lubricator section). By way of example, the flotation device can provide approximately neutral buoyancy to the subsea work chamber and/or the system as a whole, for example with the subsea chamber disposed undersea above the wellhead. Some method embodiments can further comprise inflating the flotation device. Some embodiments further comprise minimizing the weight on the wellhead 102 and/or safety valve 105 using the flotation device.

In some embodiments, the subsea work chamber 120 can comprise one or more tool canister port 530 (e.g. each configured to (e.g. sealingly) receive a tool canister 750) and/or a robotic assembly mechanism 550. In some embodiments, the subsea work chamber 120 can maintain approximately atmospheric pressure (e.g. despite being disposed undersea). Then for example, the robotic assembly mechanism 550 can comprise only conventional robotic elements (for example, configured for use under approximately atmospheric conditions and/or not configured for use under high-pressure subsea conditions).

In some embodiments, the work chamber 120 can comprise a sump system, and the method can further comprise disposing an annular sump conduit around a lubricator tube/conduit of the lubricator system 220 (e.g. before coupling the subsea work chamber atop). Some embodiments can further include coupling the sump drain and/or pump for the sump system to the annular conduit. In some embodiments, the lubricator system 220 can comprise a lubricator valve 212 and a movable wireline stuffing box 230, with the wireline from the wireline reeler unit 215 passing through the wireline stuffing box 230. In embodiments, the stuffing box 230 and/or a telescoping conduit can have a retracted position and an extended position, with the retracted position providing an open area within the subsea work chamber 120 allowing access to the distal end of the wireline, and with the extended position isolating the subsea work chamber 120 from the lubricator system 220 and/or distal end of the wireline 315. In some embodiments, the wireline stuffing box 230 seals the passage of the wireline therethrough (e.g. providing passage of the wireline while isolating the wireline reel unit from the lubricator section). In some embodiments, the lubricator system 220 can further comprises a telescoping conduit/tube. In some embodiments, the telescoping conduit can move between retracted and extended positions without moving the wireline stuffing box, while in other embodiments the wireline stuffing box 230 can be coupled to the telescoping conduit/tube 1212 (e.g. so they move together). For example, a ram mechanism 335 can be configured to axially displaced the telescoping conduit/tube and/or wireline stuffing box between the retracted position and the extended position.

Some method embodiment can further comprise, while in the retracted position, coupling a tool to the wireline (e.g. by robotic assembly mechanism 550). In some embodiments, the tool may comprise a wellcap removal tool and/or may be configured to assist with wellcap removal. Some embodiments can further comprise, selecting, by the robotic assembly mechanism, the tool from a plurality of tools disposed in a tool canister 750 coupled to the port 530 (although in other embodiments, the wellcap removal tool can already be disposed within the work chamber). The method embodiments can further comprise using the tool on the wireline to remove a wellcap/plug from the wellhead, retracting the wellcap into the subsea work chamber 120 via the wireline, and storing the wellcap in the subsea work chamber 120 (e.g. during well intervention). Some embodiments can further comprise using the tool to reattach the well cap to the wellhead 102 (e.g. after intervention).

Some method embodiments can further comprise providing a remote operated vehicle (ROV) configured to transport one or more tool canister 750. Some embodiments can further comprise providing a seabed warehouse having a plurality of tool canisters 750 (e.g. disposing a plurality of tool canisters subsea (e.g. on the sea floor) for later use. Some method embodiments can further comprise pumping fluid out of the chamber and/or lubricator section to provide approximately atmospheric pressure therein. In some embodiments, the subsea work chamber may be sealed while being lowered undersea, for example with the sealed openings only being opened once the connectors have been coupled to other elements (e.g. the tool insertion system and/or lubricator system). Alternatively, the method could include pumping fluid (e.g. silicon oil) into the subsea work chamber 120 to approximately equalize pressure with the exterior sea environment. Typically, the subsea work chamber 120 can be disposed in a subsea environment (e.g. floating above the wellhead undersea). In some embodiments, the work chamber 120 can comprise an external wireline reel unit configured to provide one or more tool canisters from the surface.

Figure 19:
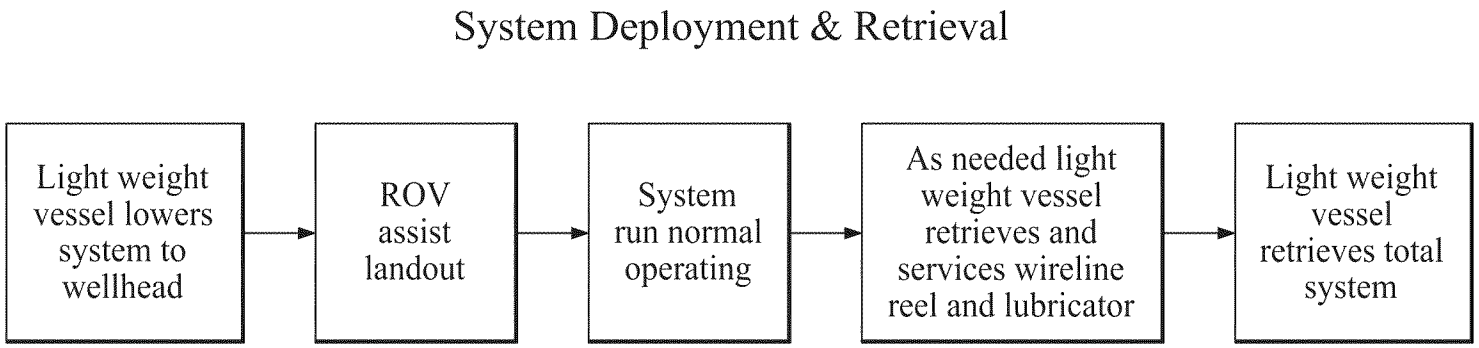
FIG. 19 is a flowchart illustrating an exemplary deployment and retrieval process, according to an embodiment of the disclosure.

Rather than assembling the system undersea, some or all of the elements can be pre-assembled at the surface (e.g. aboard a ship or platform). For example, the subsea well intervention system can be preassembled at the surface (e.g. coupling the lubrication system to the work chamber and coupling the wireline reeler unit to the work chamber) and lowered in its entirety, with the lubricator system 220, then being coupled to the safety valve 105 of the wellhead 102 under water. In embodiments, an ROV can assist in the coupling to the wellhead. Some method embodiments can further comprise (e.g. after running the system under normal operating conditions) determining that repair is needed, unlatching the entire subsea well intervention system, raising the entire subsea well intervention system to the surface, and implementing repairs thereof. In some embodiments, the ROV can perform the unlatching and/or can assist a light weight surface vessel in retrieving the system to the surface. Alternatively, upon determining that repairs are needed, methods can include decoupling one or more connector between elements of the subsea well intervention system, and raising the defective element to the surface for repair. FIG. 19 illustrates an exemplary method, in which a light weight vessel lowers the system to the wellhead, an ROV assists landout, the system runs under normal operating conditions, and if needed, a light weight vessel can retrieve and service the wireline reeler unit, the lubricator, the chamber (or any other elements/components), and/or the entire system (and in some instances, the light weight vessel may retrieve the total system, for example when its service life has ended).

Additionally, the exemplary subsea well intervention systems can be used to provide tools into the subsea work chamber 120 and/or to insert tools downhole into the well. For example, a method of providing tools for a subsea wellhead 102 can comprise: inserting/docking a tool canister 750 into a port 530 of a subsea work chamber 120, wherein the subsea work chamber 120 comprises a port cap 533 sealing an interior of the port 530, and wherein insertion of the canister 750 into the port 530 creates a seal therebetween (e.g. an external seal, distal to the port cap 533, with the canister cap 635 disposed therebetween); depressurizing the port (e.g. pumping fluid out of a space between the exterior/port seal and the port cap 533, for example to approximately equal the pressure of the work chamber, which can be approximately atmospheric in some embodiments); removing (e.g. via robotic assembly mechanism 550) the port cap 533; removing (e.g. via robotic assembly mechanism 550) the canister cap 635 (e.g. to expose the tools therein to an interior space of the subsea work chamber 120); and removing (e.g. via robotic assembly mechanism 550) a tool from the canister (e.g. into the interior space of the work chamber). When docked in the port, the canister cap 635 can be disposed between the port cap 533 and the external seal (e.g. formed by the port seal 859). In some embodiments, inserting the tool canister 750 can comprise providing the tool canister 750 via an ROV.

Method embodiments may further comprise selecting, by the ROV, the tool canister 750 from a plurality of tool canisters (e.g. from subsea warehousing). In some embodiments, inserting the tool canister 750 can comprise providing the tool canister 750 using an eternal wireline system. For example, the tool canister 750 can be lowered from a surface of the sea (e.g. from a ship or platform 160, but typically not a drill ship).

Figure 20:
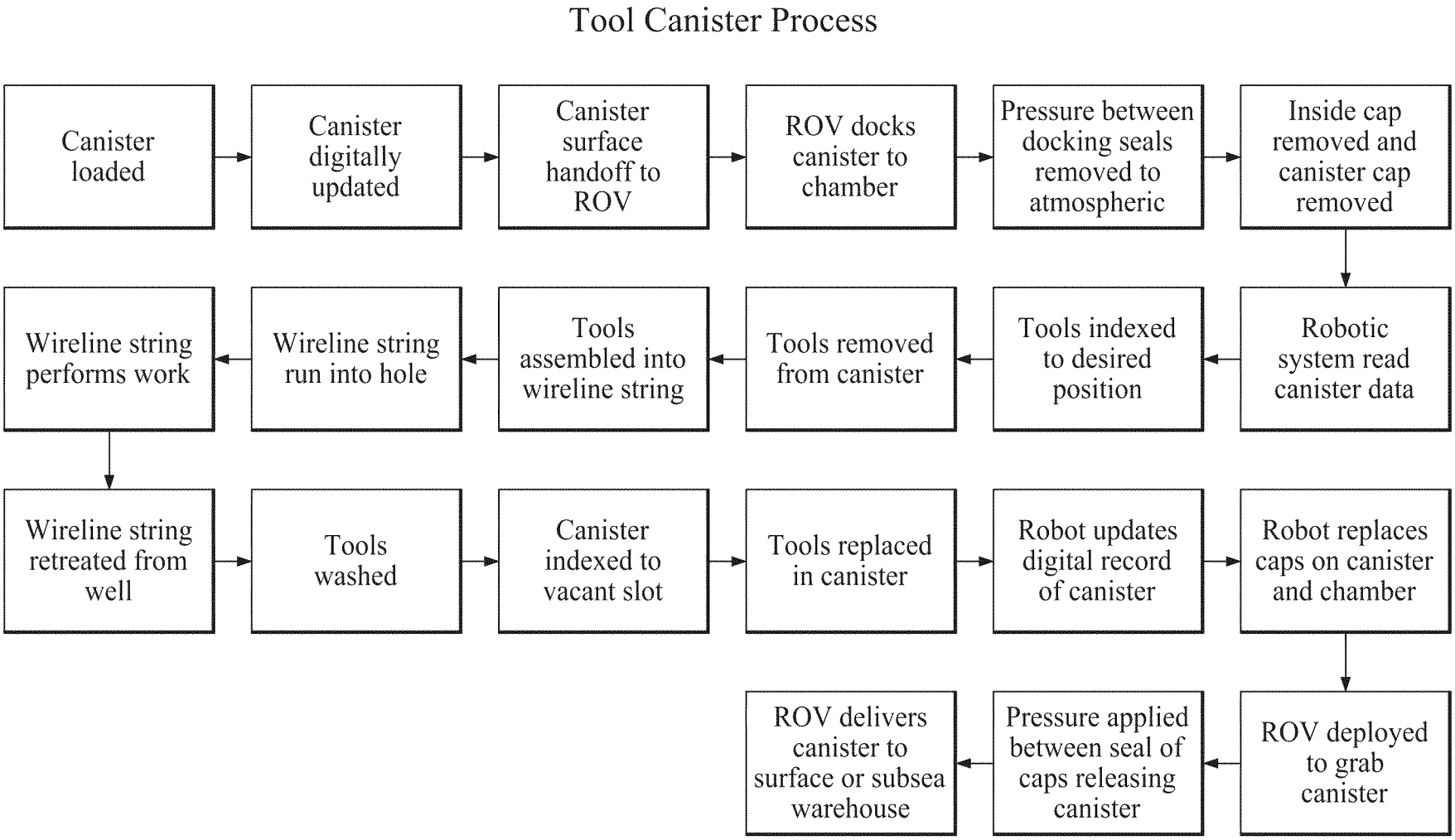
FIG. 20 is a flowchart illustrating an exemplary process for tool provision using a tool canister, according to an embodiment of the disclosure.

FIG. 20 illustrates an exemplary method of using a tool canister to provide tools to a subsea work chamber. For example, tools can be loaded into a canister (e.g. at the surface, aboard a lightweight vessel (e.g. not a drill ship)). In some embodiments, the canister may have integrated computer memory, which can be updated (e.g. regarding the tools in the canister and/or their locations). In some embodiments, an ROV can then be used to transport the canister from the surface to the subsea chamber (although other mechanisms for delivering the canister, such as external wireline, could also be used in alternate embodiments). The canister can then be docked with the chamber (e.g. in the port), e.g. with the ROV inserting the canister into the port. The sealed port (e.g. between the port seal and the port cap) can be depressurized (e.g. to remove seawater from the port via pumping and/or to provide approximately atmospheric pressure therein). The port cap can first be removed (e.g. by the robotic assembly mechanism), and then the canister cap can be removed (e.g. by the robotic assembly mechanism). In some embodiments, the robotic assembly mechanism may read/download the data from the computer memory of the canister and/or use the data for interfacing with the canister. The tools can then be indexed to the desired position (e.g. by the robotic assembly mechanism and/or to select the tool which is to be removed). In some embodiments, the data may be used to determine the proper indexing. One or more tool can then be removed from the canister (e.g. by the robotic assembly mechanism) and assembled into a wireline string (e.g. being attached/coupled to the distal end of the wireline). In some embodiments, the computer memory of the canister may be updated based on interaction with the robotic assembly mechanism.

In FIG. 20, the wireline string can be run into the wellbore (e.g. after isolation of the lubricator system from the work chamber, pressurizing the lubricator system, and opening of the lubricator valve to provide fluid communication between the lubricator system and the wellhead), allowing the wireline toolstring to perform work in the well. Once the work is completed, the wireline toolstring can be retracted from the well (which may include isolating the lubricator system from the wellbore once the toolstring has been retracted above the lubricator valve, depressurizing the lubricator section, and restoring fluid communication between the lubricator section/wireline and the work chamber). In some embodiments, the tools can be washed. Then, the canister can be indexed to the vacant slot for the tool (if needed), and the tool can be replaced in the canister (e.g. by the robotic assembly mechanism, which may also update the digital record of the canister memory in some embodiments). In embodiments, the robotic assembly mechanism can then replace the canister cap and the port cap. The sealed port can be pressurized (e.g. by pumping seawater into the space between the port seal and the port cap), allowing for ejection/removal of the canister from the port. The ROV can be deployed to grab the canister and to delver it to either the surface or to a subsea warehouse for storage.

Method embodiments can further comprise storing the port cap 533 in the work chamber 120 (e.g. in a storage area 523). In some embodiments, removing the port cap 533 can comprise using, via robotic assembly mechanism 550, a port cap removal tool. In some embodiments, removing the canister cap 635 can comprise using, via robotic assembly mechanism 550, a canister cap removal tool. In some embodiments, the same tool may be used for both port cap 533 and canister cap 635 removal (e.g. the port cap removal tool and the canister cap removal tool can be the same tool). In some embodiments, removing the tool from the canister can comprise indexing the canister and unsecuring the tool. For example, indexing can comprise using, via robotic assembly mechanism 550, an indexing tool 526 to select the specific tool from a plurality of tools in the canister and/or rotating a tool receptacle within the canister. In some embodiments, unsecuring the tool can comprise decoupling the tool from within the chamber (e.g. from the tool receptacle).

Some method embodiments can further comprise disposing the tool on a wireline in the subsea work chamber 120 (e.g. coupling the tool to the wireline or to another tool attached to the wireline and/or making up a tool string). Some embodiments can further comprise (e.g. after use of the tool is complete) inserting the tool into the canister (e.g. by robotic assembly mechanism 550, for example after removal from the wireline); attaching the canister cap 635 to the canister 750 (e.g. to seal the tool within the canister); attaching the port cap 533 to the port (to seal the interior of the port); pressurizing the port 530 (e.g. pumping fluid into the space between the external seal and the port cap 533); and removing the canister 750 from the port 530 (e.g. via ROV or external wireline system 1101). In some embodiments, pressurizing the port comprises pressurizing to approximately external sea pressure. In other embodiments, pressurizing the port can comprise over-pressurizing the port (e.g. to a pressure in excess of the eternal sea pressure). Some embodiments comprise ejecting the canister from the port. For example, over-pressurizing can eject the canister from the port.

Method embodiments can also include methods of removing a tool from a subsea tool canister 750 inserted/docked within a port of a subsea work chamber 120, wherein the tool canister 750 holds a plurality of tools. For example, method embodiments can comprise: indexing, by a robotic assembly mechanism 550, to select a desired tool from the plurality of tools; unlatching/decoupling/unsecuring, by a robotic assembly mechanism 550, the selected tool from the canister; and removing, by a robotic assembly mechanism 550, the tool from the canister. In some embodiments, indexing can comprise using, by a robotic assembly mechanism 550, an indexing tool 526 to select the tool (e.g. by interfacing the indexing tool 526 with the canister). In some embodiments, indexing can comprise rotating, by a robotic assembly mechanism 550, a tool receptacle/carousel within the canister (e.g. to align the desired tool, for example with an opening in the canister). For example, rotating can comprise using the indexing tool 526 disposed in the subsea work chamber 120. In some embodiments, indexing can comprise lifting (e.g. with the indexing tool 526) the tool receptacle (e.g. off a location retainer element) and rotating the tool receptacle to advance the tool location (e.g. to position the tool over the opening). For example, the tool receptacle can be eccentric with respect to the canister and/or the opening in the canister, such that rotating it may align different tools with the opening in the canister. In some embodiments, indexing can comprise orienting the robotic assembly mechanism 550 with respect to the desired tool. In some embodiments, indexing/rotating can comprises operating/using electric motor, hydraulic piston, or electric actuator (e.g. to rotate the tool receptacle and/or to index the desired tool into place for removal by the robotic assembly mechanism 550).

In some method embodiments, removing the tool can comprise grasping, by a robotic assembly mechanism 550, the tool and removing (e.g. sliding) the tool out of the tool receptacle and/or canister. In some embodiments, removing the tool can comprise, by a robotic assembly mechanism 550, using a removal tool (e.g. to interface with the tool and/or canister). In some method embodiments, unlatching can comprise using threaded, J-slot, hydraulic squeeze packers, collets, snap rings, etc. for latching and unlatching of the tool (e.g. rotating (e.g. to unscrew or decouple bayonet attachment) and/or axially pushing (e.g. retractable pen mechanism, for example having a pusher and/or tool connector) and/or moving the tool to unlatch a j-slot mechanism). In embodiments, the robotic assembly mechanism 550 can be disposed within the work chamber 120 (e.g. subsea, without direct contact with surface). In some embodiments, the robotic assembly mechanism 550 can comprises an arm, while in other embodiments the robotic assembly mechanism 550 can comprise two arms, with a first arm operating the removal tool and a second arm grabbing/grasping the tool from the canister (e.g. as it projects and/or ejects out of the tool receptacle and/or canister). The robotic assembly mechanism can then provide manipulation of the tool in the work chamber 120 and/or with respect to the wireline.

The latching mechanism for the tool can, in some embodiments, comprise a spiral slit with lateral divot disposed on the slit. In some such embodiments, unlatching can comprise rotating (e.g. a locking pin on the tool) the tool out of the divot and pulling (e.g. axially) the tool out of the canister (e.g. with the locking pin sliding in the slit). Some method embodiments can further comprise inserting, by a robotic assembly mechanism 550, the tool into the canister (e.g. after its use in the work chamber 120). For example, inserting can comprise pushing the tool into the canister (e.g. into the tool receptacle, for example through the aligned opening) and/or rotating the tool. For example, the locking pin can slide in the slit and/or rotating may place the locking pin into the divot. In some embodiments, pushing and rotating may occur simultaneously. Some methods can further comprise providing one or more tool to the subsea work chamber 120 by insertion of a tool canister 750 into a port of the work chamber 120.

In embodiments, once landed (e.g. with the canister in the port and accessible to the interior of the chamber), a specialized hand tool (e.g. an indexing tool, which may be operated by a first robotic hand) can be used by the robotic assembly mechanism 550 to engage a center pin (e.g. of the tool receptacle/carousel) to lift and rotate the tool receptacle/carousel, for example with indexing due to engagement of a continuous J-slot that indexes the carousel to the proper position as it is raised and then lowered (e.g. with respect to the canister). For example, the J-slot in the canister may be engaged by a pin/guide element of the tool receptacle/carousel, with the pin/guide element sliding in the J-slot (e.g. so that axial movement also results in rotation). Once the tool receptacle/carousel is indexed/rotated so that the desired wireline tool (e.g. disposed in its retaining tube/slot) is aligned with the access opening/hole into the work chamber, a second hand tool (e.g. a removal tool, which may be operated by a second robotic hand) can be used by the robotic assembly mechanism 550 to push up and then lower/remove the desired wireline tool from its retaining tube/slot.

The second hand tool can have a small diameter tip configured to fit through an opening to lift the wireline tool. A shoulder on the second hand tool can then contact an orifice ring, which may rotate as it is lifted. Such rotation of the orifice ring can align an eccentric hole with the center of the carrier tube, allowing the wireline tool to be removed from the canister. Subsequently, the wireline tool can be re-inserted into its tube/slot, where the next rotation of the orifice ring will move the eccentric hole out of alignment with the carrier tube, retaining the wireline tool in its carrier tube/slot.

Other indexing approaches may include using an electric motor to rotate the tool receptacle/carousel for retrieval or insertion of the wireline tool, using a hydraulic motor or actuator to carry out the carousel indexing, or using a simple ratchet wrench attached to the carousel center pin, which the robot can use to rotate and index the tool receptacle/carousel to the needed position. Indexing and/or tool latching/retention can be digitally verified and/or determined (e.g. by interrogation of the canister by the robotic assembly mechanism), for example by electronic communication from the canister to the robotic assembly mechanism 550. In embodiments, communication from the canisters to the robotic assembly mechanism 550 can be a wired or wireless solution, such as RFID, Bluetooth, or other means. Digital communication, such as proof of life, power status, and diagnostic information, can allow the robotic assembly mechanism 550 to perform tele-operated or automated tasks associated with the wireline tool utilization.

Still other method embodiments can comprise methods of inserting a tool from a subsea work chamber 120 into a wellhead 102. Exemplary methods can comprise: coupling, by a robotic assembly mechanism 550, a tool to a wireline disposed in the work chamber 120; moving/lowering a wireline stuffing box 230 and/or telescoping conduit (e.g. from a retracted position to an extended position) to seal a lubricator system that is coupled to the wellhead 102 (e.g. isolating the work chamber from the lubricator system and/or tool insertion system and/or lubricator valve and/or well pressure and/or distal end of the wireline); pressurizing the lubricator system, such as the lubricator conduit (e.g. between the lubricator valve and the wireline stuffing box) (e.g. to approximately wellbore pressure); opening a lubricator valve 212 disposed between the wellhead 102 and the chamber (e.g. to place the lubricator system into fluid communication with the wellhead); and lowering/moving, by the wireline, the tool into the wellhead 102 (e.g. through he lubricator system). In some embodiments, isolating the subsea work chamber (e.g. from a lubricator section/system and/or from a tool insertion system and/or from a lubricator valve) can comprise isolating the distal end of the wireline and the tool from the subsea work chamber (e.g. as they are disposed within a telescoping conduit of the lubricator section/system, which in its extended position isolates the work chamber).

In some embodiments, the lubricator conduit 312 (e.g. a lower lubricator conduit) can be coupled between the work chamber 120 and the wellhead 102. In some embodiments, the lubricator conduit 312 can be coupled to the wellhead 102 through the lubricator valve 212 and/or a safety valve 105. In some method embodiments, moving/lowering a wireline stuffing box 230 and/or telescoping conduit 1212 can seal/isolate the work chamber 120 from the lubricator system (e.g. the lubricator conduit). In some embodiments, the wireline stuffing box 230 can be attached to a telescoping (e.g. inner) conduit, and moving the wireline stuffing box 230 can comprise axially shifting the telescoping conduit 1212 from a retracted position, configured to provide access to the distal end of the wireline in the work chamber 120, to an extended position, configured to span the work chamber 120 (e.g. into sealing connection and/or fluid communication with the lubricator conduit 312 and/or lubricator valve 212). For example, in the extended position, the telescoping conduit 1212 can be sealingly coupled to the lubricator conduit 312 and/or lubricator valve 212. In embodiments, the wireline stuffing box 230 can be disposed at the distal end of the telescoping conduit 1212 (e.g. distal to/away from a wireline reeler unit 215), at a proximal end of the telescoping conduit 1212 (e.g. proximal/closest to the wireline reeler unit 215), or within the telescoping conduit 1212. For example, the wireline stuffing box 230 can be sealingly coupled to the telescoping conduit 1212. In some embodiments, moving a wireline stuffing box 230 can comprises disposing the tool on the wireline into the lubricator conduit 312 and/or into proximity with the lubricator valve 212. In some embodiments, the work chamber 120 can be at approximately atmospheric pressure (e.g. so that isolating the work chamber from the well pressure can be an important step before opening the lubricator valve 212).

In embodiments, pressurizing the lubricator conduit 312 can occur when the tool is disposed in the lubricator conduit 312 (e.g. between the work chamber 120 and the lubricator valve 212 and/or within the extended telescoping conduit 1212). In some embodiments, pressurizing the lubricator conduit 312 can occur when the wireline stuffing box 230 and/or telescoping conduit 1212 are in the extended position (e.g. when the lubricator system is isolated from the work chamber). In some embodiments, pressurizing the lubricator conduit 312 can comprise pumping fluid (e.g. from the external sea environment) into a space above the lubricator valve 212 (e.g. between the lubricator valve 212 and the wireline stuffing box 230). Method embodiments can further comprise opening a safety valve 105 disposed between the lubricator valve 212 and the wellhead 102.

In embodiments, the tool can be configured for removal of a wellcap/plug, and the method can further comprise using the tool to remove the wellcap 524; retracting (e.g. via the wireline, which is retracted) the wellcap 524 into the lubricator conduit 312 (e.g. between the lubricator valve 212 and the work chamber 120, and in some embodiments it can comprise the extended telescoping conduit); closing the lubricator valve 212; depressurizing the lubricator conduit 312 (e.g. pumping fluid out of the lubricator conduit 312 until the pressure in the lubricator conduit 312 is approximately the same as pressure in the work chamber 120—e.g. approximately atmospheric pressure); moving the wireline stuffing box 230 and/or telescoping conduit 1212 (e.g. to the retracted position) so that the work chamber is not isolated from the lubricator conduit 312; moving the tool and wellcap 524 (e.g. via wireline retraction) into the work chamber 120; and/or removing, by robotic assembly mechanism 550, the tool from the wireline.

In some embodiment, the tool can be configured for well intervention (e.g. paraffin scraping, Gas Lift Valve replacement, well survey, plug setting or unsetting, etc.), and the method can further comprise using the tool for well intervention; retracting (e.g. via the wireline, which is retracted) the tool into the lubricator conduit 312 (e.g. between the lubricator valve 212 and the work chamber 120, and in some embodiments it can comprise the extended telescoping conduit); closing the lubricator valve 212; depressurizing the lubricator system (e.g. the lubricator conduit 312, for example pumping fluid out of the lubricator conduit 312 until the pressure in the lubricator conduit 312 is approximately the same as pressure in the work chamber 120—e.g. approximately atmospheric pressure); moving the wireline stuffing box 230 and/or telescoping conduit 1212 (e.g. to the retracted position) so that the work chamber is not isolated from the lubricator conduit 312; moving the tool (e.g. via wireline retraction) into the work chamber 120; and removing, by robotic assembly mechanism 550, the tool from the wireline. In embodiments, the method can further comprise coupling, by the robotic assembly mechanism 550, a second (e.g. different) tool to the wireline disposed in the work chamber 120; moving/lowering the wireline stuffing box 230 and/or telescoping conduit 1212 (e.g. from the retracted position to the extended position) to seal/isolate the lubricator system that is coupled to the wellhead 102; pressurizing the lubricator system (e.g. to approximately wellbore pressure); opening the lubricator valve 212 disposed between the wellhead 102 and the chamber; and lowering/moving, by the wireline, the second tool into the wellhead 102.

Some method embodiments can further comprise washing/rinsing the tool as it is moved from the lubricator conduit 312/connector 560 into the work chamber 120 (e.g. using a wash ring and/or scrubber). Some embodiments can further comprise operating a sump system to dispose of (e.g. eject) any fluid/liquid entering the work chamber 120 (e.g. from the lubricator conduit 312 and/or tool and/or wash ring), for example ejecting the fluid out of the work chamber. For example, the sump system can eject/pump the fluid into the wellhead 102 (e.g. either by pumping into the lubricator conduit 312 or below the lubricator valve 212) or into the production tubing. Some method embodiments can further comprise providing the tool from a canister having a plurality of tools. In some embodiments, the one or more tool can be provided to the subsea work chamber 120 by insertion of a tool canister 750 into a port of the work chamber 120. Some methods can further comprise making up, by robotic assembly mechanism 550, a tool string comprising two or more tools. For example, the tool string can be made up in the work chamber 120 and/or making up can comprise coupling two or more tools together (e.g. and to the wireline). Method embodiments can further comprise producing the well (e.g. in some embodiments production may occur even as tools are disposed in and/or used for the well). In some method embodiments, one or more disclosed methods may be used in conjunction, as will be readily understood be persons of skill.

Figure 21:
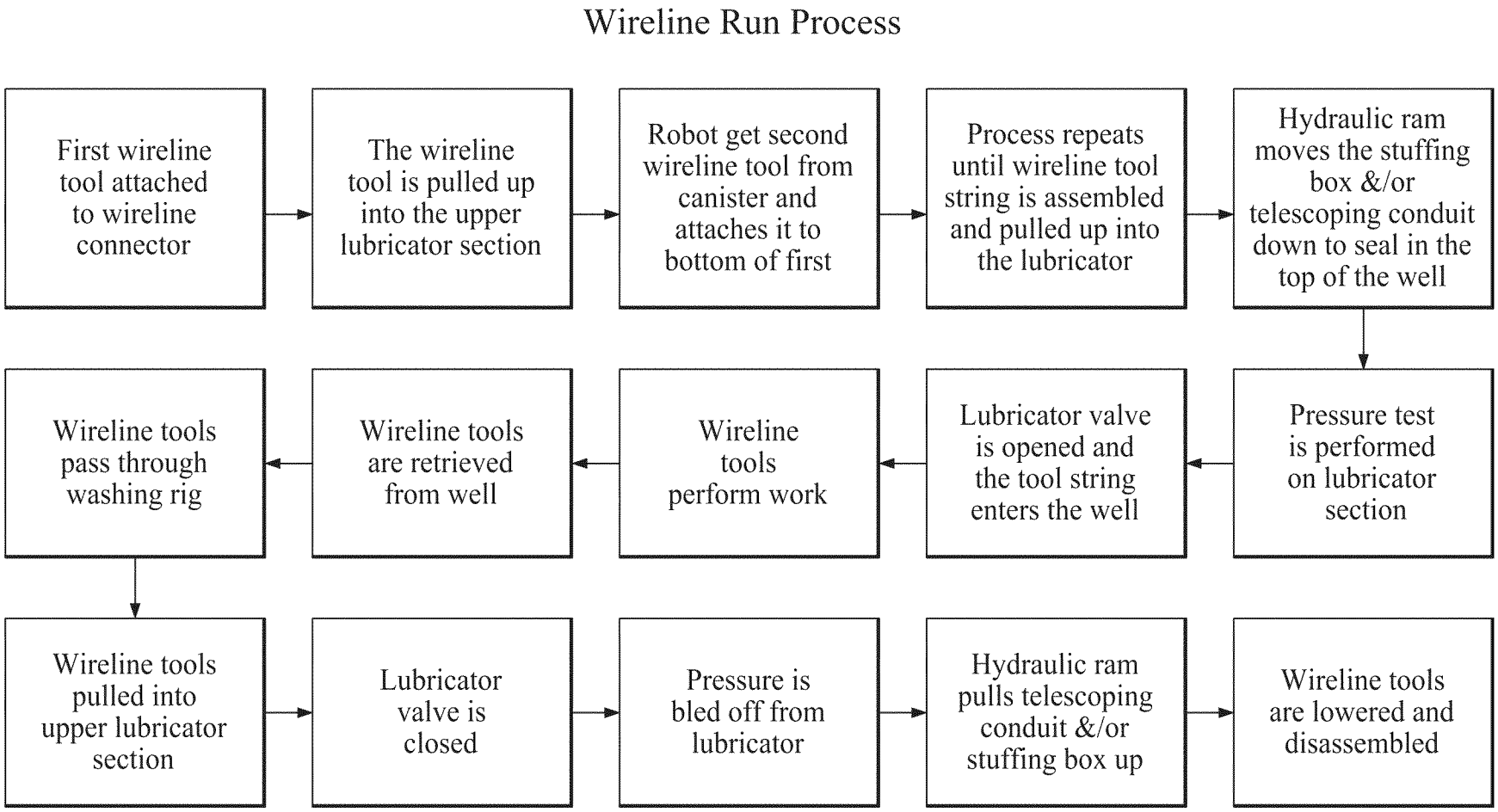
FIG. 21 is a flowchart illustrating an exemplary process for operating a wireline toolstring, according to an embodiment of the disclosure.

FIG. 21 illustrates an exemplary method of using a wireline to provide one or more tool into a subsea well. In some embodiments, a first wireline tool (e.g. removed from the canister) can be coupled to the wireline connector at the distal end of the wireline (e.g. by the robotic assembly mechanism). This may occur in the work chamber. If further tools are to be made-up into the toolstring, then the wireline can retract, for example to pull the first wireline tool and/or wireline connector upward, for example into the upper lubricator section (e.g. coupling the wireline reeler unit to the work chamber) and/or to make room in the work chamber for attachment of another tool below the first. This process can be repeated as needed until the toolstring is fully assembled (e.g. by the robotic assembly mechanism coupling as many tools as desired to form the toolstring). The lubricator system can then be isolated from the work chamber (e.g. by movement of the wireline stuffing box and/or telescoping conduit of the lubricator system), before pressure testing the lubricator system and pressurizing it (for example up to approximately well pressure). The toolstring can perform its work in the well (e.g. after the lubricator valve is opened and the toolstring lowered into the well).

For tool removal, the toolstring can be raised above the lubricator valve and/or washed/rinsed. In some embodiments, the toolstring can be pulled into the upper lubricator section. While the toolstring is above the lubricator valve, the lubricator valve can be closed (e.g. to isolate the lubricator section from the well), the lubricator system can be depressurized (e.g. to approximately atmospheric pressure), and fluid communication can be restored between the work chamber and the lubricator system (e.g. by retracting the telescoping conduit and/or wireline stuffing box). The tools can then be disassembled from the wireline (e.g. within the work chamber and/or by the robotic assembly mechanism). In some embodiments, this exemplary process (or portions thereof) can be used in conjunction with the broader tool provision process of FIG. 20 (e.g. with respect to the wireline portions of FIG. 20).

Disclosed embodiments may reduce the costs associated with vessel deployment for well intervention, for example in terms of the size of the vessel used and/or the frequency of the vessel requirement. For example, in some embodiments, no vessel may be needed for well intervention once the system has been deployed subsea. In other embodiments, even if a vessel (e.g. a surface vessel, such as a ship or platform) is used, it may not be a drill ship and/or it may be used less often (for example, to resupply the subsea warehousing). This can be helpful both in planning/scheduling and in lowering cost, since scarcity of drill ships has historically been a limiting factor. Furthermore, use of disclosed subsea well intervention systems can isolate the system (and associated well intervention) from surface weather issues. This may allow for well intervention even when the weather window conventionally would not allow it.

Additionally, disclosed embodiments may provide for lightweight or even ultra-lightweight well intervention, which can reduce stresses on the wellhead. For example, lightweight embodiments may be at or less than approximately 30 tons (e.g. approximately 20-30 tons, 25-30 tons, or 20-25 tons), and ultralightweight can be at or less than approximately 20 tons (e.g. approximately 5-20 tons, 10-20 tons, 15-20 tons, 10-15 tons, 5-10 tons, or approximately 20 tons). The modular design of the system can allow for deployment and maintenance to be carried out using smaller surface vessels, versus a traditional drill ship. Additionally, because there is no riser going to the surface, the system typically may not experience cyclical side loading associated with a riser-based system. All of this can lead to increased production of the well, for example due to the availability of intervention maintenance, for example paraffin scraping and gas lift valve replacement. Such increased production can be a core financial driver for subsea wells. Persons of skill will understand these and other potential benefits to the disclosed embodiments. Additionally, persons of skill will understand that similar systems and/or methods may be used for other subsea tasks, for example other times when a subsea well may need a tool or other device introduced.

ADDITIONAL DISCLOSURE

The following are non-limiting, specific embodiments in accordance with the present disclosure:

In a first embodiment, a subsea work chamber can comprise: a (e.g. sealed/isolated) chamber (e.g. configured to withstand subsea pressure) having an internal work space; one or more (e.g. two or three) port configured for tool canister/pod docking (e.g. insertion of corresponding tool canister with removable seal coupling); a robotic assembly mechanism (e.g. configured to remove tools from the docked canister, to connect one or more tool to the wireline, to make up a tool string, and/or to insert tools into the docket canister); a first connector configured for (e.g. fluid communication) coupling of the subsea work chamber with a lubricator system and/or wellhead (e.g. having an opening between the internal work space and the lubricator system) (e.g. with the coupling being either direct or indirect); and a second connector configured for (e.g. fluid communication) coupling of a wireline reeler unit and/or wireline stuffing box and/or telescoping conduit and/or wireline guide conduit to the subsea work chamber (e.g. having an opening between the internal work space and the wireline reeler unit and/or wireline stuffing box and/or telescoping conduit and/or wireline guide conduit) (e.g. with this coupling being either direct or indirect).

A second embodiment can include the work chamber of the first embodiment, wherein the robotic assembly mechanism comprises (for example only has/is composed of) conventional robotic equipment (e.g. configured to operate in approximately atmospheric conditions/pressure—not configured for use in high pressure/subsea environments).

A third embodiment can include the work chamber of any one of the first or second embodiments, wherein the robotic assembly mechanism comprises one or more arms (e.g. two arms) configured to move on a track (e.g. extending around the periphery of the internal work space).

A fourth embodiment can include the work chamber of any one of the first to third embodiments, wherein the robotic assembly mechanism comprises a humanoid robot.

A fifth embodiment can include the work chamber of any one of the first to fourth embodiments, wherein the sealed chamber is configured to be coupled/tethered/anchored to the wellhead and/or seabed (e.g. through the lubricator system and/or safety valve) (e.g. with the sealed chamber disposed undersea).

A sixth embodiment can include the work chamber of any one of the first to fifth embodiments, further comprising a floatation device (e.g. floatation ring disposed around an exterior of the sealed chamber) (e.g. configured to make the subsea chamber ultra-lightweight on the wellhead, for example as disposed atop the wellhead undersea) (e.g. configured to provide approximately neutral buoyancy).

A seventh embodiment can include the work chamber of any one of the first to sixth embodiments, further comprising a sump system configured to eject/dispose of fluids (e.g. liquids) in the internal work space.

An eighth embodiment can include the work chamber of the seventh embodiment, wherein the sump system comprises a drain, an annular conduit disposed around the lubricator system (e.g. around the lubricator conduit and/or lubricator valve), and a pump (e.g. configured to pump fluid from the drain to the production line up to the floating production facility).

A ninth embodiment can include the work chamber of any one of the first to eighth embodiments, further comprising a wash ring disposed in proximity to the first connector and configured to wash (e.g. spray with water) tools being retracted out of the lubricator system.

A tenth embodiment can include the work chamber of the ninth embodiment, further comprising a scrubber/brush disposed in proximity to the first connector and/or wash ring.

An eleventh embodiment can include the work chamber of any one of the first to tenth embodiments, wherein the port comprises a removable port cap configured to sealingly close the port (e.g. when attached/coupled to the port) (e.g. and to open the port when removed).

A twelfth embodiment can include the work chamber of any one of the first to eleventh embodiments, wherein the port is configured to sealingly receive the corresponding tool canister (e.g. a port seal may be disposed on the canister or on the port (e.g. in proximity to the exterior)).

A thirteenth embodiment can include the work chamber of any one of the first to twelfth embodiments, wherein, when the tool canister is docked in the port, a canister cap is nested within the port cap (e.g. disposed between the port cap and the port seal).

A fourteenth embodiment can include the work chamber of any one of the first to thirteenth embodiments, wherein the port comprises a canister guide mechanism (e.g. disposed on its external surface) configured to guide the capped open end of the canister into the port (for example, a funnel-shaped mechanism disposed on the port).

A fifteenth embodiment can include the work chamber of any one of the first to fourteenth embodiments, wherein inserting the capped canister open end into the port creates a sealed section between the port cap and the port seal (with the canister cap therebetween).

A sixteenth embodiment can include the work chamber of the fifteenth embodiment, further comprising a pump configured to pump fluid in and/or out of the sealed section (e.g. depressurizing the sealed section for tool removal and/or pressurizing the sealed section for removal of the canister from the port).

A seventeenth embodiment can include the work chamber of any one of the first to sixteenth embodiments, wherein the internal work space comprises a storage area configured to receive a wellcap/plug, a port cap, a canister cap, an indexing tool (e.g. configured for selecting one of a plurality of tools in the canister, for example by rotating the tools within the canister), and/or an in-out tool (e.g. configured for removal of a tool from the canister).

An eighteenth embodiment can include the work chamber of any one of the first to seventeenth embodiments, wherein the sealed chamber is configured to retain approximately atmospheric pressure (e.g. having approximately atmospheric pressure therein even when disposed at depth subsea).

A nineteenth embodiment can include the work chamber of any one of the first to eighteenth embodiments, wherein an indexing tool and/or an in-out tool are disposed in the interior work space.

A twentieth embodiment can include the work chamber of any one of the first to nineteenth embodiments, wherein slips and a vice are disposed in the internal work space.

A twenty-first embodiment can include the work chamber of any one of the first to twentieth embodiments, wherein the two connectors (e.g. the first and second connectors) are disposed opposite one another on the sealed chamber (e.g. with axis aligning) (e.g. the second connector on top of the sealed chamber and the first connector on the bottom of the sealed chamber, directly opposite).

A twenty-second embodiment can include the work chamber of any one of the first to twenty-first embodiments, further comprising an external wireline system (e.g. reel unit) configured to provide one or more tool canisters from the surface to the subsea work chamber (e.g. for insertion of a tool canister from the surface of the sea into the port and/or for removal of a tool canister from the port to the surface).

A twenty-third embodiment can include the work chamber of the twenty-second embodiment, wherein the external wireline system is configured to removably couple to the tool canister.

A twenty-fourth embodiment can include the work chamber of any one of the twenty-second to twenty-third embodiments, wherein the external wireline system is configured to rotate/pivot between two or more ports (e.g. allowing a single wireline system to insert or remove tool canisters from multiple ports).

A twenty-fifth embodiment can include the work chamber of any one of the first to twenty-fourth embodiments, further comprising a telescoping conduit configured to span the sealed chamber (e.g. span the interior work space) between the first and second conduits when in extended position, and to provide a work area (e.g. open to allow for passage of a tool) between the first and second conduits when in retracted position.

A twenty-sixth embodiment can include the work chamber of any one of the first to twenty-fifth embodiments, wherein the subsea work chamber is disposed subsea (e.g. in proximity to the seabed for example approximately 7-25 feet, 7-15 feet, or 15-25 feet from seabed and/or approximately 5-15, 7-15, 7-10, or 5-7 feet from the wellhead and/or production tree) and/or is exposed to subsea conditions (e.g. pressures of approximately 500-6000 PSI or greater and/or depths of approximately 1000-9000 ft or greater).

A twenty-seventh embodiment can include the work chamber of any one of the first to twenty-sixth embodiments, wherein the chamber (e.g. the interior work space) has approximately atmospheric pressure (e.g. is filled with air maintained at approximately surface atmospheric pressure) (e.g. even when disposed undersea and experiencing greater external pressure outside the chamber).

A twenty-eighth embodiment can include the work chamber of any one of the first to twenty-sixth embodiments, wherein the chamber is filled with oil (e.g. silicon oil) and pressurized to approximately the same pressure as the external subsea environment (e.g. and the robotic assembly mechanism is configured for use under such high pressure).

A twenty-ninth embodiment can include the work chamber of any one of the first to twenty-eighth embodiments, wherein the chamber is disposed in a subsea environment (for example deep water such as approximately 1000-9000 feet and/or high-pressure such as approximately 500-6000 PSI and/or temperatures of approximately 30-40 degrees Fahrenheit).

A thirtieth embodiment can include the work chamber of any one of the first to twenty-ninth embodiments, wherein the subsea work chamber is not coupled to the surface and/or to a drill ship (e.g. there is no riser extending to the surface of the sea).

A thirty-first embodiment can include the work chamber of any one of the first to thirtieth embodiments, wherein the internal work space is insufficient (e.g. in size) for a human operator.

A thirty-second embodiment can include the work chamber of any one of the first to thirty-first embodiments, wherein the sealed chamber does not include an entryway for a human operator.

A thirty-third embodiment can include the work chamber of any one of the first to thirty-second embodiments, wherein the sealed chamber does not meet safety standards required for a human operator (e.g. the sealed chamber is designed with lower safety standards acceptable for robotic use but not for human use).

In a thirty-fourth embodiment, a tool canister/pod (e.g. for delivery of well intervention tools to a subsea work chamber) can comprise: a canister/pod configured to hold one more tool (e.g. wireline and/or well intervention tool) and having an open end; and a removable canister cap configured to sealingly close the open end of the canister; wherein the canister is configured to sealingly engage with a port of the subsea work chamber, to create a sealed section around the canister cap (e.g. between a port cap of the port and a portion of the port outward of the received canister cap).

A thirty-fifth embodiment can include the canister of the thirty-fourth embodiment, wherein the canister cap is configured to fit within the port (e.g. of the subsea work chamber).

A thirty-sixth embodiment can include the canister of any one of the thirty-fourth to thirty-fifth embodiments, further comprising a port seal configured to sealingly engage within the port of the subsea work chamber (e.g. thereby preventing fluid flow from the surrounding sea environment through the port when the canister is docked in the port—e.g. between an exterior of the canister and the walls of the port).

A thirty-seventh embodiment can include the canister of the thirty-sixth embodiment, wherein the port seal is disposed on an exterior surface of the canister (e.g. the canister cap is distal to the port seal), and wherein when the canister is docked in the port, the canister cap is disposed between the port cap and the port seal.

A thirty-eighth embodiment can include the canister of any one of the thirty-fourth to thirty-seventh embodiments, wherein, upon removal of the canister cap from the canister open end, the one or more tools disposed therein are exposed (e.g. can be removed).

A thirty-ninth embodiment can include the canister of any one of the thirty-fourth to thirty-eighth embodiments, wherein the canister cap is distal to the port seal and/or the port seal is uncovered by the cannister cap (e.g. the port seal is exposed, even when the canister cap is applied to the open end).

A fortieth embodiment can include the canister of any one of the thirty-fourth to thirty-ninth embodiments, wherein the capped open end of the canister is configured for insertion into the port, thereby nesting the canister cap within the port cap.

A forty-first embodiment can include the canister of any one of the thirty-fourth to fortieth embodiments, wherein inserting the capped canister open end into the port creates a sealed section between the port cap and the port seal (e.g. with the canister cap therebetween).

A forty-second embodiment can include the canister of any one of the thirty-fourth to forty-first embodiments, wherein the canister comprises a flotation device (for example, configured to provide approximately neutral buoyancy to the canister).

A forty-third embodiment can include the canister of any one of the thirty-fourth to forty-second embodiments, wherein the canister is configured to hold a plurality of tools (e.g. subsea well intervention tools) (e.g. within its internal space).

A forty-fourth embodiment can include the canister of any one of the thirty-fourth to forty-third embodiments, wherein the canister holds a plurality of the same tool (e.g. for redundancy).

A forty-fifth embodiment can include the canister of any one of the thirty-fourth to forty-fourth embodiments, wherein the canister holds a plurality of different tools.

A forty-sixth embodiment can include the canister of any one of the thirty-fourth to forty-fifth embodiments, wherein the canister holds a plurality of tools configured to be made up into a toolstring.

A forty-seventh embodiment can include the canister of any one of the thirty-fourth to forty-sixth embodiments, wherein the canister has and/or is configured to retain approximately atmospheric pressure therein (e.g. has approximately the same pressure as the subsea work chamber that is configured to work with).

A forty-eighth embodiment can include the canister of any one of the thirty-fourth to forty-seventh embodiments, wherein the canister cap is configured for twist attachment and/or removal (e.g. screw threading or bayonet attachment).

A forty-ninth embodiment can include the canister of any one of the thirty-fourth to forty-eighth embodiments, further comprising a tool receptacle disposed within the canister and configured to hold the tools (e.g. so that an end of one or more tool can project out of the canister when the canister cap is removed) (e.g. with tools held approximately parallel to longitudinal axis of canister) (e.g, wherein each tool fits within a corresponding slot in the tool receptacle).

A fiftieth embodiment can include the canister of the forty-ninth embodiment, wherein the tool receptacle is configured to rotate within the canister (e.g. to index a desired tool for removal).

A fifty-first embodiment can include the canister of any one of the forty-ninth to fiftieth embodiments, wherein each tool is removably latched within the tool receptacle (e.g. within the corresponding slot) (e.g. by a latching system).

A fifty-second embodiment can include the canister of the fifty-first embodiment, wherein the latching system for each tool/slot is configured with a j-slot (e.g. configured to operate in a manner similar to a retractable pen).

A fifty-third embodiment can include the canister of any one of the fifty-first to fifty-second embodiments, wherein the latching system comprises a spiral slit with lateral divot disposed on the slit.

A fifty-fourth embodiment can include the canister of any one of the thirty-fourth to fifty-third embodiments, wherein the canister is configured for use in a subsea environment (for example deep water such as approximately 1000-9000 feet and/or high-pressure such as approximately 500-6000 PSI).

In a fifty-fifth embodiment, a subsea tool provision system can comprise: a sealed chamber, having a port and a removable port cap configure to sealingly close the port (e.g, wherein the port cap is configured to seal against sea pressure); a canister/pod configured to hold one more tool, configured to fit within the port, and having an open end and a removable canister cap configured to sealingly close the open end, wherein the canister is configured to sealingly engage with the port to create a sealed section around the canister cap (e.g. between the port cap and a portion of the port outward of the received canister cap).

A fifty-sixth embodiment can include the system of the fifty-fifth embodiment, further comprising a port seal, wherein the port seal is disposed on an interior of the port and configured so that, when the canister is disposed in the port, the canister cap is disposed between the port cap and the port seal and/or so that the canister cap is disposed inward of the port seal and/or the port seal is disposed outward of the canister cap.

A fifty-seventh embodiment can include the system of the fifty-fifth embodiment, wherein the canister further comprises a port seal configured to sealingly engage within the port (thereby preventing fluid flow from the surrounding sea environment through the port—e.g. through the open end of the port).

A fifty-eighth embodiment can include the system of the fifty-seventh embodiment, wherein the canister cap is distal to the port seal and/or the port seal is uncovered by the cannister cap (e.g. the port seal is exposed, even when the canister cap is applied to the open end).

A fifty-ninth embodiment can include the system of any one of the fifty-fifth to fifty-eighth embodiments, wherein the capped open end of the canister is configured for insertion into the port, thereby nesting the canister cap within the port cap.

A sixtieth embodiment can include the system of any one of the fifty-fifth to fifty-ninth embodiments, wherein inserting the capped canister open end into the port creates a sealed section between the port cap and the port seal (e.g. with the canister cap therebetween and/or disposed in the sealed section).

A sixty-first embodiment can include the system of any one of the fifty-fifth to sixtieth embodiments, further comprising a pump configured to pump fluid in and/or out of the sealed section (e.g. depressurizing the sealed section for tool removal into the sealed chamber and/or pressurizing the sealed section for removal of the canister from the port).

A sixty-second embodiment can include the system of any one of the fifty-fifth to sixty-first embodiments, wherein, to access the tools, the port cap is first removed (e.g. by a robot disposed in the chamber), and then the canister cap is removed (e.g. by the robot).

A sixty-third embodiment can include the system of any one of the fifty-fifth to sixty-second embodiments, wherein to remove/change the canister, the canister cap is attached (e.g. by the robot), and then the port cap is attached (to reestablish the sealed section) (e.g. by the robot).

A sixty-fourth embodiment can include the system of the sixty-third embodiment, wherein the pump pressurizes the sealed section (e.g. to approximately external subsea pressure) (e.g. in some embodiments, the pump over pressurizes to assist injection of the canister from the port).

A sixty-fifth embodiment can include the system of any one of the fifty-fifth to sixty-fourth embodiments, wherein the sealed chamber further comprises a canister guide mechanism (e.g. disposed on its external surface in proximity to the port) configured to guide the capped open end of the canister into the port (for example, a funnel-shaped mechanism disposed on the port).

A sixty-sixth embodiment can include the system of any one of the fifty-fifth to sixty-fifth embodiments, wherein the canister comprises a flotation device (for example, configured to provide approximately neutral buoyancy to the canister).

A sixty-seventh embodiment can include the system of any one of the fifty-fifth to sixty-sixth embodiments, wherein the canister cap is accessible within the sealed chamber after removal of the port cap (e.g. removal of the port cap exposes the cannister cap for removal, for example by the robot).

A sixty-eighth embodiment can include the system of any one of the fifty-fifth to sixty-seventh embodiments, further comprising a remote operated vehicle (ROV) configure to provide the canister to the chamber (e.g. to insert the canister into the port).

A sixty-ninth embodiment can include the system of any one of the fifty-fifth to sixty-eighth embodiments, further comprising a subsea storage warehouse configure to hold a plurality of canisters (e.g. with at least some of the plurality of canisters having different tools therein) (e.g. disposed on or in proximity to the seafloor).

A seventieth embodiment can include the system of the sixty-ninth embodiment, wherein the subsea storage warehouse comprises a seafloor mat configured for a plurality of tool canisters to be disposed thereon.

A seventy-first embodiment can include the system of any one of the fifty-fifth to seventieth embodiments, wherein the canister is configured to hold a plurality of tools (e.g. subsea well intervention tools).

A seventy-second embodiment can include the system of any one of the fifty-fifth to seventy-first embodiments, wherein the canister holds a plurality of the same tool (e.g. for redundancy).

A seventy-third embodiment can include the system of any one of the fifty-fifth to seventy-second embodiments, wherein the canister holds a plurality of different tools.

A seventy-fourth embodiment can include the system of any one of the fifty-fifth to seventy-third embodiments, wherein the canister holds a plurality of tools configured to be made up into a toolstring.

A seventy-fifth embodiment can include the system of any one of the fifty-fifth to seventy-fourth embodiments, wherein the canister has and/or is configured to retain approximately atmospheric pressure (e.g. around the tools) (e.g. even when disposed undersea).

A seventy-sixth embodiment can include the system of any one of the fifty-fifth to seventy-fifth embodiments, wherein the port comprises a tube extending into the seal chamber, and the port cap is configured to fit onto and/or close/seal the tube.

A seventy-seventh embodiment can include the system of any one of the fifty-fifth to seventy-sixth embodiments, wherein the port comprises an opening extending through the wall of the sealed chamber.

A seventy-eighth embodiment can include the system of the seventy-seventh embodiment, wherein the opening opens into the tube (e.g. they can share a common axis).

A seventy-ninth embodiment can include the system of any one of the fifty-fifth to seventy-eighth embodiments, wherein one or both of the port cap and canister cap are configured for twist attachment and/or removal (e.g. screw threading or bayonet attachment).

An eightieth embodiment can include the system of any one of the fifty-fifth to seventy-ninth embodiments, wherein the chamber has and/or is configured to retain approximately atmospheric pressure therein.

An eighty-first embodiment can include the system of any one of the fifty-fifth to eightieth embodiments, wherein the chamber is disposed in a subsea environment (for example deep water such as approximately 1000-9000 feet and/or high-pressure such as approximately 500-6000 PSI.

An eighty-second embodiment can include the system of any one of the fifty-fifth to eighty-first embodiments, wherein the subsea tool provision system comprises the chamber of any one of the first to thirty-third embodiments and/or the canister of any one of the thirty-fourth to fifty-fourth embodiments.

In an eighty-third embodiment, a tool insertion system can comprise: a wireline reeler unit having a wireline/slickline; a lubricator valve; a lubricator section which can be coupled to and/or in fluid communication with the lubricator valve (e.g. a lower lubricator conduit opposite a subsea work chamber and/or with its proximal end coupled to the subsea work chamber and its distal end coupled to the lubricator valve and/or coupled between the subsea work chamber and the lubricator valve, and/or a connector between the chamber and the lubricator valve); and a moveable wireline stuffing box; wherein: the wireline from the wireline reeler unit passes through the wireline stuffing box, with the wireline reeler unit configured to move (e.g. extend/retract) the wireline (e.g. with the wireline stuffing box always disposed between the end of the wireline and the wireline reeler unit, and the wireline reeler unit configured to control the amount of wireline extending beyond the wireline stuffing box); and the stuffing box has a retracted position and an extended position, with the retracted position providing an open area within a subsea work chamber (e.g. between the moveable stuffing box and the lubricator conduit) allowing access to the distal end of the wireline (e.g. for tool attachment and/or removal) and/or allowing fluid communication between the work chamber and the lubricator valve, and with the extended position isolating the subsea work chamber from the lubricator section and/or lubricator valve and/or distal end of the wireline.

An eighty-fourth embodiment can include the system of the eighty-third embodiment, further comprising a ram mechanism configured to move the wireline stuffing box between the retracted and extended positions.

An eighty-fifth embodiment can include the system of any one of the eighty-third to eighty-fourth embodiments, wherein the lubricator valve is configured to close/seal the lubricator conduit/section (e.g. preventing fluid flow therethrough and/or preventing fluid communication with the wellhead) (e.g. in a first/closed configuration) (and to allow fluid flow therethrough and/or communication in a second/open configuration).

An eighty-sixth embodiment can include the system of any one of the eighty-third to eighty-fifth embodiments, wherein the lubricator valve is configured be in fluid communication with a wellhead and to (e.g. removably) close/seal fluid communication between the wellhead and the lubricator conduit/section and/or subsea work chamber (e.g. to isolate the rest of the system from the wellhead).

An eighty-seventh embodiment can include the system of any one of the eighty-third to eighty-sixth embodiments, wherein the wireline stuffing box seals the passage of the wireline therethrough (e.g. providing passage and/or movement therethrough of the wireline while isolating the wireline reel unit and/or the subsea work chamber from the lubricator conduit/section and/or lubricator valve and/or well pressure).

An eighty-eighth embodiment can include the system of any one of the eighty-third to eighty-seventh embodiments, wherein the lubricator valve is coupled directly to the work chamber, and the lubricator conduit comprises the coupling (e.g. connector).

An eighty-ninth embodiment can include the system of any one of the eighty-third to eighty-eighth embodiments, wherein the lubricator system further comprises a telescoping conduit/tube, and the wireline stuffing box coupled to the telescoping conduit (e.g. the wireline stuffing box moves with the telescoping conduit).

A ninetieth embodiment can include the system of the eighty-ninth embodiment, wherein the wireline stuffing box is attached/coupled at either end of the telescoping conduit (e.g. at the distal end or the proximal end) or is disposed within the telescoping conduit (e.g. between the distal end and the proximal end).

A ninety-first embodiment can include the system of any one of the eighty-ninth to ninetieth embodiments, wherein the wireline stuffing box is sealingly coupled to the telescoping conduit.

A ninety-second embodiment can include the system of any one of the eighty-ninth to ninety-first embodiments, wherein in the extended position, the telescoping conduit extends through the subsea work chamber (e.g. spanning the work chamber) and into the lubricator conduit; and in the retracted position, the telescoping conduit retracts out of both the lubricator conduit and the subsea work chamber (e.g. so no portion of the telescoping conduit extends into the lubricator conduit (e.g. telescoping conduit is entirely withdrawn from the lubricator conduit), and the telescoping conduit does not span the subsea work chamber—for example, none or only a portion of the telescoping conduit extends into the work chamber, leaving the open area within the subsea work chamber—for example providing access to the wireline connector and/or distal end of the wireline and/or allowing fluid communication between the work chamber and the lubricator valve).

A ninety-third embodiment can include the system of any one of the eighty-ninth to ninety-second embodiments, wherein in the extended position, the telescoping conduit sealingly connects to the lubricator conduit (e.g. by having its distal end disposed in the proximal end of the lubricator conduit, with a seal disposed therebetween) and/or provides isolated passage through the work chamber (e.g. between the lubricator conduit and the moveable stuffing box) (e.g. isolates the wireline and/or lubricator conduit/section and/or lubricator valve from the work chamber).

A ninety-fourth embodiment can include the system of any one of the eighty-ninth to ninety-third embodiments, wherein the telescoping conduit has an axial length sufficient to span the subsea work chamber.

A ninety-fifth embodiment can include the system of any one of the eighty-ninth to ninety-fourth embodiments, wherein the axial length of the telescoping conduit is greater than the span/height of the subsea work chamber, and the difference between the axial length of the telescoping conduit and the span/height of the work chamber is greater than a length of a tool (e.g. for attachment to the wireline, for example a well intervention tool) (e.g. so that when retracted, there is a gap in the work chamber greater than the length of the tool, allowing access thereto).

A ninety-sixth embodiment can include the system of any one of the eighty-ninth to ninety-fifth embodiments, wherein a ram mechanism (e.g. piston) is configured to axially displace the telescoping conduit between the retracted position and the extended position (e.g. ram/piston may be hydraulic in some embodiments).

A ninety-seventh embodiment can include the system of any one of the eighty-ninth to ninety-sixth embodiments, further comprising a wireline guide conduit, which can be disposed concentrically around the telescoping conduit (e.g. the telescoping conduit is at least partially disposed within the guide conduit) and which can guide axial movement of the telescoping conduit between the retracted and extended positions (e.g. configured to allow axial movement of the telescoping conduit therein).

A ninety-eighth embodiment can include the system of any one of the eighty-ninth to ninety-seventh embodiments, wherein the proximal end of the telescoping conduit never extends out of the wireline guide conduit (e.g. in some embodiments, the wireline stuffing box never leaves the guide conduit) (e.g. in the extended position, a portion of the telescoping conduit remains within the guide conduit and/or a first (e.g. distal) portion of the telescoping conduit extends into the lubricator conduit, a second (e.g. central) portion of the telescoping conduit spans the subsea work chamber, and a third (e.g. proximal) portion of the telescoping conduit remains disposed within the wireline guide conduit).

A ninety-ninth embodiment can include the system of any one of the ninety-seventh to ninety-eighth embodiments, wherein the wireline reeler unit is disposed/coupled at the proximal end of the wireline guide conduit (e.g. opposite the subsea work chamber) and/or wherein the distal end of the wireline guide conduit is coupled to the subsea work chamber.

A one hundredth embodiment can include the system of any one of the eighty-third to ninety-ninth embodiments, wherein, when the lubricator valve is open and the wireline stuffing box and/or the telescoping conduit is in the extended position, wellbore pressure can extend through the lubricator conduit/section to the wireline stuffing box (e.g. but is isolated from the subsea work chamber).

A one hundred first embodiment can include the system of any one of the eighty-third to one hundredth embodiments, wherein in the extended position, a seal is disposed between the telescoping conduit and the lubricator conduit (e.g. seal disposed in proximity to the distal end of the telescoping conduit) and is configured to seal the coupling therebetween and/or a seal is disposed between the wireline stuffing box and the lubricator conduit (e.g. seal configured to seal the coupling therebetween).

A one hundred second embodiment can include the system of any one of the eighty-third to one hundred first embodiments, wherein the lubricator valve is configured to only be opened when the telescoping conduit and/or wireline stuffing box is in the extended position.

A one hundred third embodiment can include the system of any one of the eighty-third to one hundred second embodiments, wherein the wireline stuffing box is only in fluid communication with wellbore pressure/fluid in the extended position.

A one hundred fourth embodiment can include the system of any one of the eighty-third to one hundred third embodiments, further comprising a pump (e.g. a high pressure pump) configured to pressurize and/or depressurize the lubricator conduit (e.g. between the lubricator valve and the wireline stuffing box in its extended position) (for example, equalizing pressure either with the well or with the subsea work chamber).

A one hundred fifth embodiment can include the system of any one of the eighty-ninth to one hundred fourth embodiments, further comprising a pump (e.g. a second pump) configured to pressurize and/or depressurize the area in the guide conduit and/or the telescoping conduit between the wireline stuffing box and the wireline reeler unit (e.g. to equalize or minimize pressure differential across the wireline stuffing box, for example pressurizing when the wireline stuffing box is exposed to wellbore pressure, and depressurizing when the stuffing box is exposed to work chamber pressure (e.g. atmospheric pressure)).

A one hundred sixth embodiment can include the system of any one of the eighty-third to one hundred fifth embodiments, further comprising a wireline tool connector disposed at a distal end of the wireline (e.g. coupled to the wireline, for example with the wireline stuffing box disposed between the wireline reeler unit and the connector).

A one hundred seventh embodiment can include the system of any one of the eighty-third to one hundred sixth embodiments, wherein the tool insertion system is disposed subsea (e.g. in proximity to the seabed, such as approximately 5-30 feet, 7-30 feet, 10-30 feet, 15-30 feet, 7-15 feet, 7-20 feet, or 15-20 feet above the seabed and/or approximately 5-20 feet, 5-15 feet, 15-20 feet, 5-10 feet, 7-10 feet, or 5-7 feet above the wellhead and/or production tree) and/or is exposed to subsea conditions (e.g. approximately 1000-9000 ft of depth and/or approximately 500-6000 PSI).

A one hundred eighth embodiment can include the system of any one of the eighty-third to one hundred seventh embodiments, further comprising the subsea work chamber.

A one hundred ninth embodiment can include the system of any one of the eighty-third to one hundred eighth embodiments, wherein the subsea work chamber, lubricator valve, lubricator conduit, wireline guide conduit, and/or wireline reeler unit comprises a floatation device (e.g. is configured for floatation, for example approximately neutral buoyancy).

A one hundred tenth embodiment can include the system of any one of the eighty-third to one hundred ninth embodiments, wherein a safety valve is disposed between the lubricator valve and the wellhead.

A one hundred eleventh embodiment can include the system of any one of the eighty-third to one hundred tenth embodiments, wherein the tool insertion system comprises the subsea work chamber of any one of the first to thirty-third embodiments.

In a one hundred twelfth embodiment, a tool insertion system can comprise: a wireline reeler unit having a wireline/slickline; a lubricator valve; a lubricator section having a telescoping conduit/tube with a retracted position and an extended position; and a wireline stuffing box; wherein:

the wireline from the wireline reeler unit passes through the wireline stuffing box, with the wireline reeler unit configured to move (e.g. extend/retract) the wireline (e.g. with the wireline stuffing box always disposed between the end of the wireline and the wireline reeler unit, and the wireline reeler unit configured to control the amount of wireline extending beyond the wireline stuffing box); and the retracted position provides an open area within a subsea work chamber (e.g. between the telescoping conduit and a (e.g. lower) lubricator conduit and/or connector) allowing access to the distal end of the wireline (e.g. for tool attachment and/or removal) and/or allows fluid communication between the work chamber and the lubricator valve, and with the extended position isolating the subsea work chamber from the lubricator valve and/or distal end of the wireline.

A one hundred thirteenth embodiment can include the system of the one hundred twelfth embodiment, wherein the lubricator valve is disposed opposite the wireline stuffing box and/or wireline reeler unit (e.g. with the subsea work chamber disposed therebetween).

A one hundred fourteenth embodiment can include the system of any one of the one hundred twelfth to one hundred thirteenth embodiments, further comprising a ram mechanism configured to move the telescoping conduit between the retracted and extended positions.

A one hundred fifteenth embodiment can include the system of any one of the one hundred twelfth to one hundred fourteenth embodiments, wherein the wireline stuffing box is in fluid communication with the lubricator section.

A one hundred sixteenth embodiment can include the system of any one of the one hundred twelfth to one hundred fifteenth embodiments, wherein the wireline stuffing box is disposed between the wireline reeler unit and the telescoping conduit.

A one hundred seventeenth embodiment can include the system of any one of the one hundred twelfth to one hundred sixteenth embodiments, wherein the wireline stuffing box is disposed between the lubricator valve and the wireline reeler unit.

A one hundred eighteenth embodiment can include the system of any one of the one hundred twelfth to one hundred seventeenth embodiments, wherein the wireline stuffing box is configured to isolate the wireline reeler unit from the lubricator valve (e.g. when the telescoping conduit is in its extended position) and/or from lubricator section (e.g. to prevent fluid flow therepast to the wireline reeler unit and/or to prevent the wireline reeler unit from being in fluid communication with the wellhead (e.g. when the telescoping conduit is extended and the lubricator valve is open).

A one hundred nineteenth embodiment can include the system of any one of the one hundred twelfth to one hundred eighteenth embodiments, wherein the lubricator valve is configured to be in fluid communication with a wellhead (e.g. coupled to the wellhead, for example via a safety valve and/or production tree).

A one hundred twentieth embodiment can include the system of the one hundred nineteenth embodiment, wherein the lubricator valve is configured to isolate the subsea work chamber from the wellhead—for example close/seal the lubricator conduit (e.g. preventing fluid flow therethrough, for example in a first/closed configuration, and to allow fluid flow therethrough in a second/open configuration).

A one hundred twenty-first embodiment can include the system of any one of the one hundred twelfth to one hundred twentieth embodiments, wherein the wireline stuffing box seals the passage of the wireline therethrough (e.g. providing passage of the wireline while isolating the wireline reeler unit from the lubricator valve—e.g. when the telescoping conduit is in the extended position).

A one hundred twenty-second embodiment can include the system of any one of the one hundred twelfth to one hundred twenty-first embodiments, wherein the wireline stuffing box is configured to prevent passage of wellhead pressure to the wireline reeler unit (e.g. when the telescoping conduit is in the extended position and/or the lubricator valve is open).

A one hundred twenty-third embodiment can include the system of any one of the one hundred twelfth to one hundred twenty-second embodiments, wherein the wireline stuffing box is fixed with respect to the wireline reeler unit and/or a guide conduit (e.g. in which the telescoping conduit is configured to move axially) (e.g. when the telescoping conduit shifts between retracted and extended positions, the telescoping conduit also shifts axially with respect to the wireline stuffing box).

A one hundred twenty-fourth embodiment can include the system of any one of the one hundred twelfth to one hundred twenty-third embodiment, wherein there is a seal between the wireline reeler unit and the wireline stuffing box and/or between the stuffing box and the guide conduit (e.g. an inner seal around the wireline extending through the stuffing box, and an external seal configured to prevent fluid flow past the stuffing box to the wireline reeler unit).

A one hundred twenty-fifth embodiment can include the system of any one of the one hundred twelfth to one hundred twenty-second embodiments, wherein the wireline stuffing box is coupled to the telescoping conduit (e.g. the wireline stuffing box moves with the telescoping conduit).

A one hundred twenty-sixth embodiment can include the system of the one hundred twenty-fifth embodiment, wherein the wireline stuffing box is attached/coupled at either end of the telescoping conduit or is disposed within the telescoping conduit.

A one hundred twenty-seventh embodiment can include the system of the one hundred twenty-sixth embodiment, wherein the wireline stuffing box is sealingly coupled to the telescoping conduit.

A one hundred twenty-eighth embodiment can include the system of any one of the one hundred twelfth to one hundred twenty-seventh embodiments, wherein in the extended position, the telescoping conduit extends through the subsea work chamber (e.g. spanning the work chamber), for example into a lower lubricator conduit, a connector at the bottom of the subsea work chamber, and/or the lubricator valve.

A one hundred twenty-ninth embodiment can include the system of any one of the one hundred twelfth to one hundred twenty-eighth embodiments, wherein in the retracted position, the telescoping conduit retracts out of the lower lubricator conduit and/or the subsea work chamber (e.g. so no portion of the telescoping conduit extends into the lubricator conduit (e.g. the telescoping conduit is entirely withdrawn from the lower lubricator conduit), and/or the telescoping conduit does not span the subsea work chamber—for example none or only a portion of the telescoping conduit extends into the work chamber, leaving the open area within the subsea work chamber—for example providing access to the wireline connector and/or distal end of the wireline and/or allowing fluid communication between the work chamber and the lubricator valve).

A one hundred thirtieth embodiment can include the system of any one of the one hundred twelfth to one hundred twenty-ninth embodiments, wherein in the extended position, the telescoping conduit sealingly connects to the lower lubricator conduit (e.g. by having its distal end disposed in the proximal end of the lubricator conduit, with a seal disposed therebetween) and/or provides isolated passage through the work chamber (e.g. between the lower lubricator conduit and/or lubricator valve and the moveable stuffing box) (e.g. isolates the lubricator valve and/or distal end of the wireline from the work chamber).

A one hundred thirty-first embodiment can include the system of any one of the one hundred twelfth to one hundred thirtieth embodiments, wherein the (e.g. lower) lubricator conduit comprises the connector (e.g. coupling the lubricator valve to the work chamber).

A one hundred thirty-second embodiment can include the system of any one of the one hundred twelfth to one hundred thirty-first embodiments, further comprising a wireline guide conduit (e.g. the lubricator section can further include the guideline conduit) disposed around the telescoping conduit (e.g. the telescoping conduit at least partially disposed within the guide conduit for example with the guide conduit concentrically disposed around the telescoping conduit) and configured to guide axial movement of the telescoping conduit between the retracted and extended positions (e.g. configured to allow axial movement of the telescoping conduit therein).

A one hundred thirty-third embodiment can include the system of the one hundred thirty-second embodiment, wherein the proximal end of the telescoping conduit never (e.g. when moving between retracted and extended positions) extends out of the wireline guide conduit (e.g. in the extended position, a portion of the telescoping conduit remains within the guide conduit and/or a first (e.g. distal) portion of the telescoping conduit extends into the lubricator conduit, a second (e.g. central) portion of the telescoping conduit spans the subsea work chamber, and a third (e.g. proximal) portion of the telescoping conduit remains disposed within the wireline guide conduit).

A one hundred thirty-fourth embodiment can include the system of any one of the one hundred thirty-second to one hundred thirty-third embodiments, wherein the wireline reeler unit is disposed/coupled at the proximal end of the wireline guide conduit (e.g. opposite the subsea work chamber) and/or wherein the distal end of the wireline guide conduit is coupled to the subsea work chamber (e.g. with the wireline guide conduit disposed between the wireline reeler unit and the subsea work chamber).

A one hundred thirty-fifth embodiment can include the system of any one of the one hundred twelfth to one hundred thirty-fourth embodiments, wherein when the lubricator valve is open and the telescoping conduit is in the extended position, wellbore pressure can extend through the lubricator conduit to the wireline stuffing box (e.g. but is isolated from the subsea work chamber and the wireline reeler unit).

A one hundred thirty-sixth embodiment can include the system of any one of the one hundred twelfth to one hundred thirty-fifth embodiments, wherein in the extended position, a seal is disposed between the telescoping conduit and the (e.g. lower) lubricator conduit (e.g. with the seal disposed in proximity to the distal end of the telescoping conduit) and is configured to seal the coupling therebetween.

A one hundred thirty-seventh embodiment can include the system of any one of the one hundred twelfth to one hundred thirty-sixth embodiments, wherein the lubricator valve is configured to only be opened when the telescoping conduit is in the extended position.

A one hundred thirty-eighth embodiment can include the system of any one of the one hundred twelfth to one hundred thirty-seventh embodiments, wherein the wireline stuffing box is only in fluid communication with the wellbore pressure/fluid in the extended position.

A one hundred thirty-ninth embodiment can include the system of any one of the one hundred twelfth to one hundred thirty-eighth embodiments, further comprising a pump (e.g. a high pressure pump) configured to pressurize and/or depressurize the lubricator section and/or lubricator conduit (e.g. between the lubricator valve and the wireline stuffing box when the telescoping conduit is in its extended position) (for example, equalizing pressure either with the well (e.g. when preparing to insert a tool into the well) or with the subsea work chamber (e.g. when preparing to withdraw the tool into the subsea work chamber)).

In a one hundred fortieth embodiment, a tool insertion system can comprise: a wireline reeler unit having a wireline/slickline; a lubricator valve; a lubricator section; and a wireline stuffing box; wherein: the wireline from the wireline reeler unit passes through the wireline stuffing box, with the wireline reeler unit configured to move (e.g. extend/retract) the wireline (e.g. with the wireline stuffing box always disposed between the end of the wireline and the wireline reeler unit, and the wireline reeler unit configured to control the amount of wireline extending beyond the wireline stuffing box); the tool insertion system comprises a retracted position and an extended position; the retracted position provides/allows fluid communication between the tool insertion system (e.g. a lubricator valve) and a subsea work chamber (e.g. to which the tool insertion system is coupled) and/or allows access to the distal end of the wireline; and the extended position isolates the tool insertion system (e.g. the lubricator valve) and/or the distal end of the wireline from the subsea work chamber.

A one hundred forty-first embodiment can include the system of the one hundred fortieth embodiment, wherein the lubricator section comprises a telescoping conduit/tube with a retracted position and an extended position (e.g. corresponding to the retracted and extended positions of the tool insertion system).

A one hundred forty-second embodiment can include the system of the one hundred forty-first embodiment, wherein the retracted position of the telescoping conduit provides an open area within a subsea work chamber (e.g. between the telescoping conduit and a lower lubricator conduit and/or connector) allowing access to the distal end of the wireline (e.g. for tool attachment and/or removal) and/or allows fluid communication between the lubricator valve and the work chamber, and wherein the extended position of the telescoping conduit isolates the subsea work chamber from the lubricator valve and/or the distal end of the wireline (e.g. with the telescoping conduit extending through/spanning the subsea work chamber and preventing fluid flow between the work chamber and the telescoping conduit and/or lubricator valve).

A one hundred forty-third embodiment can include the system of any one of the one hundred forty-first to one hundred forty-second embodiments, wherein the wireline stuffing box is coupled to the telescoping conduit (e.g. the wireline stuffing box moves with the telescoping conduit).

A one hundred forty-fourth embodiment can include the system of any one of the one hundred fortieth to one hundred forty-third embodiments, wherein the wireline stuffing box is fixed with respect to the wireline reeler unit and/or subsea work chamber (e.g. does not move with the telescoping conduit).

A one hundred forty-fifth embodiment can include the system of the one hundred fortieth embodiment, wherein the wireline stuffing box has a retracted position and an extended position (e.g. corresponding to the retracted and extended positions of the tool insertion system), wherein the retracted position provides an open area within a subsea work chamber (e.g. between the moveable stuffing box and the lubricator conduit) allowing access to the wireline (e.g. for tool attachment and/or removal), and with the extended position isolating the subsea work chamber from the lubricator conduit/section and/or the lubricator valve and/or wireline (e.g. with the wireline stuffing box sealing the work chamber from the lubricator valve).

A one hundred forty-sixth embodiment can include the system of the one hundred forty-fifth embodiment, wherein the system (e.g. the lubricator section) does not include a telescoping conduit.

A one hundred forty-seventh embodiment can include the system of any one of the one hundred forty-fifth to one hundred forty-sixth embodiments, further comprising a ram mechanism configured to move the system and/or the wireline stuffing box between the retracted and extended positions.

A one hundred forty-eighth embodiment can include the system of the one hundred forty-seventh embodiment, wherein the ram mechanism directly moves the wireline stuffing box (for example with the ram directly contacting and/or coupled to the stuffing box).

In a one hundred forty-ninth embodiment, a subsea well intervention system for providing well intervention for a subsea wellhead can comprise: a tool insertion system; and a subsea work chamber; wherein the tool insertion system is operatively coupled to the subsea work chamber and to the wellhead.

A one hundred fiftieth embodiment can include the system of the one hundred forty-ninth embodiment, further comprising a subsea wellhead (e.g. with safety valve and/or production tree).

A one hundred fifty-first embodiment can include the system of the one hundred fiftieth embodiment, wherein the safety valve does not include an emergency detaching system (e.g. configured for emergency decoupling) (e.g. not required since no human operator).

A one hundred fifty-second embodiment can include the system of any one of the one hundred forty-ninth to one hundred fifty-first embodiments, further comprising production tubing from the wellhead (e.g. to the surface).

A one hundred fifty-third embodiment can include the system of any one of the one hundred forty-ninth to one hundred fifty-second embodiments, wherein the tool insertion system comprises any one of the eighty-third to one hundred forty-eighth embodiments.

A one hundred fifty-fourth embodiment can include the system of any one of the one hundred forty-ninth to one hundred fifty-third embodiments, wherein the subsea work chamber comprises any one of the first to thirty-third embodiments.

A one hundred fifty-fifth embodiment can include the system of any one of the one hundred forty-ninth to one hundred fifty-fourth embodiments, further comprising one or more tool canister.

A one hundred fifty-sixth embodiment can include the system of the one hundred fifty-fifth embodiment, wherein the tool canister comprises any one of the thirty-fourth to fifty-fourth embodiments.

A one hundred fifty-seventh embodiment can include the system of any one of the one hundred forty-ninth to one hundred fifty-sixth embodiments, further comprising a mechanism configured to provide/deliver the tool canister to the subsea work chamber (e.g. to insert the canister into the port).

A one hundred fifty-eighth embodiment can include the system of the one hundred fifty-seventh embodiment, wherein the mechanism comprises an ROV (potentially a plurality of ROVs).

A one hundred fifty-ninth embodiment can include the system of the one hundred fifty-seventh embodiment, wherein the mechanism comprises an external wireline system coupled to the surface (e.g. of the sea—for example to a ship or platform, but typically not a drill ship).

A one hundred sixtieth embodiment can include the system of any one of the one hundred forty-ninth to one hundred fifty-ninth embodiments, further comprising one or more connector configured to removably couple/link elements of the subsea well intervention system together (e.g. to couple the lubricator valve to the safety valve, the lubricator conduit to the lubricator valve, the lubricator conduit to the subsea work chamber, the lubricator valve to the subsea work chamber, the guide conduit to the subsea work chamber, and/or the wireline reeler unit to the guide conduit and/or lubricator section).

A one hundred sixty-first embodiment can include the system of any one of the one hundred forty-ninth to one hundred sixtieth embodiments, further comprising subsea (e.g. seabed) storage warehousing (e.g. configured to hold a plurality of tool canisters and/or one or more ROV subsea (e.g. in proximity to the wellhead or to a plurality of wellheads)).

A one hundred sixty-second embodiment can include the system of the one hundred sixty-first embodiment, wherein the subsea storage warehousing comprises one or more mat disposed on the seabed.

A one hundred sixty-third embodiment can include the system of any one of the one hundred forty-ninth to one hundred sixty-second embodiments, further comprising a ship or platform at the surface (e.g. of the sea), wherein the external wireline system is coupled to the ship or platform.

A one hundred sixty-fourth embodiment can include the system of the one hundred sixty-third embodiment, wherein the ship is not a drill ship.

A one hundred sixty-fifth embodiment can include the system of any one of the one hundred sixty-third to one hundred sixty-fourth embodiments, wherein the ship or platform comprises/houses a plurality of tool canisters for use with the subsea work chamber.

A one hundred sixty-sixth embodiment can include the system of any one of the one hundred sixty-third to one hundred sixty-fifth embodiments, wherein the ship or platform is configured to removably couple the tool canister to the external wireline system.

A one hundred sixty-seventh embodiment can include the system of any one of the one hundred forty-ninth to one hundred sixty-sixth embodiments, wherein communication with the subsea chamber (e.g. the wireline, the tool, and/or the robotic assembly mechanism) is through a pre-existing umbilical of the wellhead (and in some embodiments, this may be the only communication with the surface).

A one hundred sixty-eighth embodiment can include the system of any one of the one hundred forty-ninth to one hundred sixty-seventh embodiments, wherein the subsea chamber is not coupled physically to the surface (e.g. either disposed on the seabed or anchored undersea (e.g. in proximity to the wellhead) to the wellhead) (e.g. no riser to the surface).

A one hundred sixty-ninth embodiment can include the system of any one of the one hundred forty-ninth to one hundred sixty-eighth embodiments, wherein the subsea chamber and/or tool insertion system is operated exclusively subsea (e.g. disposed undersea, for example in proximity to the seabed floor—for example approximately 5-30 feet, 7-30 feet, 10-30 feet, 15-30 feet, 7-15 feet, 7-20 feet, or 15-20 feet above the seabed and/or approximately 5-20 feet, 5-15 feet, 15-20 feet, 5-10 feet, 7-10 feet, or 5-7 feet above the wellhead and/or production tree).

In a one hundred seventieth embodiment, a method of assembling a subsea well intervention system can comprise: coupling a lubricator system to a safety valve of a wellhead (e.g. placing a lubricator valve of the lubricator system into fluid communication with the wellhead); coupling a subsea work chamber to the lubricator system (e.g. to a lubricator conduit, a connector, and/or the lubricator valve); and configuring a wireline reeler unit to provide wireline/slickline for extension into the lubricator section.

A one hundred seventy-first embodiment can include the method of the one hundred seventieth embodiment, wherein the subsea work chamber is disposed under the surface of the sea (e.g. in proximity to the seabed).

A one hundred seventy-second embodiment can include the method of any one of the one hundred seventieth to one hundred seventy-first embodiments, wherein the subsea work chamber includes a flotation device, and the chamber is anchored to the well head (for example, via the lubricator section).

A one hundred seventy-third embodiment can include the method of the one hundred seventy-second embodiment, wherein the flotation device provides approximately neutral buoyancy.

A one hundred seventy-fourth embodiment can include the system of any one of the one hundred seventy-second to one hundred seventy-third embodiments, further comprising inflating the flotation device (e.g. once the subsea work chamber has been disposed undersea and/or has been anchored to the wellhead).

A one hundred seventy-fifth embodiment can include the method of any one of the one hundred seventieth to one hundred seventy-fourth embodiments, further comprising minimizing the weight on the wellhead and/or safety valve (e.g. using the flotation device and/or to provide a lightweight or ultra-lightweight system atop the wellhead).

A one hundred seventy-sixth embodiment can include the method of any one of the one hundred seventieth to one hundred seventy-fifth embodiments, wherein the subsea work chamber comprises one or more tool canister port (e.g. each configured to (e.g. sealingly) receive a tool canister).

A one hundred seventy-seventh embodiment can include the method of any one of the one hundred seventieth to one hundred seventy-sixth embodiments, wherein the subsea work chamber comprises a robotic assembly mechanism.

A one hundred seventy-eighth embodiment can include the method of the one hundred seventy-seventh embodiment, wherein the robotic assembly mechanism comprises only conventional robotic elements (for example, configured for use under approximately atmospheric conditions and/or not configured for use under high-pressure subsea conditions).

A one hundred seventy-ninth embodiment can include the method of any one of the one hundred seventieth to one hundred seventy-eighth embodiments, wherein the subsea work chamber maintains approximately atmospheric pressure (e.g. despite being disposed undersea) (e.g. providing approximately atmospheric pressure in the work chamber).

A one hundred eightieth embodiment can include the method of any one of the one hundred seventieth to one hundred seventy-ninth embodiments, wherein the work chamber comprises a sump system, and the method further comprises disposing an annular sump conduit around a lubricator conduit of the lubricator system.

A one hundred eighty-first embodiment can include the method of any one of the one hundred seventieth to one hundred eightieth embodiments, wherein: the lubricator system comprises a lubricator valve and a movable wireline stuffing box, the wireline from the wireline reeler unit passes through the wireline stuffing box, the stuffing box has a retracted position and an extended position, with the retracted position providing an open area within the subsea work chamber allowing access to the distal end of the wireline and/or allowing fluid communication between the lubricator valve and the work chamber, and with the extended position isolating the subsea work chamber from the lubricator system (e.g. the lubricator valve) and/or the distal end of the wireline.

A one hundred eighty-second embodiment can include the method of the one hundred eighty-first embodiment, wherein the wireline stuffing box seals the passage of the wireline therethrough (e.g. providing passage of the wireline while isolating the wireline reel unit from the lubricator section).

A one hundred eighty-third embodiment can include the method of any one of the one hundred eighty-first to one hundred eighty-second embodiments, wherein the lubricator system further comprises a telescoping conduit/tube, and the wireline stuffing box is coupled to the telescoping conduit/tube.

A one hundred eighty-fourth embodiment can include the method of the one hundred eighty-third embodiment, wherein a ram mechanism is configured to axially displace the telescoping conduit/tube between the retracted position and the extended position.

A one hundred eighty-fifth embodiment can include the method of any one of the one hundred seventieth to one hundred eighty-fourth embodiments, further comprising, while in the retracted position, coupling a tool to the wireline (e.g. by robotic assembly mechanism).

A one hundred eighty-sixth embodiment can include the method of the one hundred eighty-fifth embodiment, wherein the tool comprises a wellcap removal tool and/or is configured to assist with wellcap removal.

A one hundred eighty-seventh embodiment can include the method of any one of the one hundred eighty-fifth to one hundred eighty-sixth embodiments, further comprising, selecting, by the robotic assembly mechanism, the tool from a plurality of tools disposed in a tool canister coupled to the port.

A one hundred eighty-eighth embodiment can include the method of any one of the one hundred eighty-fifth to one hundred eighty-seventh embodiments, further comprising using the tool on the wireline to remove a wellcap/plug from the wellhead, retracting the wellcap into the subsea work chamber via the wireline, and/or storing the wellcap in the subsea work chamber (e.g. during well intervention).

A one hundred eighty-ninth embodiment can include the method of the one hundred eighty-eighth embodiment, further comprising using the tool to reattach the well cap to the wellhead.

A one hundred ninetieth embodiment can include the system of any one of the one hundred eighty-fifth to one hundred eighty-ninth embodiments, further comprising re-attaching the tool to the wireline, by robotic assembly mechanism (e.g. after well intervention).

A one hundred ninety-first embodiment can include the method of any one of the one hundred seventieth to one hundred ninetieth embodiments, further comprising, providing a remote operated vehicle (ROV) configured to transport one or more tool canister.

A one hundred ninety-second embodiment can include the method of any one of the one hundred seventieth to one hundred ninety-first embodiments, further comprising providing a seabed warehouse having a plurality of tool canisters.

A one hundred ninety-third embodiment can include the method of any one of the one hundred seventieth to one hundred ninety-second embodiments, further comprising pumping fluid out of the chamber and/or lubricator section to provide approximately atmospheric pressure therein.

A one hundred ninety-fourth embodiment can include the method of any one of the one hundred seventieth to one hundred ninety-second embodiments, further comprising pumping fluid (e.g. oil, such as silicon oil) into the subsea work chamber to approximately equalize pressure with the exterior sea environment.

A one hundred ninety-fifth embodiment can include the method of any one of the one hundred seventieth to one hundred ninety-fourth embodiments, wherein the subsea work chamber is disposed in a subsea environment.

A one hundred ninety-sixth embodiment can include the method of any one of the one hundred seventieth to one hundred ninety-fifth embodiments, wherein the work chamber comprises an external wireline reel unit configured to provide one or more tool canisters from the surface.

A one hundred ninety-seventh embodiment can include the method of any one of the one hundred seventieth to one hundred ninety-sixth embodiments, further comprising determining that repair is needed, unlatching the entire subsea well intervention system, raising the entire subsea well intervention system to the surface, and implementing repairs thereof.

A one hundred ninety-eighth embodiment can include the method of any one of the one hundred seventieth to one hundred ninety-sixth embodiments, further comprising determining that repairs are needed (e.g. one or more element of the system is defective), decoupling one or more connector between elements of the subsea well intervention system, and raising the defective element to the surface for repair.

A one hundred ninety-ninth embodiment can include the method of any one of the one hundred seventieth to one hundred ninety-eighth embodiments, wherein coupling a subsea work chamber to the lubricator system occurs subsea (e.g. after lowering the work chamber undersea into proximity to the wellhead and/or lubricator system); and configuring a wireline reeler unit to provide wireline/slickline for extension into the lubricator section occurs subsea (e.g. after lowering the wireline reeler unit undersea into proximity with the lubricator section and/or subsea chamber).

A two hundredth embodiment can include the method of any one of the one hundred seventieth to one hundred ninety-ninth embodiments, wherein coupling a lubricator system to a safety valve of a wellhead occurs subsea (e.g. after lowering the lubricator system, for example the lubricator valve and/or lubricator conduit, undersea).

A two hundred first embodiment can include the method of any one of the one hundred seventieth to two hundredth embodiments, wherein coupling a lubricator system to a safety valve of a wellhead comprises coupling a lubricator valve to the wellhead (e.g. through a safety valve, for example coupling the lubricator valve to the safety vale with the safety valve disposed between the lubricator valve and the wellhead), and coupling a lubricator conduit (e.g. which may comprise a connector for coupling to the subsea work chamber) to the lubricator valve (e.g. one or both of which may occur undersea).

A two hundred second embodiment can include the method of any one of the one hundred seventieth to two hundred first embodiments, wherein coupling a subsea work chamber to the lubricator system comprises coupling the work chamber to a lubricator conduit and/or lubricator valve.

A two hundred third embodiment can include the method of any one of the one hundred seventieth to one hundred ninety-eighth embodiments, comprising preassembling the subsea well intervention system at the surface (e.g. on a ship or platform); lowering the preassembled subsea well intervention system in its entirety (e.g. undersea, for example into proximity with the wellhead), and coupling the lubricator system (e.g. lubricator valve) to the safety valve of the wellhead.

A two hundred fourth embodiment can include the method of the two hundred third embodiment, wherein preassembling the subsea well intervention system comprises (e.g. at the surface) coupling a subsea work chamber to the lubricator system (e.g. to a lubricator conduit, a connector, and/or the lubricator valve); and configuring a wireline reeler unit to provide wireline/slickline for extension into the lubricator section (e.g. coupling the wireline reeler unit to the subsea work chamber, for example at the surface).

A two hundred fifth embodiment can include the method of any one of the one hundred seventieth to two hundred fourth embodiments, wherein the undersea coupling is performed by an ROV (e.g. in proximity to the seafloor).

A two hundred sixth embodiment can include the method of any one of the one hundred seventieth to two hundred fifth embodiments, using the canister of any one of the thirty-fourth to fifty fourth embodiments, the subsea work chamber of any one of the first to thirty-third embodiments, the tool insertion system (e.g. see with respect to the lubricator system) of any one of the eighty-third to one hundred forty-eighth embodiments, and/or the subsea tool provision system of any one of the fifty-fifth to eighty-second embodiments (e.g, wherein the subsea well intervention system comprises the canister of any one of the thirty-fourth to fifty fourth embodiments, the subsea work chamber of any one of the first to thirty-third embodiments, the tool insertion system (e.g. lubricator system) of any one of the eighty-third to one hundred forty-eighth embodiments, the subsea tool provision system of any one of the fifty-fifth to eighty-second embodiments, and/or the subsea well intervention system of any one of the one hundred forty-ninth to one hundred sixty-ninth embodiments).

In a two hundred seventh embodiment, a method of providing tools for a subsea wellhead, can comprise: inserting/docking a tool canister into a port of a subsea work chamber, wherein the subsea work chamber comprises a port cap sealing an interior of the port, and wherein insertion of the canister into the port creates a seal therebetween (e.g. an external seal, distal/outward of the port cap, with the canister cap disposed therebetween); depressurizing the port (e.g. pumping fluid, such as sea water, out of a sealed space between the exterior seal and the port cap); removing (e.g. via robotic assembly mechanism) the port cap (e.g. thereby unsealing the port on its interior and/or providing access to the canister cap from the interior work space of the work chamber); removing (e.g. via robotic assembly mechanism) the canister cap (e.g. to expose the tools therein to the interior space of the subsea work chamber and/or provide access to the tools by the robotic assembly mechanism); and removing (e.g. via robotic assembly mechanism) a tool from the canister (e.g. within the work chamber).

A two hundred eighth embodiment can include the method of the two hundred seventh embodiment, wherein the canister cap is disposed (when docked in the port) between the port cap and the external seal (e.g. a port seal).

A two hundred ninth embodiment can include the method of any one of the two hundred seventh to two hundred eighth embodiments, wherein inserting the tool canister comprises providing the tool canister via an ROV and/or using the ROV to dock the canister into the port.

A two hundred tenth embodiment can include the method of any one of the two hundred seventh to two hundred ninth embodiments, further comprising selecting, by the ROV, the tool canister from a plurality of tool canisters (e.g. from subsea warehousing).

A two hundred eleventh embodiment can include the method of any one of the two hundred seventh to two hundred eighth embodiments, wherein inserting the tool canister comprises providing the tool canister using an eternal wireline system.

A two hundred twelfth embodiment can include the method of the two hundred eleventh embodiment, wherein the tool canister is lowered (e.g. via the external wireline system) from a surface of the sea (e.g. from a ship or platform, but not a drill ship).

A two hundred thirteenth embodiment can include the method of any one of the two hundred seventh to two hundred twelfth embodiments, further comprising storing (e.g. after removal by the robotic assembly mechanism) the port cap in the work chamber (e.g. in a storage area).

A two hundred fourteenth embodiment can include the method of any one of the two hundred seventh to two hundred thirteenth embodiments, wherein removing the port cap comprises using, via robotic assembly mechanism, a port cap removal tool.

A two hundred fifteenth embodiment can include the method of any one of the two hundred seventh to two hundred fourteenth embodiments, wherein removing the canister cap comprises using, via robotic assembly mechanism, a canister cap removal tool (e.g. in some embodiments, the same tool may be used for both port cap and canister cap removal, for example the port cap removal tool and the canister cap removal tool can be the same tool).

A two hundred sixteenth embodiment can include the method of any one of the two hundred seventh to two hundred fifteenth embodiments, wherein removing the tool from the canister comprises indexing the canister and unsecuring/unlatching the tool.

A two hundred seventeenth embodiment can include the method of the two hundred sixteenth embodiment, wherein indexing comprises using, via robotic assembly mechanism, an indexing tool to select the specific tool from a plurality of tools in the canister.

A two hundred eighteenth embodiment can include the method of any one of the two hundred sixteenth to two hundred seventeenth embodiments, wherein indexing comprises rotating a tool receptacle within the canister.

A two hundred nineteenth embodiment can include the method of any one of the two hundred sixteenth to two hundred eighteenth embodiments, wherein unsecuring the tool comprises decoupling the tool from within the chamber (e.g. from the tool receptacle) (e.g. using rotation and/or push/pull).

A two hundred twentieth embodiment can include the method of any one of the two hundred seventh to two hundred nineteenth embodiments, further comprising disposing the tool on a wireline (e.g. a distal end of the wireline) in the subsea work chamber (e.g. coupling the tool to the wireline or to another tool attached to the wireline and/or making up a tool string).

A two hundred twenty-first embodiment can include the method of the two hundred twentieth embodiment, further comprising isolating the tool attached to the wireline from the subsea work chamber and lowering the tool into the well (e.g. to perform well intervention).

A two hundred twenty-second embodiment can include the method of the two hundred twenty-first embodiment, wherein isolating the tool comprises disposing the tool in a lubricator section/system (e.g. either lowering the tool into a lower lubricator conduit and sealing the lower lubricator conduit from the subsea work chamber or lowering a telescoping conduit of the lubricator section to enclose the tool and seal with respect to the work chamber), wherein once the tool is fully disposed in the lubricator section, the subsea work chamber is isolated from the lubricator section and the wellhead.

A two hundred twenty-third embodiment can include the method of any one of the two hundred twenty-first to two hundred twenty-second embodiments, wherein lowering the tool into the well comprises pressurizing the isolated lubricator section (e.g. above the lubricator valve) and opening the lubricator valve (e.g. to place the tool and/or lubricator section into communication with the wellhead).

A two hundred twenty-fourth embodiment can include the method of the two hundred twenty-third embodiment, wherein pressurizing the isolated lubricator section comprises increasing the pressure therein to approximately equal that of the wellhead (e.g. pumping sea water into the lubricator section until its pressure is approximately the same as that of the wellhead).

A two hundred twenty-fifth embodiment can include the method of any one of the two hundred seventh to two hundred twenty-fourth embodiments, wherein depressurizing the port comprises pumping fluid (e.g. sea water) out of the sealed section of the port (e.g. when the canister is docked in the port).

A two hundred twenty-sixth embodiment can include the method of any one of the two hundred seventh to two hundred twenty-fifth embodiments, wherein depressurizing the port comprises reducing pressure in the port (e.g. the sealed section of the port) to approximately be equal to that of the subsea work chamber (e.g. approximately atmospheric pressure).

A two hundred twenty-seventh embodiment can include the method of any one of the two hundred seventh to two hundred twenty-sixth embodiments, further comprising (e.g. after use of the tool is complete) inserting the tool into the canister (e.g. by robotic assembly mechanism, for example after removal from the wireline); attaching the canister cap to the canister (e.g. to seal the tool within the canister); attaching the port cap to the port (to seal the interior of the port); pressurizing the port (e.g. pumping fluid into the space between the external seal and the port cap); and removing the canister from the pod (e.g. via ROV or external wireline system).

A two hundred twenty-eighth embodiment can include the method of the two hundred twenty-seventh embodiment, wherein pressurizing the port comprises pumping fluid (e.g. seawater) into of the sealed section of the port (e.g. when the canister is docked in the port).

A two hundred twenty-ninth embodiment can include the method of any one of the two hundred twenty-seventh to two hundred twenty-eighth embodiments, wherein pressurizing the port comprises increasing pressure in the port (e.g. the sealed section of the port) to approximately be equal to that of the external subsea environment.

A two hundred thirtieth embodiment can include the method of any one of the two hundred twenty-seventh to two hundred twenty-eighth embodiments, wherein pressurizing the port comprises over-pressurizing the port (e.g. to a pressure in excess of the eternal sea pressure) (e.g. which may eject the canister from the port).

A two hundred thirty-first embodiment can include the method of any one of the two hundred seventh to two hundred thirtieth embodiments, wherein the canister comprises a port seal on its exterior surface configured to sealingly engage within the port to form the sealed section (e.g. with the canister cap of the docked canister disposed between the port cap and the port seal).

A two hundred thirty-second embodiment can include the method of any one of the two hundred seventh to two hundred thirty-first embodiments, wherein the port comprises a port seal configured to sealingly engage the docked canister to form the sealed section (e.g. with the canister cap of the docked canister disposed between the port cap and the port seal).

A two hundred thirty-third embodiment can include the method of any one of the two hundred seventh to two hundred thirty-second embodiments, using the canister of any one of the thirty-fourth to fifty fourth embodiments, the subsea work chamber of any one of the first to thirty-third embodiments, the tool insertion system (e.g. see with respect to the lubricator system) of any one of the eighty-third to one hundred forty-eighth embodiments, and/or the subsea tool provision system of any one of the fifty-fifth to eighty-second embodiments (e.g, wherein the method comprises the canister of any one of the thirty-fourth to fifty fourth embodiments, the subsea work chamber of any one of the first to thirty-third embodiments, the tool insertion system (e.g. lubricator system) of any one of the eighty-third to one hundred forty-eighth embodiments, the subsea tool provision system of any one of the fifty-fifth to eighty-second embodiments, and/or the subsea well intervention system of any one of the one hundred forty-ninth to one hundred sixty-ninth embodiments).

In a two hundred thirty-fourth embodiment, a method of removing a tool from a subsea tool canister inserted/docked within a port of a subsea work chamber, wherein the tool canister holds a plurality of tools, can comprise: indexing, by a robotic assembly mechanism, to select a desired tool from the plurality of tools; unlatching/decoupling/unsecuring, by a robotic assembly mechanism, the selected tool from the canister; and/or removing, by a robotic assembly mechanism, the tool from the canister.

A two hundred thirty-fifth embodiment can include the method of the two hundred thirty-fourth embodiment, wherein indexing comprises using, by a robotic assembly mechanism, an indexing tool to select the tool (e.g. by interfacing the indexing tool with the canister).

A two hundred thirty-sixth embodiment can include the method of any one of the two hundred thirty-fourth to two hundred thirty-fifth embodiments, wherein indexing comprises rotating, by a robotic assembly mechanism, a tool receptacle within the canister (e.g. to align the desired tool, for example with an opening in the canister).

A two hundred thirty-seventh embodiment can include the method of the two hundred thirty-sixth embodiments, wherein rotating comprises using the indexing tool disposed in the subsea work chamber.

A two hundred thirty-eighth embodiment can include the method of any one of the two hundred thirty-fourth to two hundred thirty-seventh embodiments, wherein indexing comprises lifting (e.g. with the indexing tool) the tool receptacle (e.g. off a location retainer element) and rotating the tool receptacle to advance the tool location (e.g. to position the tool over the opening) (e.g. the tool receptacle is eccentric with respect to the canister and/or the opening in the canister).

A two hundred thirty-ninth embodiment can include the method of any one of the two hundred thirty-fourth to two hundred thirty-eighth embodiments, wherein indexing comprises orienting the robotic assembly mechanism with respect to the desired tool.

A two hundred fortieth embodiment can include the method of any one of the two hundred thirty-fourth to two hundred thirty-ninth embodiments, wherein indexing/rotating comprises operating (e.g. by robotic assembly mechanism) an electric motor used to rotate the tool carousel to position for retrieval or insertion of the wireline tool, a hydraulic motor or actuator to carry out the carousel indexing, or a simple ratchet wrench attached to the carousel center pin to rotate and index the tool carousel to the needed position.

A two hundred forty-first embodiment can include the method of any one of the two hundred thirty-fourth to two hundred fortieth embodiments, wherein removing the tool comprises grasping, by a robotic assembly mechanism, the tool and removing (e.g. sliding) the tool out of the tool receptacle and/or canister.

A two hundred forty-second embodiment can include the method of any one of the two hundred thirty-fourth to two hundred forty-first embodiments, wherein removing the tool comprises, by a robotic assembly mechanism, using a removal tool (e.g. to interface with the tool and/or canister).

A two hundred forty-third embodiment can include the method of any one of the two hundred thirty-fourth to two hundred forty-second embodiments, wherein unlatching comprises rotating (e.g. to unscrew threading or decouple bayonet attachment) and/or axially pushing (e.g. pen mechanism) (e.g. moving the tool to unlatch a j-slot mechanism) (e.g. in some embodiments, unlatching can include using a second hand tool (e.g. a removal tool) designed with a small diameter tip that fits through an opening to lift the wireline tool; a shoulder on the hand tool then contacts the orifice ring, which rotates as it is lifted; this rotation aligns the eccentric hole with the center of the carrier tube, allowing the wireline tool to be removed from the canister.)

A two hundred forty-fourth embodiment can include the method of any one of the two hundred thirty-fourth to two hundred forty-third embodiments, wherein the robotic assembly mechanism is disposed within the work chamber.

A two hundred forty-fifth embodiment can include the method of any one of the two hundred thirty-fourth to two hundred forty-fourth embodiments, wherein the robotic assembly mechanism comprises an arm.

A two hundred forty-sixth embodiment can include the method of any one of the two hundred thirty-fourth to two hundred forty-fifth embodiments, wherein the robotic assembly mechanism comprises two arms, wherein a first arm operates the removal tool and a second arm grabs the tool (e.g. as it projects and/or ejects out of the tool receptacle and/or canister) (e.g. for manipulation of the tool in the work chamber).

A two hundred forty-seventh embodiment can include the method of any one of the two hundred thirty-fourth to two hundred forty-sixth embodiments, wherein the latching mechanism for the tool comprises a spiral slit with lateral divot disposed on the slit.

A two hundred forty-eighth embodiment can include the method of the two hundred forty-seventh embodiment, wherein unlatching comprises rotating (e.g. a locking pin on the tool) the tool out of the divot and pulling the tool out of the canister (e.g. with the locking pin sliding in the slit).

A two hundred forty-ninth embodiment can include the method of any one of the two hundred thirty-fourth to two hundred forty-eighth embodiments, further comprising inserting, by a robotic assembly mechanism, the tool into the canister (e.g. after its use in the work chamber and/or well).

A two hundred fiftieth embodiment can include the method of the two hundred forty-ninth embodiment, wherein inserting comprises pushing the tool into the canister (e.g. into the tool receptacle, for example through the aligned opening) (e.g. with the locking pin sliding in the slit) and rotating the tool (e.g. to place the locking pin into the divot (in some embodiments, pushing and rotating may occur simultaneously) (e.g. in some embodiments, inserting can include rotation of the orifice ring to move the eccentric hole to not align with the carrier tube and to retain the wireline tool in its carrier tube).

A two hundred fifty-first embodiment can include the method of any one of the two hundred thirty-fourth to two hundred fiftieth embodiments, using the canister of any one of the thirty-fourth to fifty fourth embodiments, the subsea work chamber of any one of the first to thirty-third embodiments, the tool insertion system (e.g. see with respect to the lubricator system) of any one of the eighty-third to one hundred forty-eighth embodiments, and/or the subsea tool provision system of any one of the fifty-fifth to eighty-second embodiments (e.g, wherein the method comprises the canister of any one of the thirty-fourth to fifty fourth embodiments, the subsea work chamber of any one of the first to thirty-third embodiments, the tool insertion system (e.g. lubricator system) of any one of the eighty-third to one hundred forty-eighth embodiments, the subsea tool provision system of any one of the fifty-fifth to eighty-second embodiments, and/or the subsea well intervention system of any one of the one hundred forty-ninth to one hundred sixty-ninth embodiments).

A two hundred fifty-second embodiment can include the method of any one of the two hundred thirty-fourth to two hundred fifty-first embodiments, further comprising providing one or more tool to the subsea work chamber by insertion of a tool canister into a port of the work chamber, for example using the method of any one of the two hundred seventh to two hundred thirty-third embodiments.

In a two hundred fifty-third embodiment, a method of inserting a tool from a subsea work chamber into a wellhead can comprise: coupling, by a robotic assembly mechanism (e.g. disposed in the subsea work chamber), a tool to a wireline (e.g. a distal end of the wireline) disposed in the work chamber; moving/lowering a wireline stuffing box (e.g. from a retracted position to an extended position) to seal a lubricator conduit (e.g. lower lubricator conduit and/or connector) that is coupled to the wellhead and/or to isolate the subsea work chamber from a lubricator valve and/or from the lubricator conduit; pressurizing the lubricator conduit (e.g. to approximately wellbore pressure); opening the lubricator valve disposed between the wellhead and the chamber; and lowering/moving, by the wireline, the tool into the wellhead.

A two hundred fifty-fourth embodiment can include the method of the two hundred fifty-third embodiment, wherein moving/lowering the wireline stuffing box comprises isolating the wireline and the tool from the subsea work chamber.

A two hundred fifty-fifth embodiment can include the method of any one of the two hundred fifty-third to two hundred fifty-fourth embodiments, wherein the lubricator conduit is coupled between the work chamber and the wellhead.

A two hundred fifty-sixth embodiment can include the method of any one of the two hundred fifty-third to two hundred fifty-fifth embodiments, wherein the lubricator conduit is coupled to the wellhead through the lubricator valve and/or a safety valve.

A two hundred fifty-seventh embodiment can include the method of any one of the two hundred fifty-third to two hundred fifty-sixth embodiments, wherein moving/lowering a wireline stuffing box seals/isolates the work chamber from the lubricator conduit and/or lubricator valve.

A two hundred fifty-eighth embodiment can include the method of any one of the two hundred fifty-third to two hundred fifty-seventh embodiments, wherein the work chamber is maintained at approximately atmospheric pressure.

A two hundred fifty-ninth embodiment can include the method of any one of the two hundred fifty-third to two hundred fifty-eighth embodiments, wherein the wireline stuffing box is attached/coupled to a telescoping (e.g. inner) conduit, and wherein moving the wireline stuffing box comprises axially shifting the telescoping conduit from a retracted position, configured to provide access to the wireline in the work chamber, to an extended position, configured to span the work chamber (e.g. into sealing connection and/or fluid communication with the lubricator conduit and/or to isolate the subsea work chamber from the lubricator valve).

A two hundred sixtieth embodiment can include the method of the two hundred fifty-ninth embodiment, wherein in the extended position, the telescoping conduit is sealingly coupled to the lubricator conduit (e.g. isolating the work chamber from the distal end of the wireline).

A two hundred sixty-first embodiment can include the method of any one of the two hundred fifty-ninth to two hundred sixtieth embodiments, wherein the wireline stuffing box is disposed at the distal end of the telescoping conduit (e.g. distal to/away from a wireline reeler unit), at a proximal end of the telescoping conduit (e.g. proximal/closest to the wireline reeler unit), or within the telescoping conduit.

A two hundred sixty-second embodiment can include the method of any one of the two hundred fifty-ninth to two hundred sixty-first embodiments, wherein the wireline stuffing box is sealingly coupled to the telescoping conduit.

A two hundred sixty-third embodiment can include the method of any one of the two hundred fifty-third to two hundred sixty-second embodiments, wherein moving a wireline stuffing box comprises disposing the tool on the wireline into the lubricator conduit (which in some embodiments may occur when the telescoping conduit is extended).

A two hundred sixty-fourth embodiment can include the method of any one of the two hundred fifty-third to two hundred sixty-third embodiments, wherein pressurizing the lubricator conduit occurs when the tool is disposed in the lubricator conduit (e.g. between the work chamber and the lubricator valve and/or within the extended telescoping conduit).

A two hundred sixty-fifth embodiment can include the method of any one of the two hundred fifty-third to two hundred sixty-fourth embodiments, wherein pressurizing the lubricator conduit occurs when the wireline stuffing box and/or telescoping conduit are in the extended position.

A two hundred sixty-sixth embodiment can include the method of any one of the two hundred fifty-third to two hundred sixty-fifth embodiments, wherein pressurizing the lubricator conduit comprises pumping fluid (e.g. from the external sea environment) into a space above the lubricator valve (e.g. between the lubricator valve and the wireline stuffing box).

A two hundred sixty-seventh embodiment can include the method of any one of the two hundred fifty-third to two hundred sixty-sixth embodiments, further comprising opening a safety valve disposed between the lubricator valve and the wellhead.

A two hundred sixty-eighth embodiment can include the method of any one of the two hundred fifty-third to two hundred sixty-seventh embodiments, wherein the tool is configured for removal of a wellcap/plug, further comprising using the tool to remove the wellcap; retracting (e.g. via the wireline, which is retracted) the wellcap into the lubricator conduit (e.g. between the lubricator valve and the work chamber and/or within the extended telescoping conduit); closing the lubricator valve; depressurizing the lubricator conduit (e.g. pumping fluid out of the lubricator conduit until the pressure in the lubricator conduit is approximately the same as pressure in the work chamber—e.g. approximately atmospheric pressure); moving the wireline stuffing box and/or telescoping conduit (e.g. to the retracted position) so that the chamber is not isolated from the lubricator conduit; moving the tool and wellcap (e.g. via wireline retraction) into the work chamber; and removing, by robotic assembly mechanism, the tool from the wireline.

A two hundred sixty-ninth embodiment can include the method of any one of the two hundred fifty-third to two hundred sixty-eighth embodiments, wherein the tool is configured for well intervention (e.g. paraffin scraping, gas lift valve replacement, logging the well, setting or pulling well plugs, etc.), further comprising using the tool for well intervention; retracting (e.g. via the wireline, which is retracted) the tool into the lubricator conduit (e.g. between the lubricator valve and the work chamber and/or within the extended telescoping conduit); closing the lubricator valve; depressurizing the lubricator conduit (e.g. pumping fluid out of the lubricator conduit until the pressure in the lubricator conduit is approximately the same as pressure in the work chamber—e.g. approximately atmospheric pressure); moving the wireline stuffing box and/or telescoping conduit (e.g. to the retracted position) so that the chamber is not isolated from the lubricator conduit; moving the tool (e.g. via wireline retraction) into the work chamber; and removing, by robotic assembly mechanism, the tool from the wireline.

A two hundred seventieth embodiment can include the method of the two hundred sixty-ninth embodiment, further comprising coupling, by the robotic assembly mechanism, a second (e.g. different) tool to the wireline disposed in the work chamber; moving/lowering the wireline stuffing box and/or telescoping conduit (e.g. from the retracted position to the extended position) to seal the lubricator conduit that is coupled to the wellhead and/or to isolate the work chamber from the lubricator valve and/or to isolate the work chamber from the distal end of the wireline; pressurizing the lubricator conduit (e.g. to approximately wellbore pressure); opening the lubricator valve disposed between the wellhead and the chamber; and lowering/moving, by the wireline, the second tool into the wellhead.

A two hundred seventy-first embodiment can include the method of any one of the two hundred fifty-third to two hundred seventieth embodiments, further comprising washing/rinsing the tool as it is moved from the lubricator conduit into the work chamber (e.g. using a wash ring and/or scrubber).

A two hundred seventy-second embodiment can include the method of any one of the two hundred fifty-third to two hundred seventy-first embodiments, further comprising operating a sump system to dispose of (e.g. eject) any fluid entering the work chamber (e.g. from the lubricator conduit and/or tool and/or wash ring).

A two hundred seventy-third embodiment can include the method of the two hundred seventy-second embodiments, wherein the sump system ejects/pumps the fluid into the wellhead (e.g. either by pumping into the lubricator conduit or below the lubricator valve) and/or into the production tubing (e.g. leading to the surface).

A two hundred seventy-fourth embodiment can include the method of any one of the two hundred fifty-third to two hundred seventy-third embodiments, further comprising providing the tool from a canister having a plurality of tools, for example using the method of any one of the two hundred thirty-fourth to two hundred fifty-second embodiments.

A two hundred seventy-fifth embodiment can include the method of any one of the two hundred fifty-third to two hundred seventy-fourth embodiments, further comprising providing one or more tool to the subsea work chamber by insertion of a tool canister into a port of the work chamber, for example using the method of any one of the two hundred seventh to two hundred thirty-third embodiments.

A two hundred seventy-sixth embodiment can include the method of any one of the two hundred fifty-third to two hundred seventy-fifth embodiments, wherein the lubricator valve is coupled directly to the work chamber, and the lubricator conduit comprises the coupling.

A two hundred seventy-seventh embodiment can include the method of any one of the two hundred fifty-third to two hundred seventy-sixth embodiments, further comprising making up, by robotic assembly mechanism, a tool string comprising two or more tools (e.g. from the same tool canister).

A two hundred seventy-eighth embodiment can include the method of the two hundred seventy-seventh embodiment, wherein the tool string is made up in the work chamber and/or wherein making up comprises coupling two or more tools together (e.g. and then to the wireline).

A two hundred seventy-ninth embodiment can include the method of any one of the two hundred fifty-third to two hundred seventy-eighth embodiments, further comprising producing the well (e.g. in some embodiments production may occur even as tools are disposed in and/or used for the well, for example with respect to well intervention).

A two hundred eightieth embodiment can include the method of any one of the two hundred fifty-third to two hundred seventy-ninth embodiments, using the canister of any one of the thirty-fourth to fifty fourth embodiments, the subsea work chamber of any one of the first to thirty-third embodiments, the tool insertion system (e.g. see with respect to the lubricator system/section) of any one of the eighty-third to one hundred forty-eighth embodiments, and/or the subsea tool provision system of any one of the fifty-fifth to eighty-second embodiments (e.g, wherein the method comprises the canister of any one of the thirty-fourth to fifty fourth embodiments, the subsea work chamber of any one of the first to thirty-third embodiments, the tool insertion system (e.g. lubricator system) of any one of the eighty-third to one hundred forty-eighth embodiments, the subsea tool provision system of any one of the fifty-fifth to eighty-second embodiments, and/or the subsea well intervention system of any one of the one hundred forty-ninth to one hundred sixty-ninth embodiments).

In a two hundred eighty-first embodiment, a method of inserting a tool from a subsea work chamber into a wellhead, comprising: coupling, by a robotic assembly mechanism, a tool to a wireline disposed in the subsea work chamber; isolating the subsea work chamber from a lubricator section/system and/or a tool insertion system and/or from a lubricator valve and/or from the wireline;

pressurizing the lubricator section/system and/or tool insertion system (e.g. to approximately wellbore pressure) (wherein the wireline and/or tool are disposed in the lubricator section/system during pressurization); opening the lubricator valve disposed between the wellhead and the subsea work chamber; and lowering/moving, by the wireline, the tool into the wellhead.

A two hundred eighty-second embodiment can include the method of the two hundred eighty-first embodiment, wherein isolating the subsea work chamber from a lubricator section/system and/or from a lubricator valve comprises isolating the wireline and the tool from the subsea work chamber.

A two hundred eighty-third embodiment can include the method of any one of the two hundred eighty-first to two hundred eighty-second embodiments, wherein the subsea work chamber is initially isolated from the wellhead by the lubricator valve.

A two hundred eighty-fourth embodiment can include the method of any one of the two hundred eighty-first to two hundred eighty-third embodiments, wherein the lubricator valve is initially closed (e.g. closing the isolator valve, for example before coupling, isolating or pressurizing).

A two hundred eighty-fifth embodiment can include the method of any one of the two hundred eighty-first to two hundred eighty-fourth embodiments, wherein isolating the subsea work chamber comprises moving/lowering a wireline stuffing box (e.g. from a retracted position to an extended position and/or to seal a (e.g. lower) lubricator conduit that is coupled to the wellhead and/or to isolate the subsea work chamber from the lubricator valve and/or the distal end of the wireline).

A two hundred eighty-sixth embodiment can include the method of any one of the two hundred eighty-first to two hundred eighty-fifth embodiments, wherein the (e.g. lower) lubricator conduit is coupled between the work chamber and the wellhead and/or wherein the lubricator conduit is coupled to the wellhead through the lubricator valve and/or a safety valve.

A two hundred eighty-seventh embodiment can include the method of any one of the two hundred eighty-first to two hundred eighty-sixth embodiments, wherein moving/lowering a wireline stuffing box seals/isolates the work chamber from the lubricator conduit and/or lubricator valve.

A two hundred eighty-eighth embodiment can include the method of any one of the two hundred eighty-first to two hundred eighty-seventh embodiments, wherein the lubricator valve is coupled directly to the work chamber (e.g. by a connector), and the lubricator conduit comprises the coupling/connector.

A two hundred eighty-ninth embodiment can include the method of any one of the two hundred eighty-first to two hundred eighty-eighth embodiments, wherein the work chamber is maintained at approximately atmospheric pressure.

A two hundred ninetieth embodiment can include the method of any one of the two hundred eighty-first to two hundred eighty-ninth embodiments, wherein the wireline stuffing box is attached/coupled to a telescoping (e.g. inner) conduit, and wherein moving the wireline stuffing box comprises axially shifting the telescoping conduit from a retracted position, configured to provide access to the distal end of the wireline in the work chamber, to an extended position, configured to span the work chamber (e.g. into sealing connection and/or fluid communication with the lubricator conduit) and/or to isolate the work chamber from the lubricator valve and/or the distal end of the wireline.

A two hundred ninety-first embodiment can include the method of the two hundred ninetieth embodiment, wherein the lubricator valve is coupled directly to the work chamber, and the lubricator conduit comprises the coupling and/or the telescoping conduit.

A two hundred ninety-second embodiment can include the method of any one of the two hundred ninetieth to two hundred ninety-first embodiments, wherein in the extended position, the telescoping conduit is sealingly coupled to the lubricator conduit (e.g. the lower lubricator conduit and/or the coupling/connector).

A two hundred ninety-third embodiment can include the method of any one of the two hundred ninetieth to two hundred ninety-second embodiments, wherein the wireline stuffing box is disposed at the distal end of the telescoping conduit (e.g. distal to/away from a wireline reeler unit), at a proximal end of the telescoping conduit (e.g. proximal/closest to the wireline reeler unit), or within the telescoping conduit.

A two hundred ninety-fourth embodiment can include the method of any one of the two hundred ninetieth to two hundred ninety-third embodiments, wherein the wireline stuffing box is sealingly coupled to the telescoping conduit.

A two hundred ninety-fifth embodiment can include the method of any one of the two hundred eighty-first to two hundred ninety-fourth embodiments, wherein moving a wireline stuffing box comprises disposing the tool on the wireline into the lubricator conduit (e.g. into the lower lubricator conduit and/or the extended telescoping conduit).

A two hundred ninety-sixth embodiment can include the method of any one of the two hundred eighty-first to two hundred ninety-fifth embodiments, wherein pressurizing the lubricator conduit occurs when the tool is disposed in the lubricator conduit (e.g. between the work chamber and the lubricator valve or within the extended telescoping conduit).

A two hundred ninety-seventh embodiment can include the method of any one of the two hundred eighty-first to two hundred ninety-sixth embodiments, wherein pressurizing the lubricator conduit occurs when the wireline stuffing box and/or telescoping conduit are in the extended position.

A two hundred ninety-eighth embodiment can include the method of any one of the two hundred eighty-first to two hundred ninety-seventh embodiments, wherein pressurizing the lubricator conduit comprises pumping fluid (e.g. from the external sea environment) into a space above the lubricator valve (e.g. between the lubricator valve and the wireline stuffing box).

A two hundred ninety-ninth embodiment can include the method of any one of the two hundred eighty-first to two hundred ninety-eighth embodiments, further comprising opening a safety valve disposed between the lubricator valve and the wellhead.

A three hundredth embodiment can include the method of any one of the two hundred eighty-first to two hundred eighty-fourth embodiments, wherein isolating the subsea work chamber comprises (e.g. axially) shifting a telescoping conduit from a retracted position, configured to provide access to the distal end of the wireline in the work chamber, to an extended position, configured to span the work chamber (e.g. into sealing connection and/or fluid communication with the lubricator conduit and/or lubricator valve) and/or to isolate the subsea work chamber from the lubricator valve and/or to isolate the work chamber from the distal end of the wireline.

A three hundred first embodiment can include the method of the three hundredth embodiment, wherein in the extended position, the telescoping conduit is sealingly coupled to the (e.g. lower) lubricator conduit, the connector, and/or the lubricator valve.

A three hundred second embodiment can include the method of any one of the three hundredth to three hundred first embodiments, wherein isolating the subsea work chamber from a lubricator section/system and/or from a lubricator valve comprises isolating the wireline and the tool from the subsea work chamber (e.g. within the extended telescoping conduit).

A three hundred third embodiment can include the method of any one of the three hundredth to three hundred second embodiments, wherein lowering/moving by the wireline comprises using a wireline reeler unit to alter an amount of the wireline extending from a wireline stuffing box (e.g. to extend and/or retract the wireline from the wireline stuffing box).

A three hundred fourth embodiment can include the method of any one of the three hundredth to three hundred third embodiments, further comprising fluidly isolating the telescoping conduit from the wireline reeler unit.

A three hundred fifth embodiment can include the method of the three hundred fourth embodiment, wherein fluidly isolating the telescoping conduit from the wireline reeler unit comprises providing a seal between the stuffing box and the wireline reeler unit and/or between the stuffing box and the telescoping conduit and/or between a guide conduit (e.g. in which the telescoping conduit is configured to move axially).

A three hundred sixth embodiment can include the method of any one of the three hundred fourth to three hundred fifth embodiments, wherein fluidly isolating the telescoping conduit from the wireline reeler unit comprises disposing the wireline stuffing box between the wireline reeler unit and the lubricator valve and/or telescoping conduit.

A three hundred seventh embodiment can include the method of any one of the three hundredth to three hundred sixth embodiments, wherein the wireline stuffing box is fixed with respect to the wireline reeler unit and/or guide conduit and/or subsea work chamber, and/or wherein the telescoping conduit is configured to move (e.g. axially) with respect to the wireline stuffing box (e.g. the wireline stuffing box is not fixed/coupled to the telescoping conduit).

A three hundred eighth embodiment can include the method of any one of the three hundredth to three hundred seventh embodiments, wherein pressurizing the lubricator conduit occurs when the tool is disposed in the lubricator conduit (e.g. between the work chamber and the lubricator valve or within the extended telescoping conduit).

A three hundred ninth embodiment can include the method of any one of the three hundredth to three hundred eighth embodiments, wherein pressurizing the lubricator conduit occurs when the telescoping conduit is in the extended position.

A three hundred tenth embodiment can include the method of any one of the three hundredth to three hundred ninth embodiments, wherein pressurizing the lubricator conduit occurs when the subsea work chamber is isolated from lubricator system/section and/or lubricator valve and/or telescoping conduit.

A three hundred eleventh embodiment can include the method of any one of the three hundredth to three hundred tenth embodiments, wherein pressurizing the lubricator conduit comprises pumping fluid (e.g. from the external sea environment) into a space above the lubricator valve (e.g. between the lubricator valve and the wireline stuffing box, for example including the extended telescoping conduit).

A three hundred twelfth embodiment can include the method of any one of the three hundredth to three hundred eleventh embodiments, further comprising opening a safety valve disposed between the lubricator valve and the wellhead.

A three hundred thirteenth embodiment can include the method of any one of the two hundred eighty-first to three hundred twelfth embodiments, using the canister of any one of the thirty-fourth to fifty fourth embodiments, the subsea work chamber of any one of the first to thirty-third embodiments, the tool insertion system (e.g. see with respect to the lubricator system/section) of any one of the eighty-third to one hundred forty-eighth embodiments, and/or the subsea tool provision system of any one of the fifty-fifth to eighty-second embodiments (e.g, wherein the method comprises the canister of any one of the thirty-fourth to fifty fourth embodiments, the subsea work chamber of any one of the first to thirty-third embodiments, the tool insertion system (e.g. lubricator system) of any one of the eighty-third to one hundred forty-eighth embodiments, the subsea tool provision system of any one of the fifty-fifth to eighty-second embodiments, and/or the subsea well intervention system of any one of the one hundred forty-ninth to one hundred sixty-ninth embodiments).

A three hundred fourteenth embodiment can include the method of any one of the two hundred eighty-first to three hundred thirteenth embodiments, wherein the subsea work chamber is operatively coupled to the wellhead by the tool insertion system (e.g. which can include the lubricator section/system, for example with at least portions (such as the lower lubricator conduit, the connector, and/or the lubricator valve) disposed below the subsea work chamber, the wireline reeler unit, disposed above the subsea work chamber, and the wireline stuffing box and/or telescoping conduit (e.g. which may interact with both the wireline reeler unit and the lubricator sections and/or may span the work chamber in the extended position).

A three hundred fifteenth embodiment can include the system of any one of the fifty-fifth to eighty-second embodiments, wherein the chamber comprises a floatation device (e.g. configured to make the chamber and/or system lightweight or ultra-lightweight and/or to provide approximately neutral buoyancy).

A three hundred sixteenth embodiment can include the system of any one of the fifty-fifth to eighty-second or three hundred fifteenth embodiments, wherein the chamber is configured to be coupled to the wellhead (e.g. via a tool insertion system or a lubricator section).

A three hundred seventeenth embodiment can include the system of any one of the fifty-fifth to eighty-second or three hundred fifteenth to three hundred sixteenth embodiments, wherein the chamber further comprises an external wireline system configured to provide one or more tool canister from the surface to the port of the work chamber.

A three hundred eighteenth embodiment can include the system of any one of the fifty-fifth to eighty-second or three hundred fifteenth to three hundred seventeenth embodiments, wherein the chamber comprises a robotic assembly mechanism disposed in its interior work space (e.g. configured to remove tools from the canister and/or attach the tools to a wireline).

A three hundred nineteenth embodiment can include the system of any one of the fifty-fifth to eighty-second or three hundred fifteenth to three hundred eighteenth embodiments, wherein the robotic assembly mechanism comprises conventional robotics configured for use at approximately atmospheric pressure.

A three hundred twentieth embodiment can include the system of any one of the fifty-fifth to eighty-second or three hundred fifteenth to three hundred nineteenth embodiments, wherein the chamber is configured to maintain approximately atmospheric pressure therein (e.g. even when disposed subsea, for example in proximity to a subsea wellhead).

A three hundred twenty-first embodiment can include the method of any one of the one hundred seventieth to two hundred sixth embodiments, wherein: coupling the lubricator system comprises coupling a lubricator valve between the subsea work chamber and the wellhead, configuring the wireline reeler unit comprises coupling a moveable wireline stuffing box between the wireline reeler unit and the lubricator valve, the wireline stuffing box has a retracted position and an extended position, the retracted position provides fluid communication between the subsea work chamber and the lubricator valve and/or allows access to the distal end of the wireline, and/or the extended position isolates the subsea work chamber from the lubricator valve and/or the distal end of the wireline.

A three hundred twenty-second embodiment can include the method of any one of the two hundred thirty-fourth to two hundred fifty-second embodiments, wherein indexing and/or tool latching/retention and/or tool removal is digitally verified, for example by electronic communication from the canister (e.g. the memory storage of the canister) to the robotic assembly mechanism 550.

A three hundred twenty-third embodiment can include the method of any one of the two hundred thirty-fourth to two hundred fifty-second embodiments or the three hundred twenty-second embodiment, further comprising communicating data (e.g. digital data/communication, for example regarding canister docking, depressurization of the port (e.g. based on a sensor in the port and/or on the canister), pressure within the canister, tool position (e.g. for indexing), tool coupling/latching (e.g. for verification of status), proof of life, power status, and/or diagnostic information) from the canister (e.g. from its memory storage) to the robotic assembly mechanism.

A three hundred twenty-fourth embodiment can include the method of any one of the two hundred thirty-fourth to two hundred fifty-second embodiments or the three hundred twenty-second to three hundred twenty-third embodiments, wherein the communication is via a wired (e.g. by terminal contact when the canister is inserted into/docked with the port) or wireless solution, such as RFID, Bluetooth, or other means.

A three hundred twenty-fifth embodiment can include the method of any one of the two hundred thirty-fourth to two hundred fifty-second embodiments or the three hundred twenty-second to three hundred twenty-fourth embodiments, wherein the robotic assembly mechanism uses the communication (e.g. the digital information provided by the docked canister) to perform tele-operated or automated tasks associated with the wireline tool utilization (for example, to remove the canister cap and/or the port cap (e.g. once depressurization of the port has been verified), to properly index to the desired tool, to verify that the tool has been unlatched (e.g. before attempting to remove it), to select and/or operate the indexing and/or removal tool, to verify that the tool has been latched (e.g. before indexing again and/or replacing the canister cap), to verify that the tool is in good working order and/or has sufficient power, to select the desired tools in the desired order for effective toolstring make-up, etc.).

A three hundred twenty-sixth embodiment can include the method of any one of the two hundred thirty-fourth to two hundred fifty-second embodiments or the three hundred twenty-second to three hundred twenty-fifth embodiments, further comprising communication (e.g. using similar wired or wireless means) between the robotic assembly mechanism and the canister and/or updating of the memory storage of the canister (e.g. after usage of the tool and/or insertion of the tool back into the canister) (e.g. regarding operating time downhole to update tool life (e.g. for use in anticipating end of service life and/or replacement or repair), to update tools onboard the canister and/or tool location (e.g. for future indexing), regarding diagnostic information relating to the tool, etc.).

A three hundred twenty-seventh embodiment can include the method of any one of the two hundred thirty-fourth to two hundred fifty-second embodiments or the three hundred twenty-second to three hundred twenty-sixth embodiments, wherein re-latching the tool in the canister comprises communicating between the tool and the canister (e.g. to update the canister memory based on communication from the tool (e.g. which may be a smart tool, with one or more sensor and/or with its own memory storage), for example upon insertion and/or based on contact connection or wireless communication).

A three hundred twenty-eighth embodiment can include the method of any one of the two hundred thirty-fourth to two hundred fifty-second embodiments or the three hundred twenty-second to three hundred twenty-seventh embodiments, further comprising communicating (e.g. wirelessly) with (e.g. sending a signal to) the ROV (e.g. from the canister and/or the chamber and/or the robotic assembly mechanism), for example to activate retrieval and/or removal of the canister from the port.

A three hundred twenty-ninth embodiment can include the method of the three hundred twenty-eighth embodiment, wherein communicating with the ROV occurs only after and/or in response to coupling the canister cap to the canister and the port cap to the port of the chamber.

A three hundred thirtieth embodiment can include the method of the three hundred twenty-eighth or three hundred twenty-ninth embodiments, wherein communicating with the ROV comprises communicating information about the tools in the ROV (e.g. to allow for updating of records regarding location of various tools, for example when the canister is stored).

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with, and vice versa. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=Rl+k*(Ru-Rl)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . . 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded. The use of the terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

What is claimed is:

1. A subsea work chamber comprising:

a subsea work chamber configured to withstand subsea pressure and having an internal work space therein;

one or more port configured for tool canister docking;

a robotic assembly mechanism disposed in the internal work space;

a first connector configured for coupling of the subsea work chamber with a wellhead;

a second connector configured for coupling of a wireline reeler unit to the subsea work chamber; and a floatation device configured for floatation of the subsea work chamber, wherein the subsea work chamber is configured to be disposed subsea and tethered to the wellhead.

2. The subsea work chamber of claim 1, wherein the chamber is configured to retain approximately atmospheric pressure.

3. The subsea work chamber of claim 2, wherein the robotic assembly mechanism comprises conventional robotic equipment configured to operate in approximately atmospheric conditions.

4. The subsea work chamber of claim 1, further comprising a sump system configured to eject liquids from the internal work space.

5. The subsea work chamber of claim 1, wherein each port comprises a removable port cap configured to sealingly close the port, and wherein each port is configured to sealingly receive the corresponding tool canister.

6. The subsea work chamber of claim 1, wherein the chamber is filled with oil and pressurized to approximately the same pressure as an external subsea environment, and the robotic assembly mechanism is configured for use under such pressure.

7. The work chamber of claim 1, further comprising a wash ring disposed in proximity to the first connector and configured to wash tools being retracted out of the lubricator system.

8. A subsea work chamber comprising:

a subsea work chamber configured to withstand subsea pressure and having an internal work space therein;

one or more port configured for tool canister docking;

a robotic assembly mechanism disposed in the internal work space;

a first connector configured for coupling of the subsea work chamber with a wellhead; and a second connector configured for coupling of a wireline reeler unit to the subsea work chamber, wherein each port comprises a removable port cap configured to sealingly close the port, wherein each port is configured to sealingly receive the corresponding tool canister, wherein the tool canister comprises an open end that is sealed closed by a removable canister cap, and wherein inserting the capped canister open end into the port creates a sealed section of the port around the canister cap, and the subsea work chamber further comprises a pump configured to pump fluid in and out of the sealed section.

9. The subsea work chamber of claim 8, wherein the port comprises a canister guide mechanism configured to guide the capped open end of the canister into the port.

10. A subsea work chamber comprising:

a subsea work chamber configured to withstand subsea pressure and having an internal work space therein;

one or more port configured for tool canister docking;

a robotic assembly mechanism disposed in the internal work space;

a first connector configured for coupling of the subsea work chamber with a wellhead; and a second connector configured for coupling of a wireline reeler unit to the subsea work chamber; and an external wireline system configured to provide one or more tool canisters from the surface to the subsea work chamber.

11. The work chamber of claim 10, wherein the one or more port comprises two or more ports, and wherein the external wireline system is configured to rotate between the two or more ports.

12. A tool canister for delivery of well intervention tools to a subsea work chamber comprising:

a canister configured to hold one or more tool and having an open end; and a removable canister cap configured to sealingly close the open end of the canister;

wherein:

the canister is configured to sealingly engage with a port of the subsea work chamber to create a sealed section around the canister cap, the canister holds approximately atmospheric pressure therein, and the canister is configured for use in a subsea environment, the capped open end of the canister is configured for insertion into the port, thereby nesting the canister cap within a port cap of the port of the subsea work chamber.

13. The canister of claim 12, further comprising a port seal configured to sealingly engage within the port of the subsea work chamber, wherein the port seal is disposed on an exterior surface of the canister.

14. The canister of claim 12, further comprising a flotation device.

15. A subsea well intervention system for providing well intervention for a subsea wellhead comprising:

a tool insertion system; and a subsea work chamber;

wherein:

the tool insertion system is operatively coupled to the subsea work chamber and to the wellhead, the subsea work chamber and the tool insertion system are disposed undersea, the tool insertion system comprises:

a wireline reeler unit having a wireline;

a lubricator valve;

a lubricator section; and a wireline stuffing box;

wherein:

the wireline from the wireline reeler unit passes through the wireline stuffing box, with the wireline reeler unit configured to control the amount of wireline extending beyond the wireline stuffing box;

the tool insertion system comprises a retracted position and an extended position;

the retracted position provides fluid communication between the subsea work chamber and the lubricator valve; and the extended position isolates the subsea work chamber from the lubricator valve.

16. The system of claim 15, wherein the subsea work chamber comprises:

a subsea work chamber configured to withstand subsea pressure and having an internal work space therein;

a port configured for tool canister docking;

a removable port cap configured to sealingly close the port;

a robotic assembly mechanism disposed in the internal work space; and a floatation device;

wherein:

the subsea work chamber has approximately atmospheric pressure;

the robotic assembly mechanism comprises conventional robotic equipment configured to operate in approximately atmospheric pressure; and the subsea work chamber is disposed subsea and tethered to the wellhead.

17. The system of claim 16, further comprising one or more tool canister, wherein the tool canister comprises:

a canister configured to hold one or more tool and having an open end; and a removable canister cap configured to sealingly close the open end of the canister;

wherein:

the canister is configured to sealingly engage with a port of the subsea work chamber to create a sealed section around the canister cap, the canister holds approximately atmospheric pressure therein, and the canister is configured for use in a subsea environment.

18. The system of claim 17, further comprising a mechanism configured to provide the tool canister to the subsea work chamber.

19. The system of claim 18, wherein the mechanism comprises an ROV.

20. The system of claim 18, wherein the mechanism comprises an external wireline system coupled to a surface ship or platform.

* * * * *